US012220061B2

(12) United States Patent
Leng

(10) Patent No.: US 12,220,061 B2
(45) **Date of Patent: *Feb. 11, 2025**

(54) FURNITURE CONSTRUCTION WITH ELASTIC OR SPRING MODULES

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD, Xiamen (CN)

( * ) Notice: Subject to any disclaimer, the term of this patent is extended or adjusted under 35 U.S.C. 154(b) by 1144 days.

This patent is subject to a terminal disclaimer.

(21) Appl. No.: 17/079,976

(22) Filed: Oct. 26, 2020

(65) Prior Publication Data

US 2021/0037988 A1 Feb. 11, 2021

Related U.S. Application Data

(60) Division of application No. 15/832,081, filed on Dec. 5, 2017, now Pat. No. 10,869,559, which is a (Continued)

(30) Foreign Application Priority Data

Jun. 3, 2016 (CN) ..... 201610394625.X

(51) Int. Cl.
*A47C 27/20* (2006.01)
*A47C 7/14* (2006.01)

(Continued)

(52) U.S. Cl.
CPC ..... *A47C 27/20* (2013.01); *A47C 7/14* (2013.01); *A47C 7/144* (2018.08); *A47C 7/185* (2013.01);

(Continued)

(58) Field of Classification Search
CPC ... A47C 27/001; A47C 27/0456; A47C 27/05; A47C 27/062; A47C 27/064;

(Continued)

(56) References Cited

U.S. PATENT DOCUMENTS 1,944,614 A * 1/1934 Salmon ..... A47C 27/065 123/169 PH
2,841,209 A 7/1958 Wetzler (Continued)

FOREIGN PATENT DOCUMENTS

CN 201048750 Y 4/2008
CN 201246370 Y 5/2009

(Continued)

OTHER PUBLICATIONS

CNIPA, "Search Report", for Chinese Application No. 201610394625.X, Oct. 15, 2020.

(Continued)

*Primary Examiner* — David R Hare
(74) *Attorney, Agent, or Firm* — Perkins Coie LLP

(57) ABSTRACT

Furniture is assembled from elastic modules enabling rapid and convenient assembly and disassembly. The elastic module has a spring, an outer covering layer, and an end member attached to an end face of the outer covering layer. A mattress includes a plurality of individual spring assemblies (145), with each spring assembly including at least one spring (134) and a spring cap (144, 150, 161, 164, 171, 184, 194, 204). Each spring cap has at least one first attachment fitting (168, 178, 174, 186, 196) and at least one second attachment fitting (169, 180, 176, 187) with each first attachment fitting engageable into or onto and removable from a second attachment fitting of an adjoining spring cap. The spring assemblies are attached to each other via the first and second attachment fittings, forming the individual (Continued)

spring assemblies into a spring core. A top pad is positioned on top of the spring core.

20 Claims, 104 Drawing Sheets

Related U.S. Application Data continuation-in-part of application No. PCT/CN2017/087130, filed on Jun. 5, 2017.

(51) Int. Cl.

| | |
|---|---|
| ***A47C 7/18*** | (2006.01) |
| ***A47C 7/34*** | (2006.01) |
| ***A47C 7/35*** | (2006.01) |
| ***A47C 23/00*** | (2006.01) |
| ***A47C 23/043*** | (2006.01) |
| ***A47C 27/00*** | (2006.01) |
| ***A47C 27/045*** | (2006.01) |
| ***A47C 27/05*** | (2006.01) |
| ***A47C 27/06*** | (2006.01) |
| ***A47C 27/07*** | (2006.01) |

(52) U.S. Cl.

CPC ..... *A47C 7/347* (2013.01); *A47C 7/35* (2013.01); *A47C 23/002* (2013.01); *A47C 23/005* (2013.01); *A47C 27/001* (2013.01); *A47C 27/0456* (2013.01); *A47C 27/05* (2013.01); *A47C 27/062* (2013.01); *A47C 27/064* (2013.01); *A47C 27/065* (2013.01); *A47C 27/07* (2013.01); *A47C 7/34* (2013.01); *A47C 7/342* (2013.01); *A47C 23/0438* (2013.01); *A47C 27/066* (2013.01)

(58) Field of Classification Search

CPC ..... A47C 27/065; A47C 27/066; A47C 27/07; A47C 27/20; A47C 7/14; A47C 7/144; A47C 7/185; A47C 7/34; A47C 7/342; A47C 7/347; A47C 7/35; A47C 23/002; A47C 23/005; A47C 23/0438

USPC ..... 5/717, 720

See application file for complete search history.

(56) References Cited

U.S. PATENT DOCUMENTS

| | | | | |
|---|---|---|---|---|
| 3,031,690 | A * | 5/1962 | Ramsay | A47C 23/002 297/284.3 |
| 3,099,844 | A | 8/1963 | Bolesky | |
| 3,145,020 | A * | 8/1964 | Calla | A47C 27/20 267/143 |
| 4,956,884 | A * | 9/1990 | Hwang | A47C 23/0431 267/179 |
| 5,353,455 | A | 10/1994 | Loving et al. | |
| 5,426,799 | A | 6/1995 | Ottiger | |
| 5,471,688 | A | 12/1995 | Cavazos | |
| 5,485,639 | A * | 1/1996 | Cavazos | A47C 27/07 5/259.1 |
| 5,957,438 | A * | 9/1999 | Workman | B68G 9/00 5/655.8 |
| 6,113,082 | A | 9/2000 | Fujino | |
| 6,128,798 | A * | 10/2000 | Barman | A47C 27/05 5/654.1 |
| 7,661,165 | B2 | 2/2010 | Piccinini | |
| 8,246,023 | B2 | 8/2012 | Cappeller | |
| 9,131,782 | B1 * | 9/2015 | Baker | A47C 27/001 |
| 9,586,453 | B2 * | 3/2017 | Mizukoshi | F16F 1/122 |
| 10,869,559 | B2 * | 12/2020 | Leng | A47C 27/0456 |
| 11,019,937 | B2 * | 6/2021 | Leng | A47C 7/35 |
| 11,889,926 | B1 * | 2/2024 | Leng | A47C 27/065 |
| 2003/0110566 | A1 | 6/2003 | Stumpf | |
| 2004/0123384 | A1 * | 7/2004 | Fromme | A47C 23/002 5/255 |
| 2008/0098533 | A1 * | 5/2008 | Erdman | A47C 27/001 5/722 |
| 2009/0106908 | A1 | 4/2009 | Defranks et al. | |
| 2009/0126107 | A1 * | 5/2009 | Kuo | A47C 27/148 5/724 |
| 2011/0004998 | A1 * | 1/2011 | Losio | A47C 23/002 5/699 |
| 2011/0179580 | A1 * | 7/2011 | Wieland | A47C 27/065 5/690 |
| 2012/0131752 | A1 * | 5/2012 | Mason | A47C 27/148 5/655.8 |
| 2015/0000229 | A1 | 1/2015 | Leng et al. | |
| 2017/0340129 | A1 | 11/2017 | Leng | |
| 2018/0027976 | A1 | 2/2018 | Leng | |

FOREIGN PATENT DOCUMENTS

| | | | |
|---|---|---|---|
| CN | 101568281 | A | 10/2009 |
| CN | 101959443 | A | 1/2011 |
| CN | 102370366 | A | 3/2012 |
| CN | 203641359 | U | 6/2014 |
| CN | 204617668 | U | 9/2015 |
| CN | 204812976 | U | 12/2015 |
| CN | 204838771 | U | 12/2015 |
| CN | 204931031 | U | 1/2016 |
| CN | 106473508 | A | 3/2017 |
| DE | 20314109 | U1 | 1/2004 |
| EP | 1989974 | A1 | 11/2008 |
| FR | 1191747 | A | 10/1959 |
| FR | 2915661 | B1 | 9/2012 |
| KR | 20090079642 | A | 7/2009 |
| RS | 1452 | U1 | 4/2016 |
| WO | 2013002500 | A2 | 1/2013 |
| WO | 2016148594 | A1 | 9/2016 |

OTHER PUBLICATIONS

EPO , "extended European Search Report", for European Application No. 20198400.2, Oct. 15, 2020.

USPTO, Final Office Action for U.S. Appl. No. 15/533,375 dated Oct. 19, 2020, 15 pages.

Chinese Office Action and Search Report dated Jul. 7, 2021 for Application No. 2017800443054.

Extended European Search Report dated Jan. 23, 2020 for Application No. 17805906.9, 14 pages.

EPO, Application No. 16845693.7, Extended European Search Report dated Feb. 21, 2019, 6 pages.

PCT, International Search Report for International Application No. PCT/CN2017/087130. Mail Date: Aug. 29, 2017. 4 pages.

PCT, Written Opinion for International Application No. PCT/CN2017/087130. Mail Date: Aug. 29, 2017. 4 pages.

SIPO, The Second Office Action for Application No. 201610394625.X dated Apr. 14, 2021, 10 pages.

SIPO, First Office Action for Application No. 201610394625.X dated Nov. 13, 2020, 10 pages.

* cited by examiner

FURNITURE CONSTRUCTION WITH ELASTIC OR SPRING MODULES

CROSS REFERENCE TO RELATED APPLICATIONS

This application is a divisional of U.S. application Ser. No. 15/832,081, filed Dec. 5, 2017, now U.S. Pat. No. 10,869,559, which is a continuation in part of International Application No. PCT/CN2017/087130, filed Jun. 5, 2017, which claims the benefit of Chinese Patent Application No. 201610394625.X, filed Jun. 3, 2016, both of which are incorporated herein by reference in their entirety.

FIELD OF THE INVENTION

The field of the invention is furniture and mattresses and modules which can be assembled into a furniture pad or mattress.

BACKGROUND OF THE INVENTION

With urbanization, population movement is accelerated and more frequent. In the house-moving process, disassembling and moving large furniture, like a couch, bed, etc., is difficult. At times, large and still useable furniture is discarded to ease the burden of the move. Accordingly, designing furniture so that it can be easily disassembled and/or assembled (e.g. with or without using tools), may greatly reduce the energy, time and economic costs consumed in the moving process.

A couch or bed typically consists of a frame (a bed frame or couch frame), a spring pad (couch cushion or bed mattress) and an outer cover (a cloth or leather cover, etc.). Most spring pads have a traditional form in which a plurality of overlaid layers and springs are formed into an integral pad. The integral pad conventionally includes a plurality of elastic elements (e.g. springs) substantially arranged in a plane and various sponge or rubber mass layers integrally covering the outer sides of the springs to provide a comfortable support. Generally the spring pad is an un-detachable integral structure.

A so-called "independently bagged spring" bed mattress is intended to prevent two or more persons simultaneously lying on a bed from influencing one another (e.g. if the weight difference between individuals is relatively great, one person inevitably influences the other(s) when turning over or moving his/her body). In this type of mattress, each spring is separately packaged in a bag or sleeve made of non-woven fabrics or other materials. The spring bags are arranged in a pattern and afterwards the outside of the arranged spring bag group is covered by an integral piece of foam rubber by adhesion, binding, etc., to produce the desired spring pad in the form of a furniture pad or mattress. However, the finished spring pad is still an integral product. Since the individually packaged spring bags are not separable or removable from the mattress, the mattress is still overly large, making it difficult to move or store.

Accordingly, there is a need for improved furniture designs, and for designs which can be more easily disassembled, moved and re-assembled, and also more easily stored.

BRIEF STATEMENT OF THE INVENTION

In one aspect, an elastic or spring module includes at least one spring, and an outer covering layer formed of a foam or sponge type material surrounding the spring. The elastic module may also have an end member on a bottom or end face of the outer covering layer. The end member, if used, includes a module connecting structure for attaching the elastic module to another optionally identical elastic module. The end member may also include a frame connecting element for attaching the elastic module to a support frame, such as a bed frame or a couch frame. The module connecting structure, and the frame connecting element, if used, can be manually attached and detached preferably without using tools. The module connecting structure and the frame connecting element may optionally be attached to the outer covering layer if desired, or if no end member is used.

In the elastic module the springs and an outer covering layer (e.g. an outer foam rubber or similar covering layer of e.g., polyurethane) provide a comfortable support for a user. A spring pad or mattress made up of elastic modules may be quickly assembled or dis-assembled. Thus, furniture which can be much more easily moved and stored is provided.

An outer end face of the elastic module may have an ergonomic curvature, such that a plurality of elastic modules, when assembled as for example into a couch, can have a configuration conforming to the back of the human body.

The module connecting structure, which may be on the end member, in one form includes a recess in a sidewall of a plate of the end member of a first elastic module, and a protrusion on a sidewall of a plate of the module connecting structure of an adjoining second elastic module, with the protrusion configured to engage into the recess. As another example, the module connecting structure includes a recess on the outward surface of the end member of a first elastic module, and a protrusion on the outward surface of the end member of an adjoining second elastic module, with the protrusion configured to have a shape complementary to the recess. By snapping the recess of the end member of one elastic module into engagement with a complementary protrusion of the end member on another elastic module, the two elastic modules may be horizontally or vertically mounted. Alternatively, the module connecting structure may have a mounting hole formed on a body or plate of the end member, with the hole receiving a separate locking piece such that a plurality of the elastic modules can be detachably coupled together. The end member may be metal, plastic or a sponge material.

In another aspect, the spring may be a spiral spring, specifically a cylinder spiral spring, conical spiral spring, middle-portion-convex or concave spiral spring, or a spiral spring formed by nesting a left-handed spring and a right-handed spring. The outer covering layer and the spring can be integrally foam-molded within a mold. That is, the spring may be a metal spring, or the spring may be non-metal plastic or molded material. At least one spring may be nested on a core located in the middle of the mold before molding. The outer covering layer may be foam-molded independently of the spring, with the middle portion removed for arranging the spring. The outer covering layer may partially surround the spring. With the spring molded together with the outer covering layer, the spring and the outer covering layer are provided as integral unit, with the spring made of the molding material.

In a separate aspect a mattress includes a plurality of individual spring assemblies, with each spring assembly including at least one conical spring and a spring cap. Each spring cap has at least one first attachment fitting and at least one second attachment fitting with each first attachment fitting engageable into or onto, and removable from, a second attachment fitting of an adjoining spring cap. The spring assemblies may be identical to each other. The spring assemblies are attached to each other via the first and second attachment fittings, forming the individual spring assemblies into a spring core. A top pad is positioned on top of the spring core. Side pads may be positioned around a perimeter of the top pad and/or the spring core. The mattress can be quickly and easily assembled and dis-assembled, without tools, and stored in a compact space by removing the top pad and separating the spring assemblies from each other. The springs and spring caps can then be formed in nested stacked columns, with the column of springs contained inside of the column of spring caps. Spring clips may be used instead of spring caps.

In another aspect, a mattress includes a flat webbing and a plurality of spring caps attachable to the flat webbing. A plurality of springs are provided with each spring attachable to a spring cap. A top pad is positioned on top of the springs. The flat webbing may be flexible to allow the webbing to be rolled up into a tube or folded up, and the flat webbing may be perforated or have a grid pattern of through openings.

Elements described in one embodiment may of course be used separately or in combination in other embodiments.

BRIEF DESCRIPTION OF DRAWINGS

In the drawings, the dimensions do not necessarily represent actual dimensions or scale of the designs. The drawings are only illustrative, and certain non-essential elements may be omitted for clarity.

FIG. 35C is a top and front perspective view of the spring cap shown in

FIG. 35A.

FIG. 39F is a left view of the stacked column of springs and spring caps shown in FIG. 39A.

FIG. 39G is a right view of the stacked column of springs and spring caps shown in FIG. 39A.

FIG. 40A is a perspective view of the springs and spring caps of a larger size mattress in two stacked columns in a container, for storage or transport.

FIG. 40B is a perspective view of the springs and spring caps of the spring core in a stacked column for storage or transport, as shown in FIG. 40A.

FIG. 40C is a bottom view of the stacked column of springs and spring caps shown in FIG. 40B.

FIG. 40D is a front view of the stacked column of springs and spring caps shown in FIG. 40B.

FIG. 40E is a top view of the stacked column of springs and spring caps shown in FIG. 40B.

FIG. 40F is a back view of the stacked column of springs and spring caps shown in FIG. 40B.

FIG. 40G is a left view of the stacked column of springs and spring caps shown in FIG. 40B.

FIG. 40H is a right view of the stacked column of springs and spring caps shown in FIG. 40B.

FIG. 41 is a perspective view of another spring cap.

Figure 41:
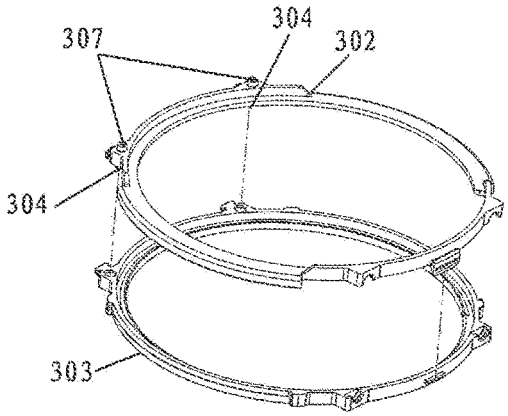
Figure 42A:
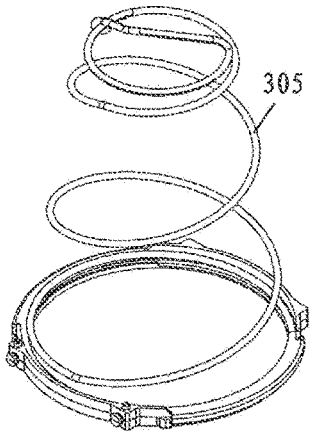
Figure 43:
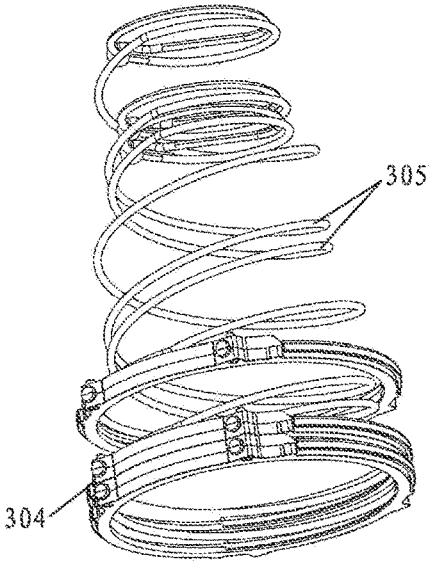
Figure 44:
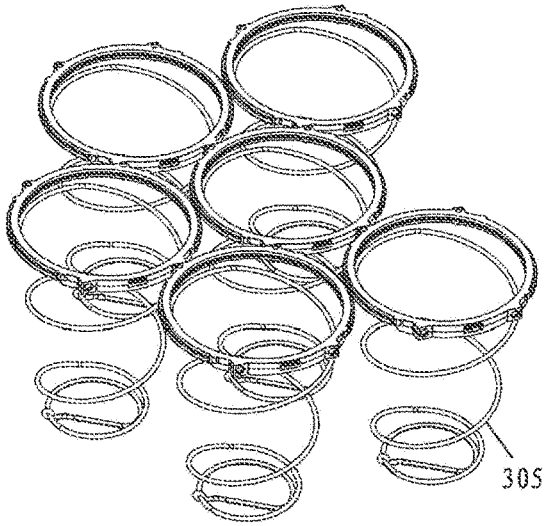

FIGS. 42A, 43, and 44 are perspective views of a sequence of assembly of the spring element shown in FIG. 41.

Figure 42B:
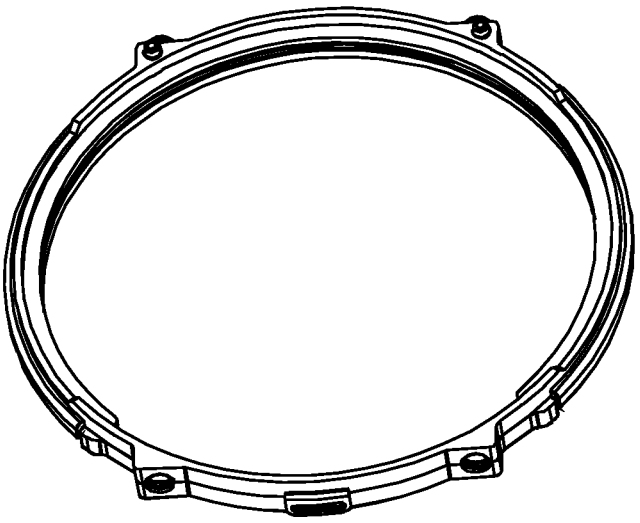

FIG. 42B is a perspective view of the element shown in FIG. 42A.

Figure 42C:
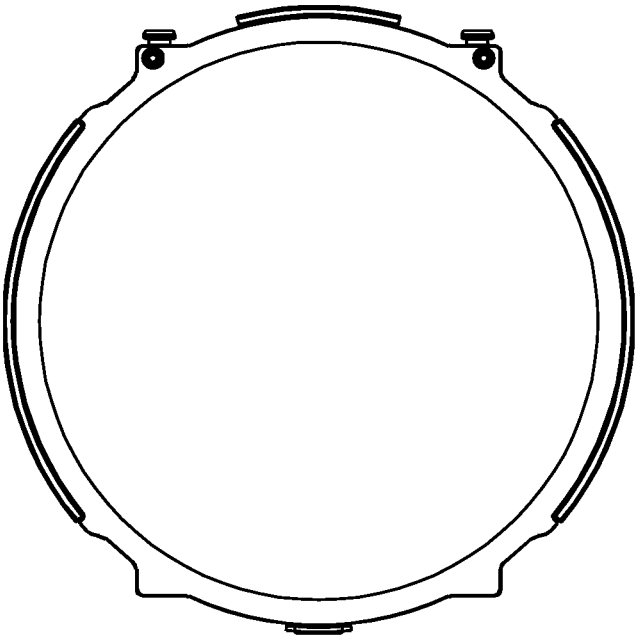

FIG. 42C is a bottom view of the element shown in FIG. 42B.

Figure 42D:
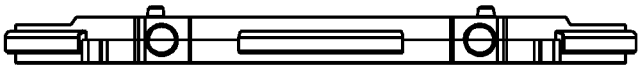

FIG. 42D is a front view of the element shown in FIG. 42B.

Figure 42E:
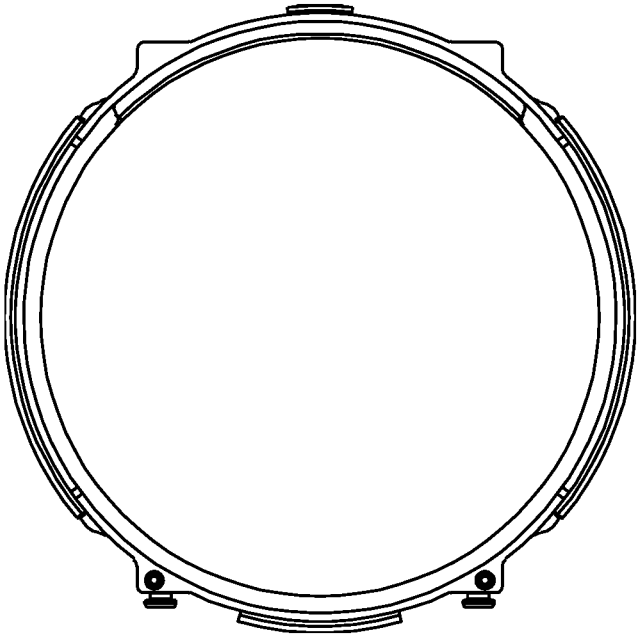

FIG. 42E is a top view of the element shown in FIG. 42B.

Figure 42F:
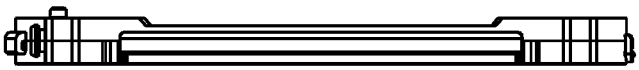

FIG. 42F is a back view of the element shown in FIG. 42B.

Figure 42G:
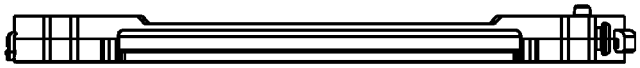

FIG. 42G is a left view of the element shown in FIG. 42B.

Figure 42H:
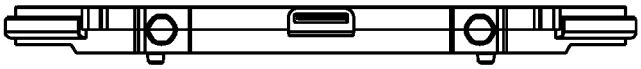

FIG. 42H is a right view of the element shown in FIG. 42B.

Figure 45:
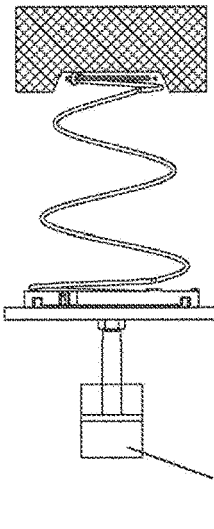
Figure 46:
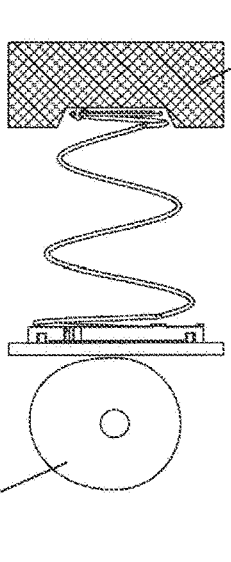
Figure 47:
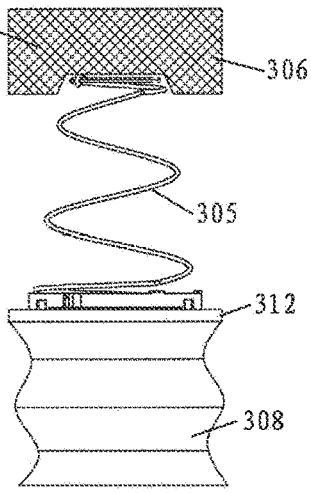

FIGS. 45 to 47 are schematic diagrams of actuators acting on a mattress element.

Figure 48:
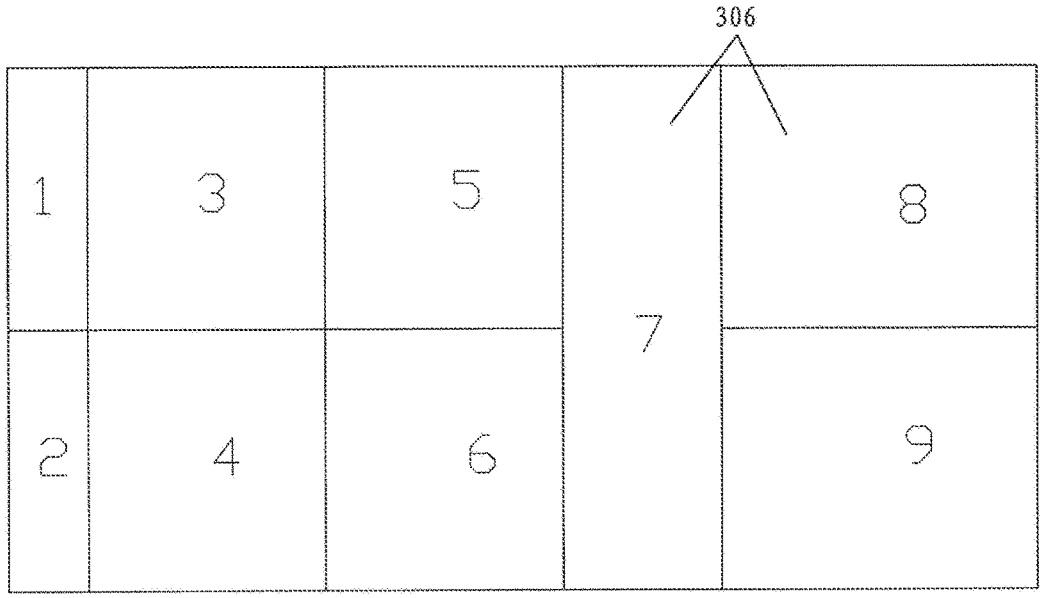

FIG. 48 is a top view of a mattress divided into separate sections moveable vertically.

Figure 49:
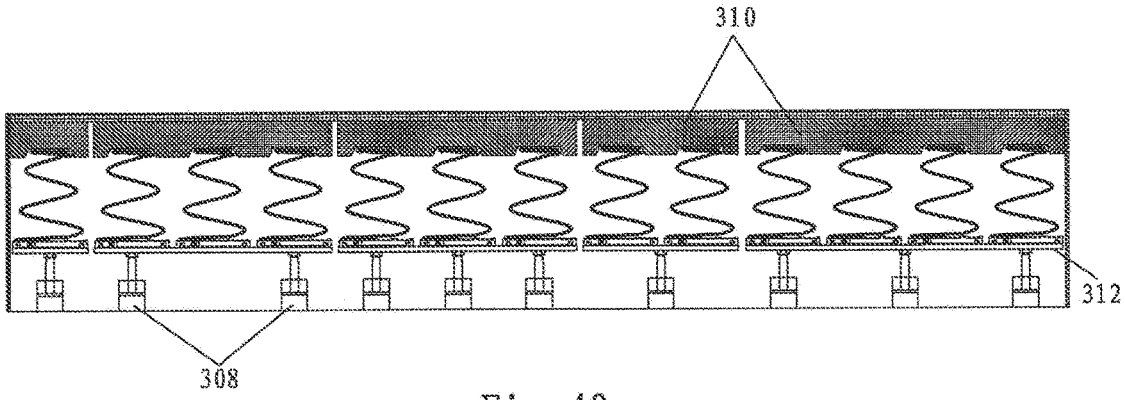

FIG. 49 is a section view of the mattress of FIG. 48.

FIGS. 50-54 are section views of operations of a mattress having separate sections movable vertically.

DETAILED DESCRIPTION

Figure 1A:
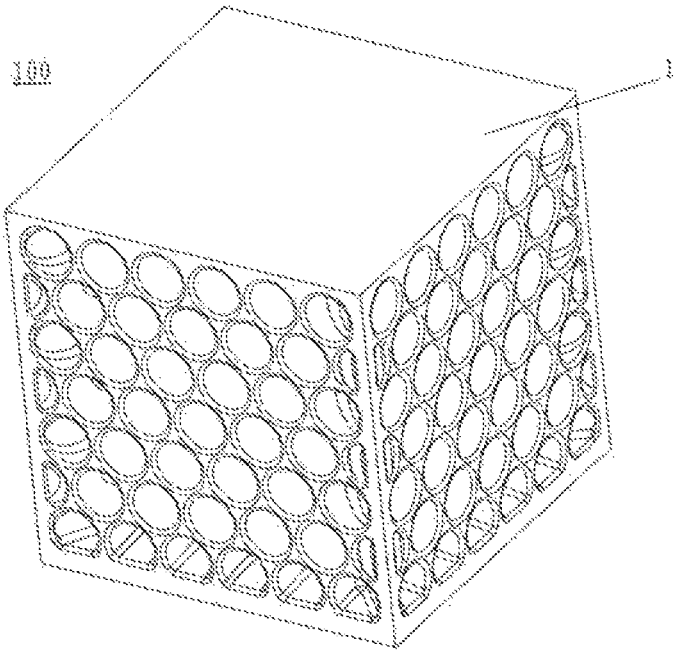
FIG. 1*a*-FIG. 1*b* are respectively a perspective view and a sectional view of an elastic module.
Figure 1B:
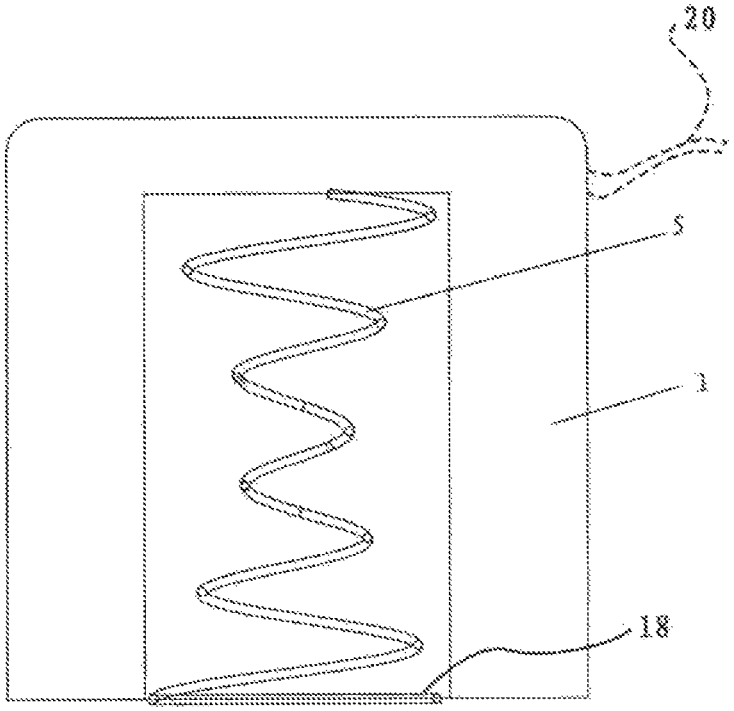
Figure 2:
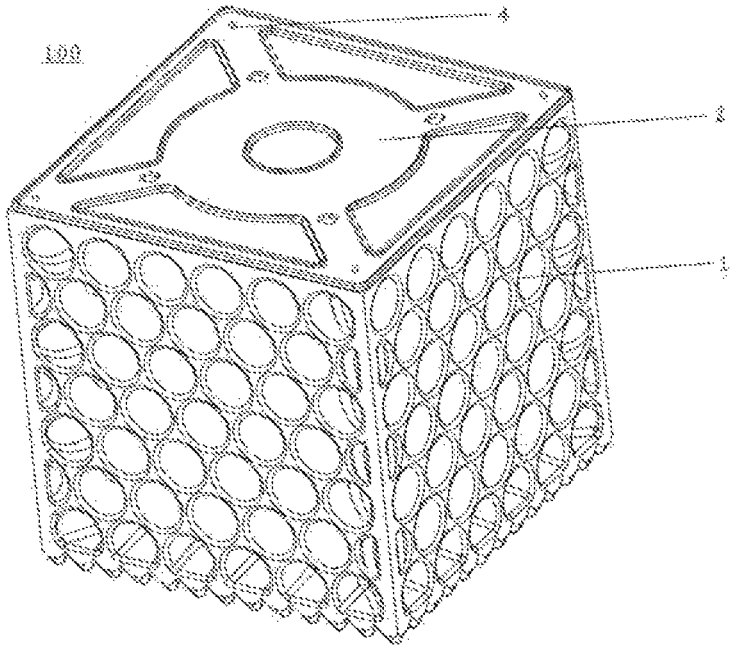
FIG. 2 is a perspective view of an elastic module provided with an end member in another embodiment.

FIG. 1*a* and FIG. 1*b* are respectively a perspective view and a sectional view schematically illustrating an elastic module 100 having a spring 5, and an elastic outer covering layer 1 formed of e.g., polyurethane sponge and surrounding the spring completely or partially. The spring 5 is disposed in the outer covering layer 1 in such a manner that the spring 5 can be substantially static relative to the outer covering layer 1, so that the spring moves with the outer covering layer 1. The elastic module 100 may be made in at least two ways.

In the first way mainly by utilizing a foaming process, the spring 5 and the outer covering layer 1 are simultaneously integrally formed with each other. The specific operation steps can be similar to those of the foaming process for a vehicle seat. In brief, the spring 5 is nested on a mold core located in a middle of a mold, like a foam box. Since the elastic deformation of foam-molded polyurethane sponge cannot be readily recovered, the elastic force of the spring 5 may be adversely influenced. Nesting the spring 5 over the core avoids this undesirable possibility. In this first way the integrally formed spring 5 and outer covering layer 1 are obtained when the foaming or molding process is completed.

In the second way, the foaming process is first used to make the outer covering layer 1 of polyurethane foam material, and then the middle portion of the foaming-formed outer covering layer is hollowed out. The volume of the hollowed region may be adjusted based on the number of the springs 5 to be included in the elastic module. Next, the springs 5 are placed in the hollowed region. To form an interference fit between the springs 5 and the outer covering layer 1, the dimension of the hollowed region should be smaller than the space occupied by the springs 5. In this embodiment, the spring may be attached to the outer covering layer 1, or it may be only contained within the outer covering layer 1.

Figure 9A:
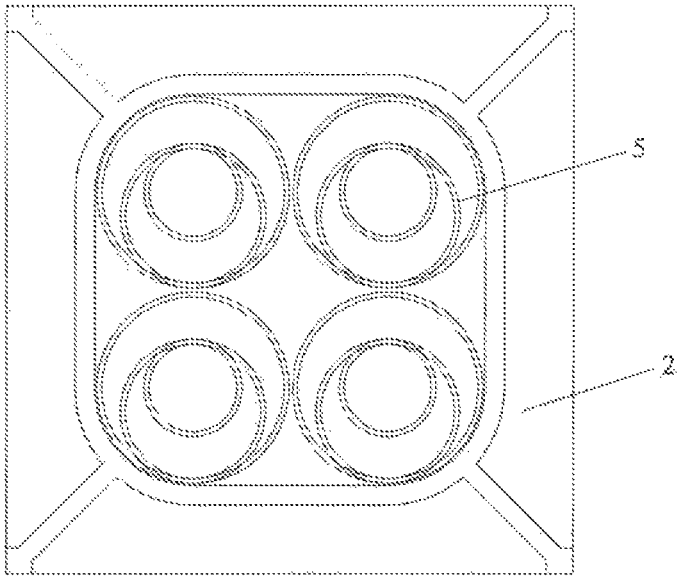
FIG. 9*a*-FIG. 9*c*.
Figure 9B:
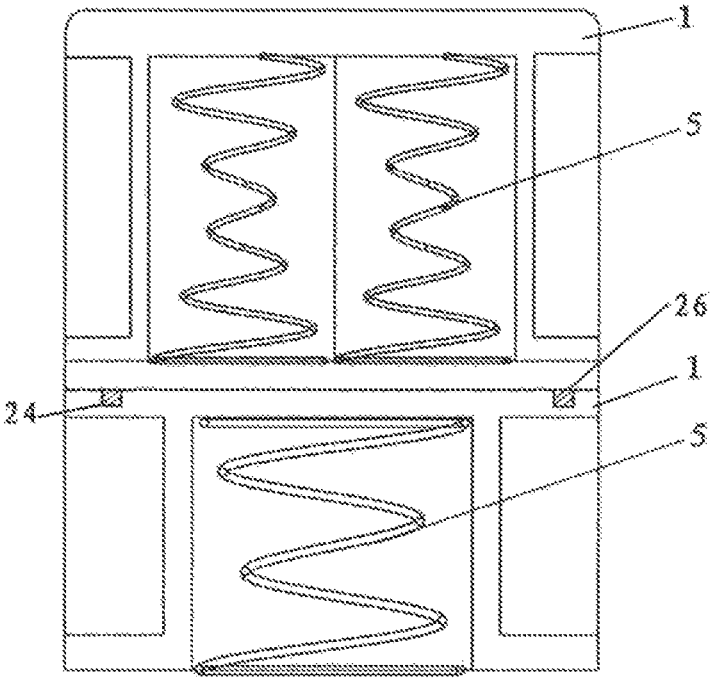
Figure 9C:
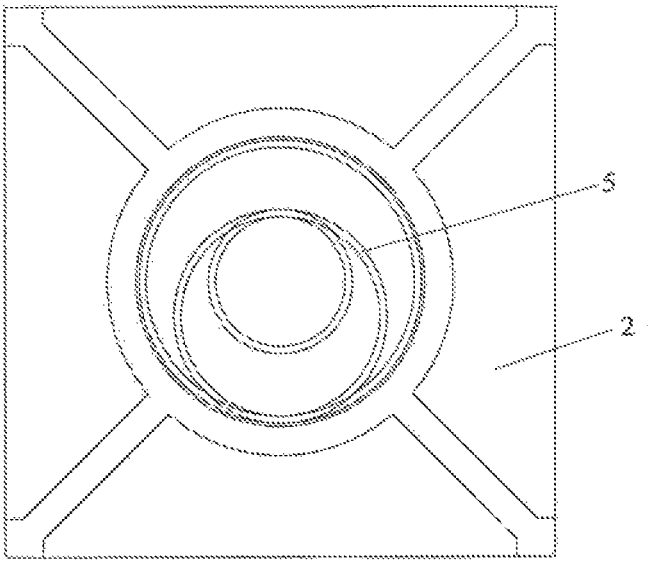

As shown in FIG. 9*a*-FIG. 9*b*, four springs 5 are disposed in one outer covering layer 1, with each of springs 5 preferably spaced apart by a portion of the outer covering layer 1. In other words, in the first way of the integral foaming process, the number of the cores is preferably equal to the number of springs 5, while in the second way of forming a hollow portion by removing a portion of a foaming body, a portion of polyurethane foaming body is preferably retained between each of the hollow portions, providing a dividing wall between adjacent springs.

In either case the spring 5 should have a certain pre-load or pre-tension after the mounting or assembling is completed, so as to better achieve a relatively static relation of the springs with the outer covering layer 1.

In order to detachably assemble elastic modules 100, a user may purchase elastic modules 100 in a certain number conforming to a dimension of a desired furniture, as well as a fabric cover having a dimension matching with the volume of the certain number of the elastic modules 100, like a couch cover, a bed cover, etc. The user can then place the elastic modules 100 into the cover, arrange them in a certain mode, and finally close the cover (via a zipper, snaps, hook and loop tape, etc.) to provide an integral and detachable bed mattress. Ideally, the elastic modules 100 are preferably not movable in horizontal directions after being placed into the cover; in other words, the elastic modules 100 will remain in place relative to the cover.

To combine a plurality of elastic modules 100 more firmly as a whole, the surface of the outer covering layer 1 may be provided with non-permanent connection structures, like straps tape, snap buttons, hooks 20, etc., which are for example sewn on the outer covering layer 1. In this way, a tighter connection among the elastic modules 100 will be created, making the couch, mattress, etc. more comfortable.

Figure 10A:
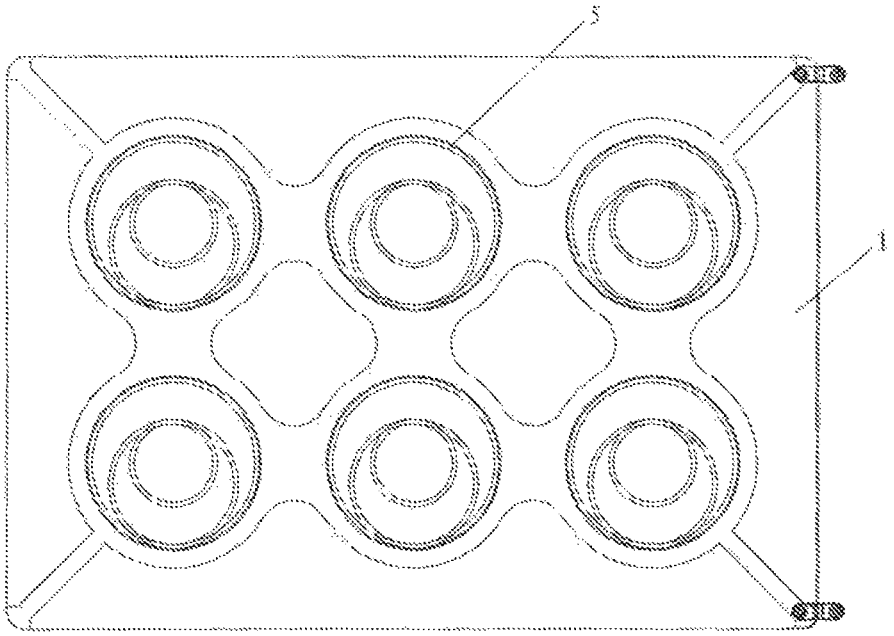
FIG. 10*a*-FIG. 10*d*.
Figure 10B:
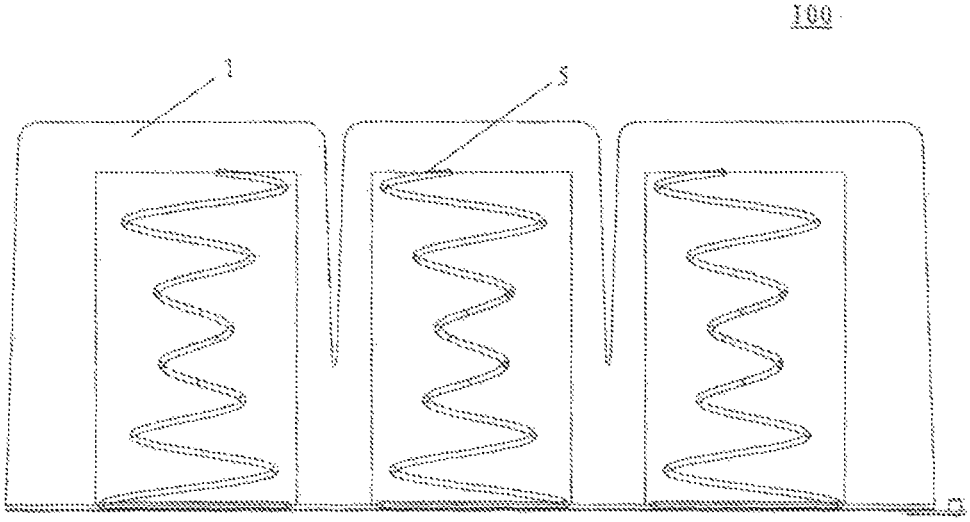
Figure 10C:
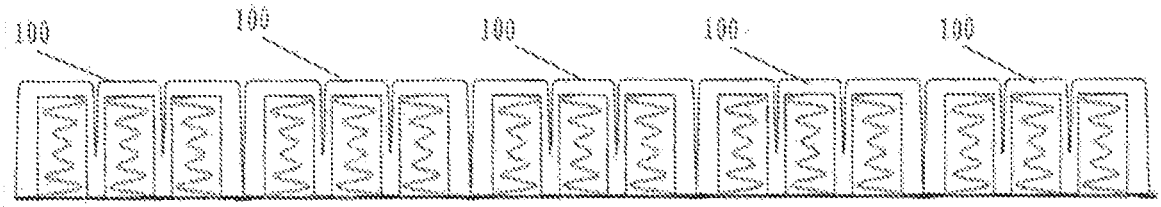

FIG. 10*a*-FIG. 10*d* show another example of a plurality of springs arranged simultaneously within one elastic module 100. FIG. 10*a* is a top view of the elastic module 10 (or it may be a bottom view, depending on how an end member 2 is disposed relative to the outer covering layer 1). In FIGS. 10*a*-10*d*, the six springs 5 of the same dimension are mounted as described above. The dimensions or configurations of these six springs may be different. FIG. 10*b* is a side view of an elastic module 100 comprising six springs 5. FIG.

Figure 10D:
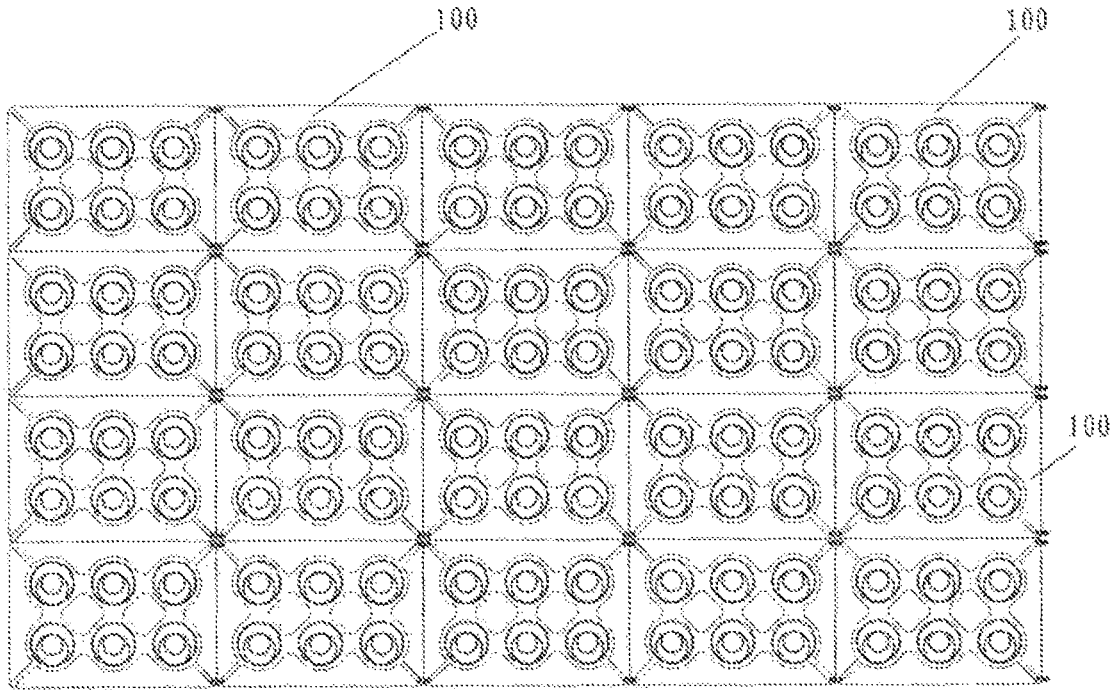

10*c* and FIG. 10*d* are respectively a side view and a top view of a spring pad assembled from the elastic modules 100.

Simultaneously mounting a plurality of springs 5 in one elastic module 100 has the following advantages: as compared to an elastic module 100 having a small volume (e.g. an elastic module 100 having only one spring 5 of the same or similar dimensions), when a user needs to assemble a larger spring pad, like a double mattress, from the elastic modules 100, this multi-spring elastic module 100 having a relatively large volume achieves the purpose of easy assembly or disassembly and simultaneously saves time spent on assembling and dissembling the elastic modules 100. This is because, in the case that the spring pad has an identical or similar volume, the number of the required elastic modules 100 is reduced, and the required assembling or disassembling steps are reduced accordingly. Based on a desired size and characteristics, the elastic module s100 can be provided with for example two, four, six, eight or even more springs.

Although the elastic modules 100 are shown as a cube or cuboid, the elastic modules 100 may be for example a triangular or pyramid shaped. In this case, the number of springs 5 may be one, three, five, etc.

Figure 4A:
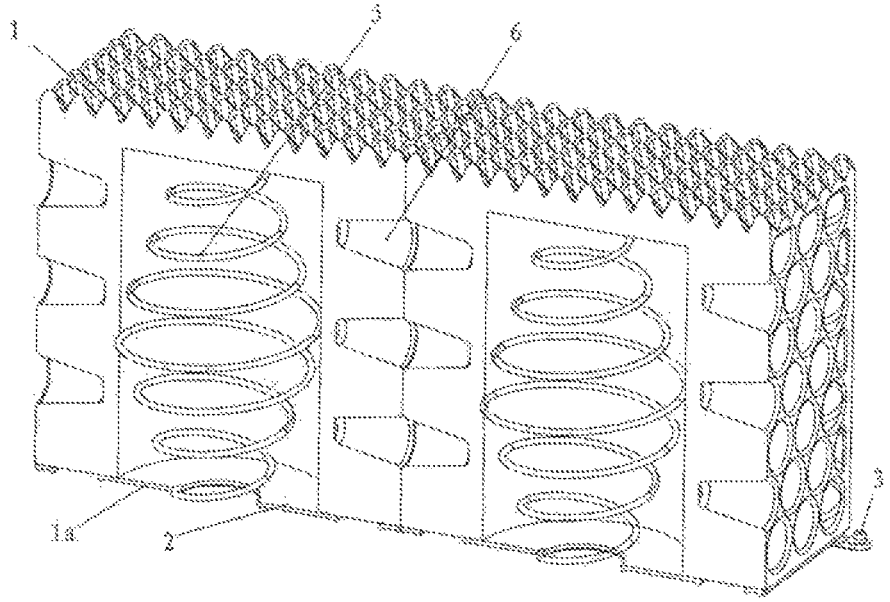
FIG. 4*a*-FIG. 4*c* are respectively sectional views of elastic modules assembled with three different types of springs.
Figure 4B:
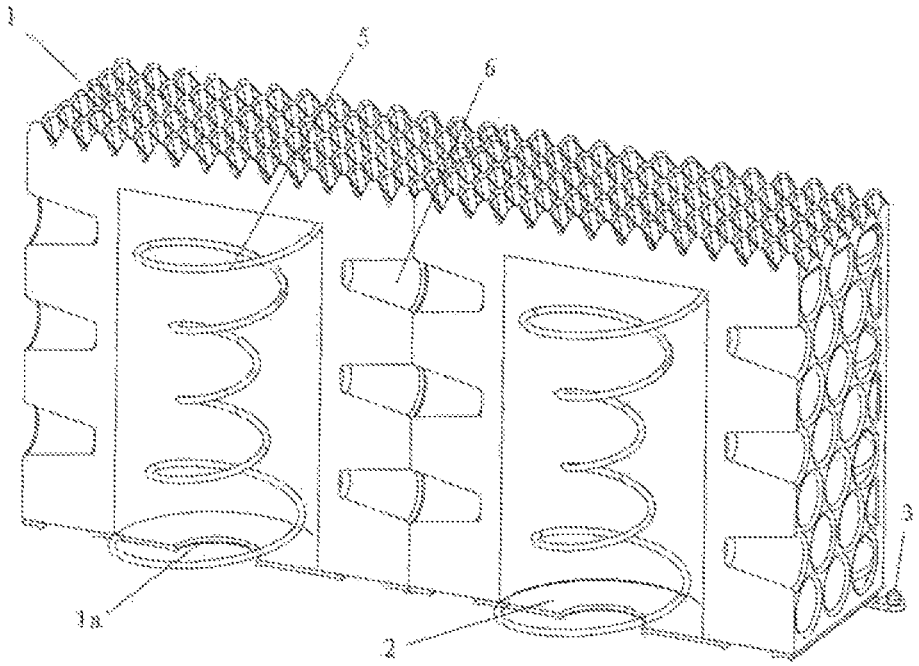
Figure 4C:
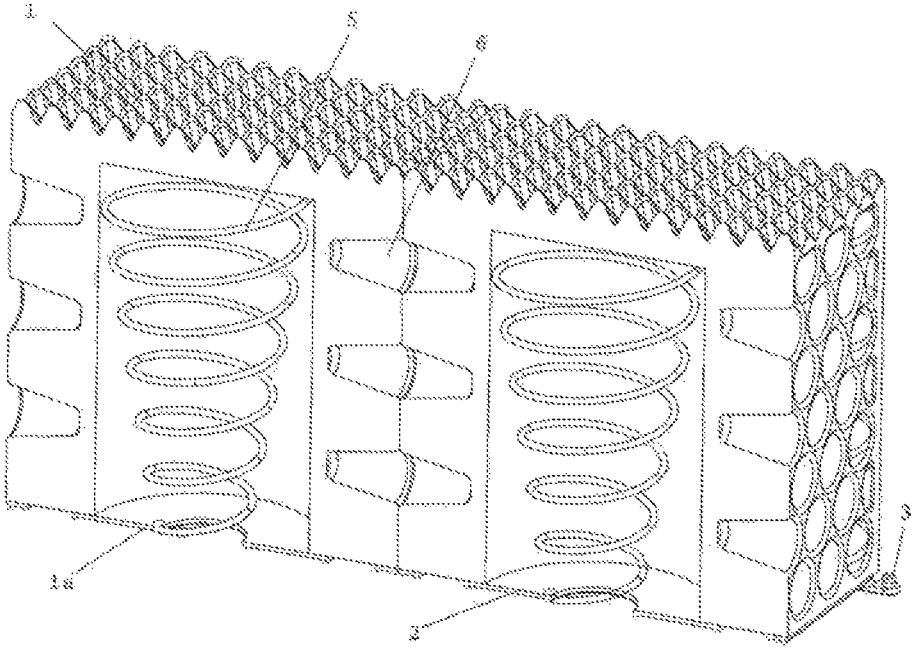
Figure 5A:
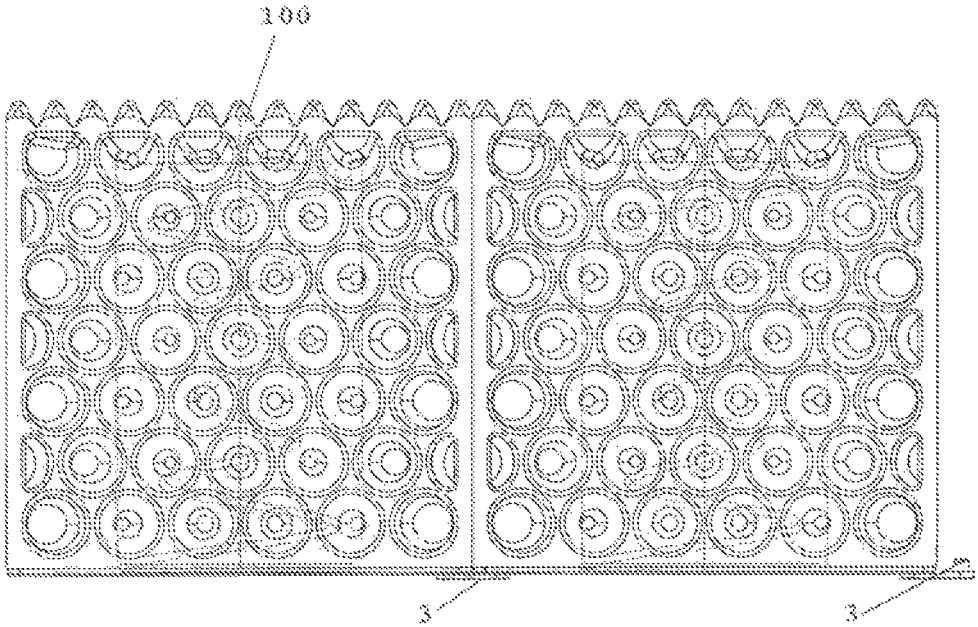
FIG. 5*a*-FIG. 5*b* are respectively a front view and a top view of the assembled elastic modules as shown in FIG. 2.
Figure 5B:
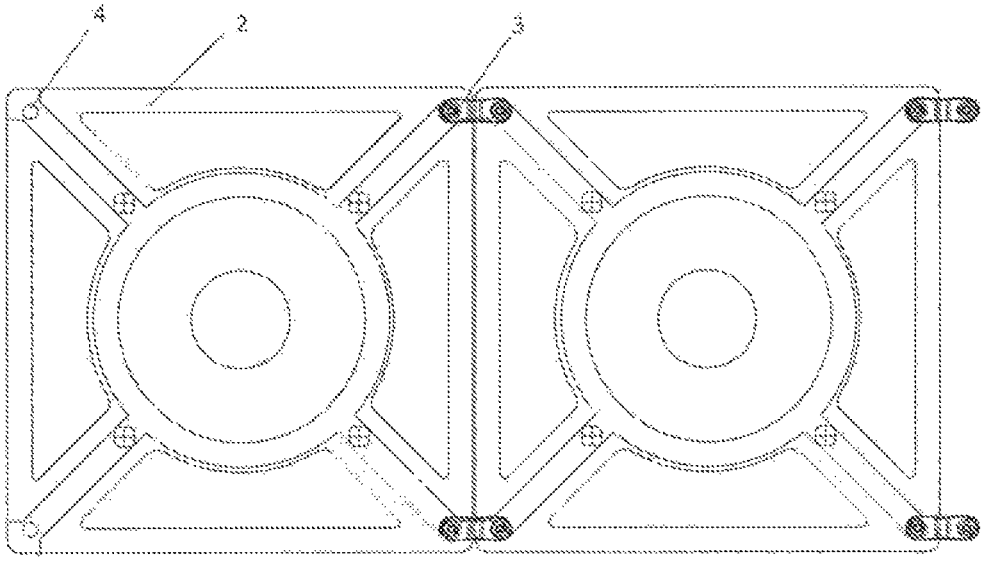

Preferably, the spring 5 is a spiral spring. For example, the spring 5 as shown in FIG. 4*a* is a middle-portion-convex spiral spring, the one as shown in FIG. 4*b* is a middle-portion-concave spiral spring, and the one as shown in FIG. 4*c* is a truncated conical spiral spring. The spring 5 may be preferably any one of a cylinder spiral spring, a conical spiral spring, a middle-portion-convex or concave spiral spring, or a spiral spring formed by nesting a left-handed spring and a right-handed spring together. In the spiral spring formed by nesting a left-handed spring and a right-handed spring together, the dual-spring configuration avoids the defect that a single spring is vulnerable to be broken and it may have improved elastic performance. In practice, any type of spring capable of solving the technical problem may be used.

Figure 3:
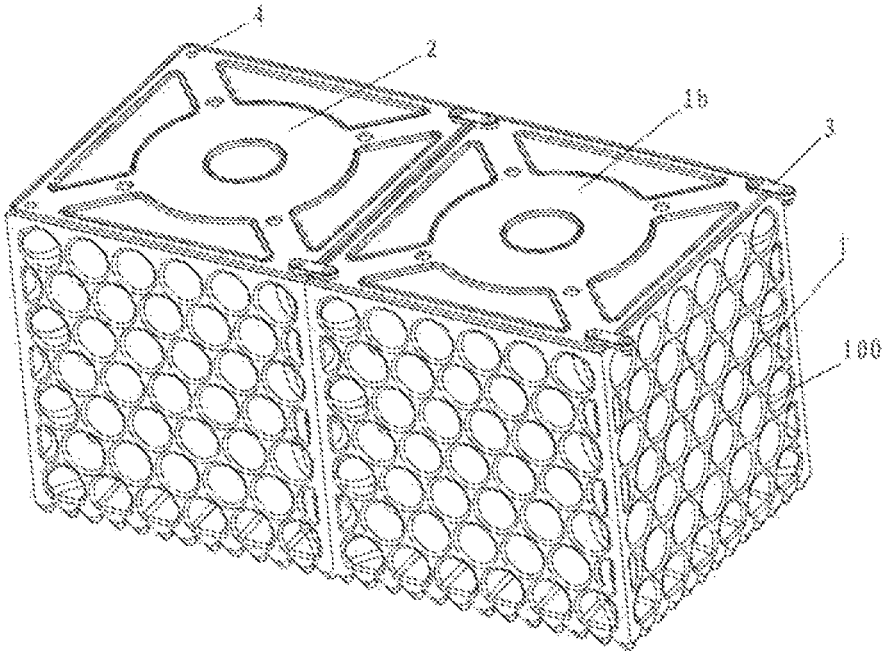
FIG. 3 is a perspective view of two elastic modules of FIG. 2 transversely assembled together.

As shown in FIG. 3 the elastic module 100 may have an end member 2 attached to a lower end of the outer covering layer 1, with the end member 2 formed thereon with a module connecting structure capable of allowing a plurality of elastic modules 100 to be detachably coupled with one another. Herein, "an upper end face" and "a lower end face" are oriented relative to a longitudinal (vertical) axis of the spring 5.

In this embodiment, the spring 5 and the outer covering layer 1 are formed as one integral piece as described above. After the elastic module 100 is formed, an end member is provided. A bottom end of the spring 5 may abut against or attach to the end member 2, i.e., the end member 2 here may act as a support for the spring as shown in FIG. 4*a*-FIG. 4*c*. The end member 2 may be a rigid disk, ring or plate, although in some designs as described below, the end member 2 is somewhat flexible.

In the embodiment in FIGS. 7*a*-7*d*, the module connecting structure may comprise a recess 2*a* formed on one side wall of at least one pair of side walls of the body of the end member 2, and a protrusion 2*b* formed on the opposite side wall. The protrusion 2*b* is adapted to engage the recess 2*a* of the end member 2 of an adjacent elastic module. The recess 2*a* and protrusion 2*b* are attached to each other using a snap fit or a shaped fit, such as a dovetail fit. The recess 2*a* and the protrusion 2*b* both extend horizontally, perpendicular to the longitudinal (vertical) axis of the spring 5. This module connecting structure is advantageous for assembling the elastic modules 100 horizontally, alongside each other, on a floor or on frame.

In a further embodiment, the module connecting structure may comprise a mounting hole 4 formed on the body of the end member 2, and the mounting hole 4 is capable of cooperating with a separate locking piece 3 (FIG. 3 and FIG. 7*a*-FIG. 7*d*), such that the plurality of elastic modules 100 can be detachably coupled together.

Figure 6:
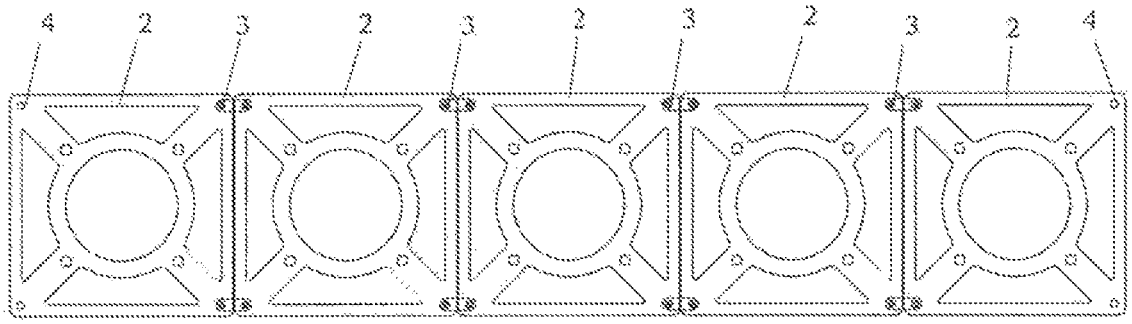
FIG. 6 is a top view of transversely assembled elastic modules.
Figure 7A:
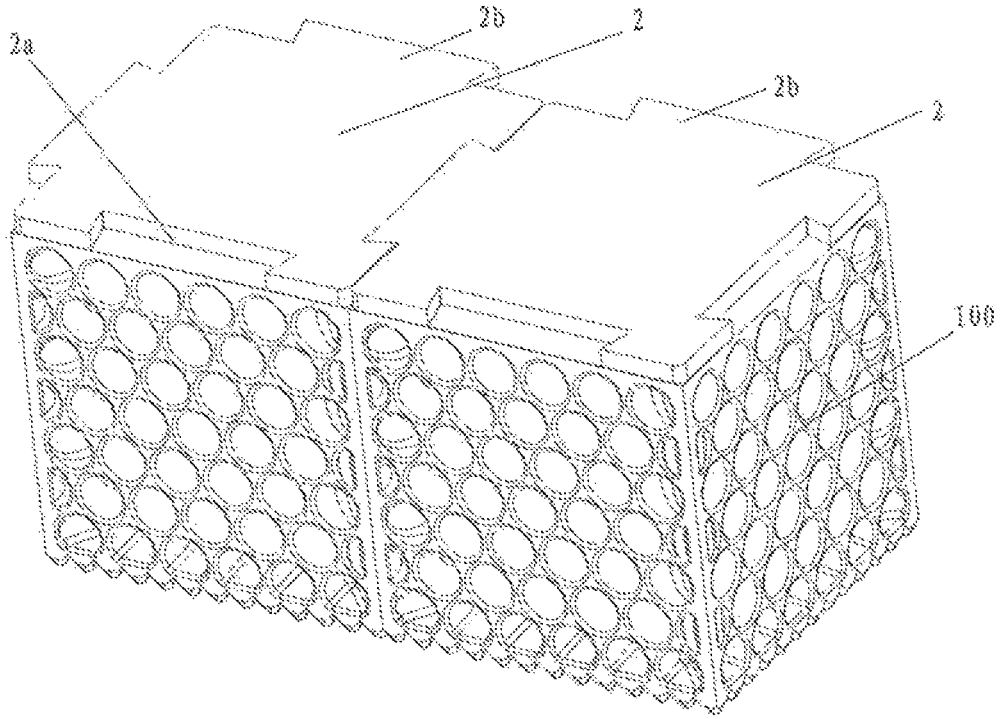
FIG. 7*a*-FIG. 7*d* illustrate an example of a module connecting structure connecting elastic modules.
Figure 7B:
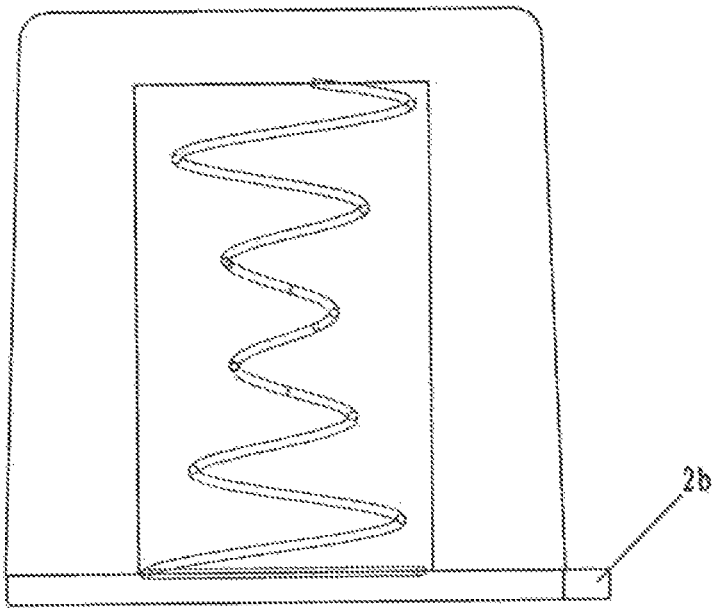
Figure 7C:
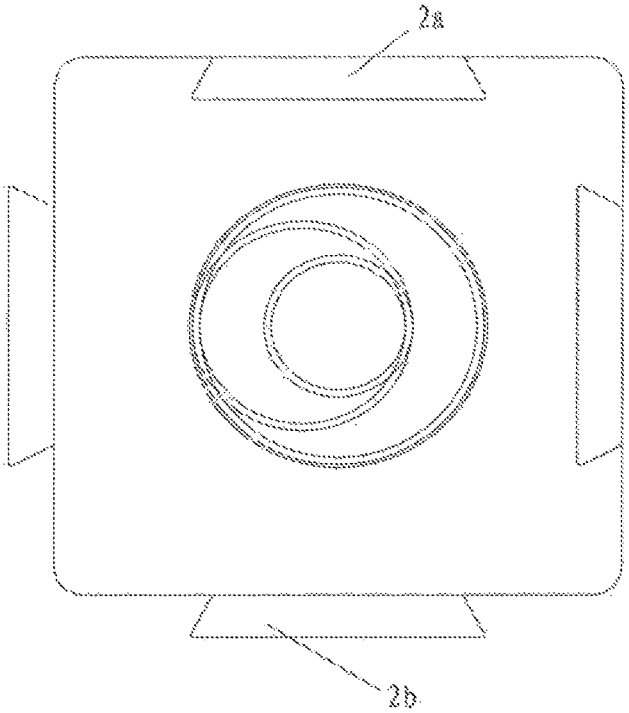
Figure 7D:
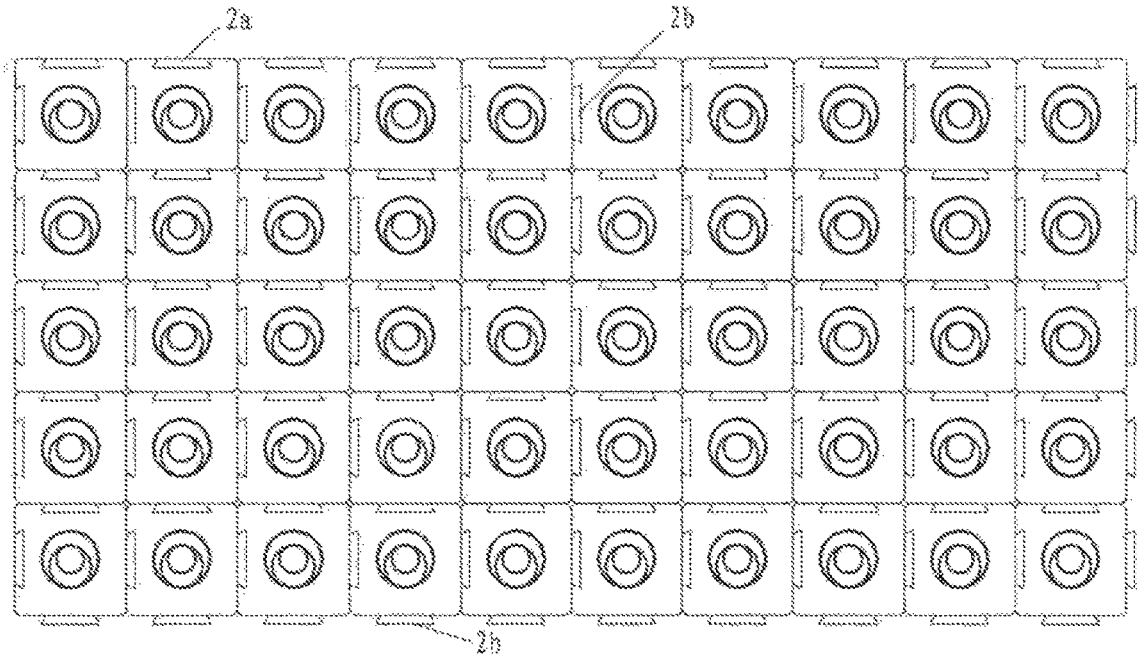

In this context, a mounting hole 4 may be preferably distributed symmetrically at four corners of the end member 2, as shown in FIG. 3. When two elastic modules 100 are transversely assembled side-by-side, as shown in FIG. 3, the locking piece 3 is fixed or snap-connected to the mounting hole 4 by using a pin, screw, etc. or only by using the locking piece 3 per se, such that these two elastic modules 100 are connected. Any number of elastic modules 100 can be assembled horizontally side-by-side into a pad or mattress, as shown in FIG. 6. The locking piece 3 is described below in detail with reference to FIG. 17.

The end member 2 may have a shape as shown in FIG. 2, FIG. 3, FIG. 4*a*-FIG. 4*b*, or a different shape. The end member 2 may directly contact the ground or frame, that is, the assembled spring pad can be directly placed on a horizontal contact face with the end member 2.

The end member 2 as shown is substantially flat or planar, but it may also be in the form of a frame or of any other appropriate shape so long as it can perform the function of connecting with another elastic module. For use on a frame the end member 2 may have certain flexibility to enable the spring pad 100*a*, 100*b* (e.g. the bed mattress in FIG. 15*a*-FIG. 15*b* and the couch cushion in FIG. 16*a*-FIG. 16*b*) to adaptively match the curved surfaces, if any, of the bed frame, couch frame, etc. The bottom coil 18 of the spring 5 can rest on, or be attached to, the end member 2.

Figure 8A:
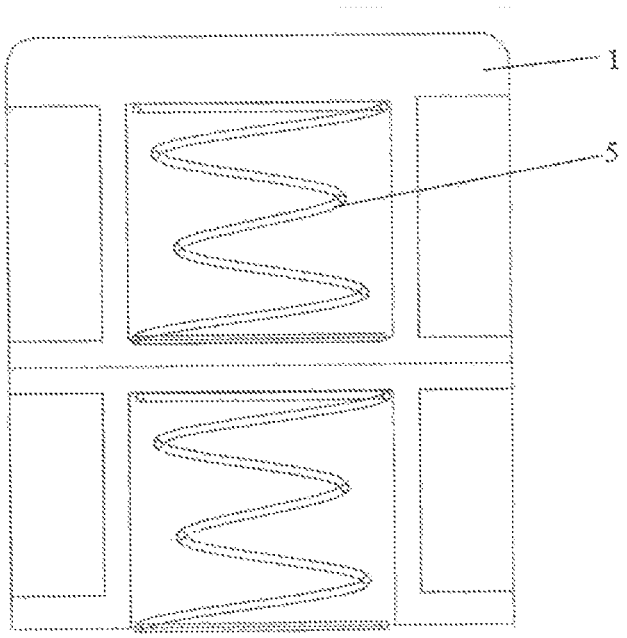
FIG. 8*a*-FIG. 8*b*.
Figure 8B:
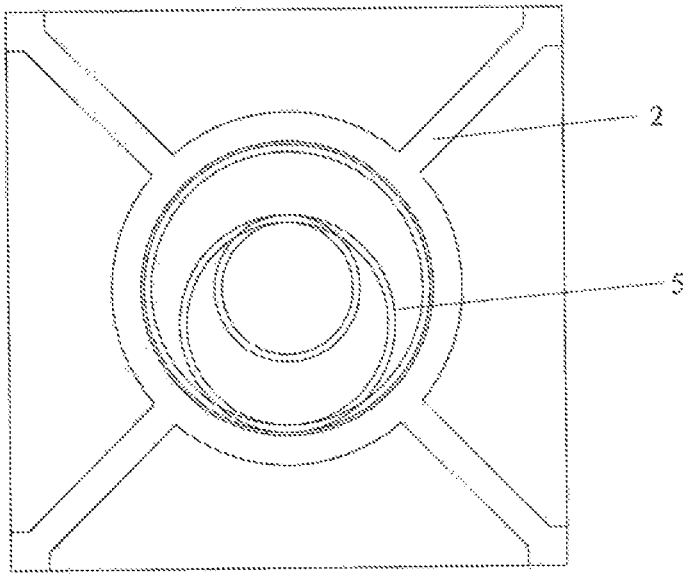

As shown in FIGS. 8*a* and 9*b*, in addition to transverse (or horizontal) assemblies, the elastic modules 100 can be stacked or assembled vertically as well. For example, small elastic modules 100 can be built up horizontally and vertically to provide a pad or mattress having a desired height.

An end member 2 may be provided on both the top and bottom surfaces of the outer covering layer. In this case, the module connecting structure may comprise a recess formed at an edge of an outward end face 1*a* (FIG. 4*a*-FIG. 4*c*) of one of the two end members 2, and a protrusion formed on an outward end face 1*b* (FIG. 3) of the other end member, and wherein both the recess and the protrusion extend substantially vertically. By snapping the recess on the outward end face of the end member 2 of one elastic module 100 with the corresponding protrusion on the outward end face of the end member on another elastic module, the two elastic modules may be vertically mounted or stacked. In this embodiment, the recess and the protrusion for forming the module connecting structure is similar to those of the recess 2*a* and the protrusion 2*b* as shown in FIG. 7*a*-FIG. 7*d*.

The end member 2 may be made of polyurethane sponge, or metal or plastic. Preferably, if used, the sponge for producing the end member 2 is denser and harder than the outer covering layer 1, such that the end member forms is sufficiently strong and rigid connection to allow end members of adjacent elastic modules to securely form a spring pad or mattress. In this case, the recess 2*a* and the protrusion 2*b* of the module connecting structure are formed of polyurethane sponge.

Figure 11A:
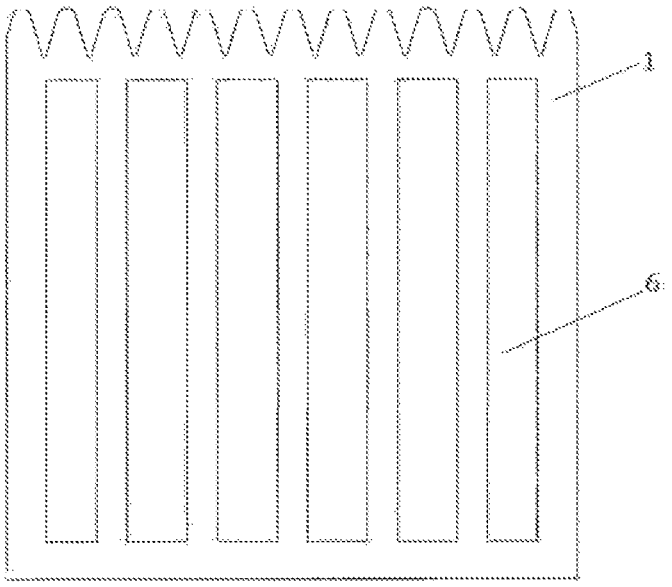
FIG. 11*a*-FIG. 11*b*.
Figure 11B:
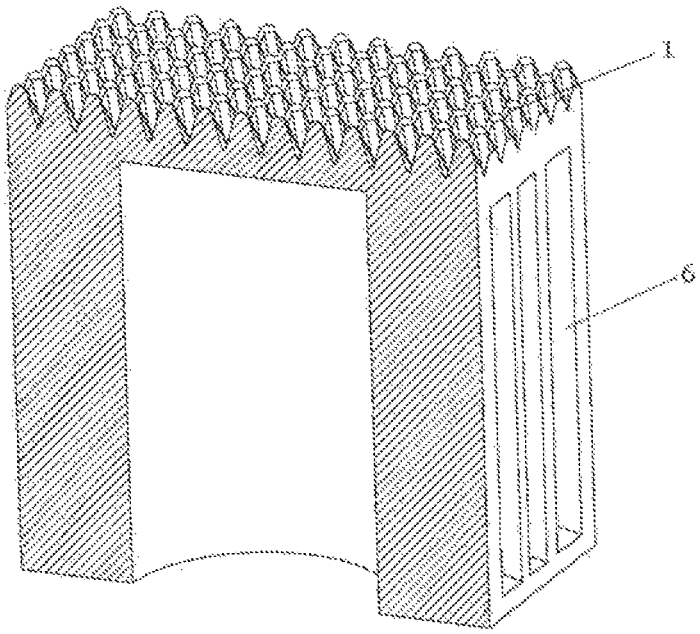
Figure 12A:
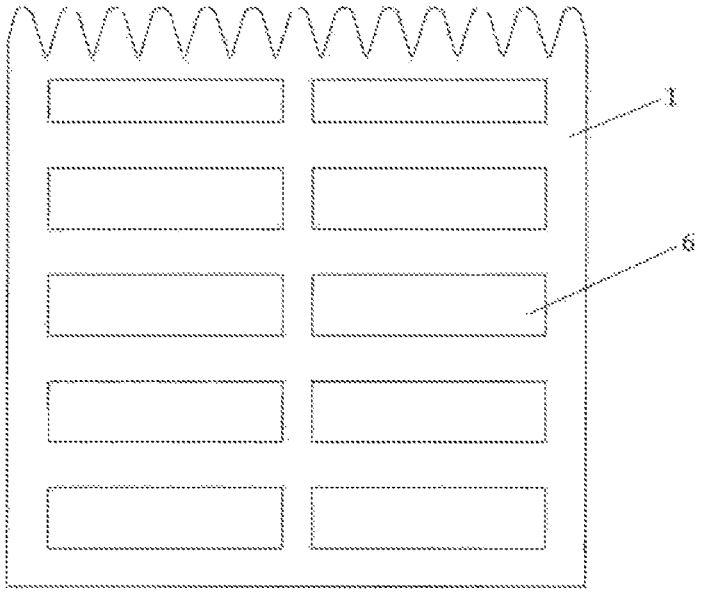
FIG. 12*a*-FIG. 12*b*.
Figure 12B:
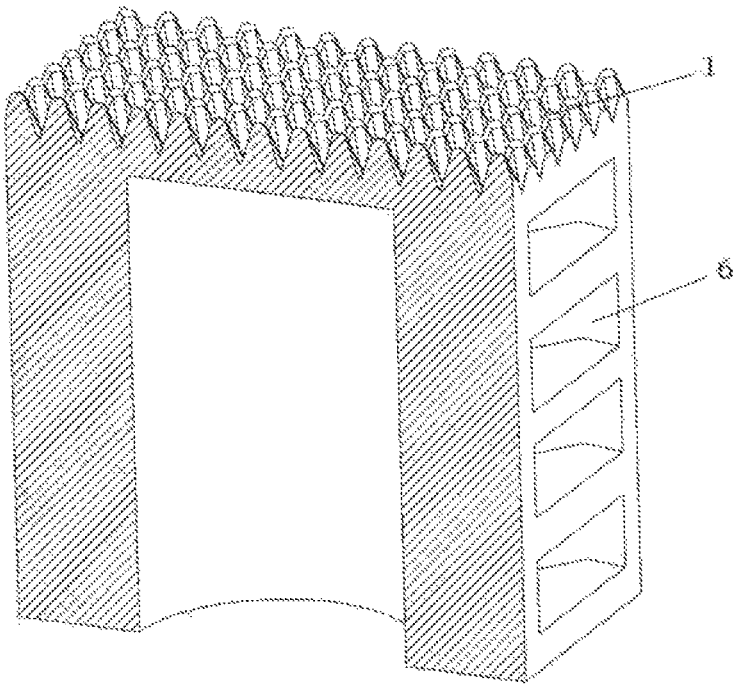
Figure 13A:
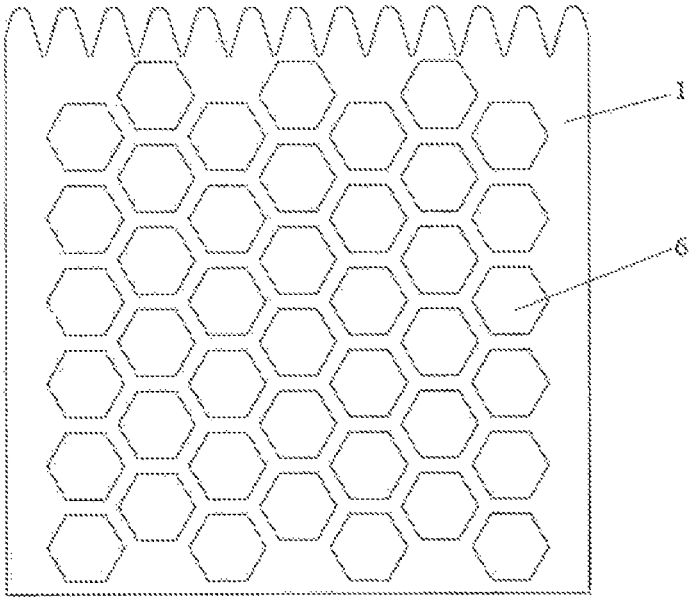
FIG. 13*a*-FIG. 13*b* are schematic views of embodiments of an elastic module.
Figure 13B:
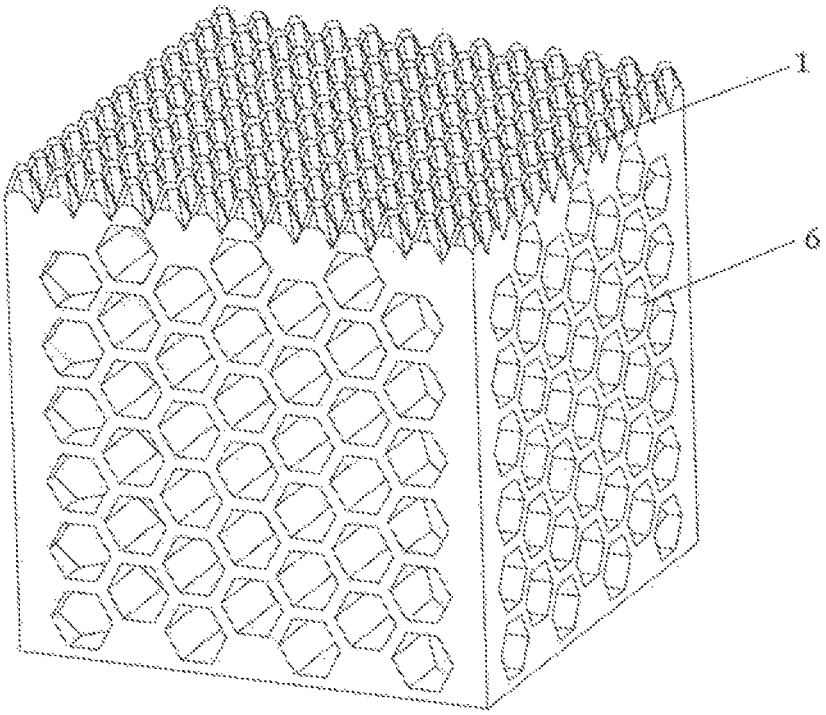

Now turning to FIG. 11*a*-FIG. 11*b*, FIG. 12*a*-FIG. 12*b* and FIG. 13*a*-FIG. 13*b*, the surface of the outer covering layer 1 may be formed with uniformly distributed concave holes 6. FIG. 11*a*-FIG. 11*b* illustrate elongated rectangle-like holes 6 extending vertically on the sides of the elastic module. FIG. 12*a*-FIG. 12*b* illustrate concave holes 6 oriented horizontally on the sides of the elastic module. FIG. 13*a*-FIG. 13*b* illustrate honeycomb-shaped concave holes 6, optionally on all sides of the elastic module. The concave holes 6, if used, reduce restrictions of the outer covering layer 1 on the movement of the spring 5 in each orientation so as to optimize the elastic performance of the spring 5, thereby providing better comfort to the user.

Figure 14:
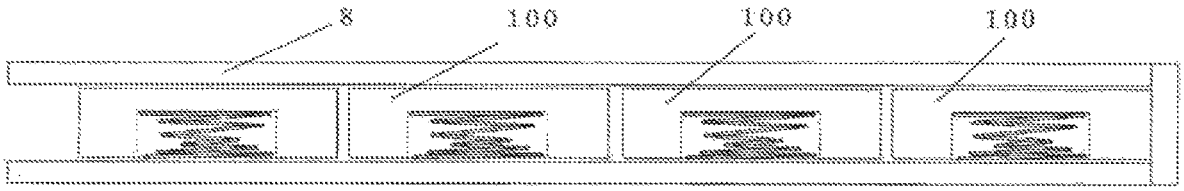
FIG. 14 schematically illustrates a state in which elastic modules are mounted in a storage device independently from one another.

Referring to FIG. 14, a storage state of unassembled or disassembled elastic modules 100 is shown. The separate elastic modules 100 are shown in a compressed state within a storage space or container 8, thereby greatly reducing the storage space occupied by the elastic modules. When the consumer purchases the elastic modules 100 they may be packaged in a compressed state. Hence they are easily loaded into a vehicle and transported to his/her residence. The elastic modules 100 will expand when removed from the container 8. They can then be assembled together without tools. Similarly, the elastic modules can be disassembled and stored temporarily, or moved from one place to another place, by following the reverse procedure. Each elastic module 100 can be detached from adjoining elastic modules, compressed and stored in the container 8. Compared to traditional furniture, the volume of the compressed elastic modules can be advantageously reduced by 40-90%, and therefore lowers transport costs and storage space requirements.

Spring pads or mattresses 100*a*, 100*b* formed of the elastic modules 100 are also provided. The elastic module 100 may include an elastic outer covering layer 1 formed of polyurethane couch sponge, at least one spring 5 disposed in the middle of the outer covering layer 1, an end member 2 attached onto at least one end face of the outer covering layer 1, and a mounting hole 4 formed on the body of the end member 2. As a preferable manner, the spring pad further comprises an separate locking piece 3 which can be connected with the mounting hole 4 via for example a screw, etc., or can engage the mounting hole 4 in any appropriate manner, such that a plurality of elastic modules 100 can be detachably coupled with one another.

A cloth, fabric or leather cover may be provided around the outer covering layer 1.

With reference to FIG. 15*a*-FIG. 15*d* and FIG. 16*a*-FIG. 16*b*, specific application of the spring pads 100*a*, 100*b* are illustrated.

Figure 15A:
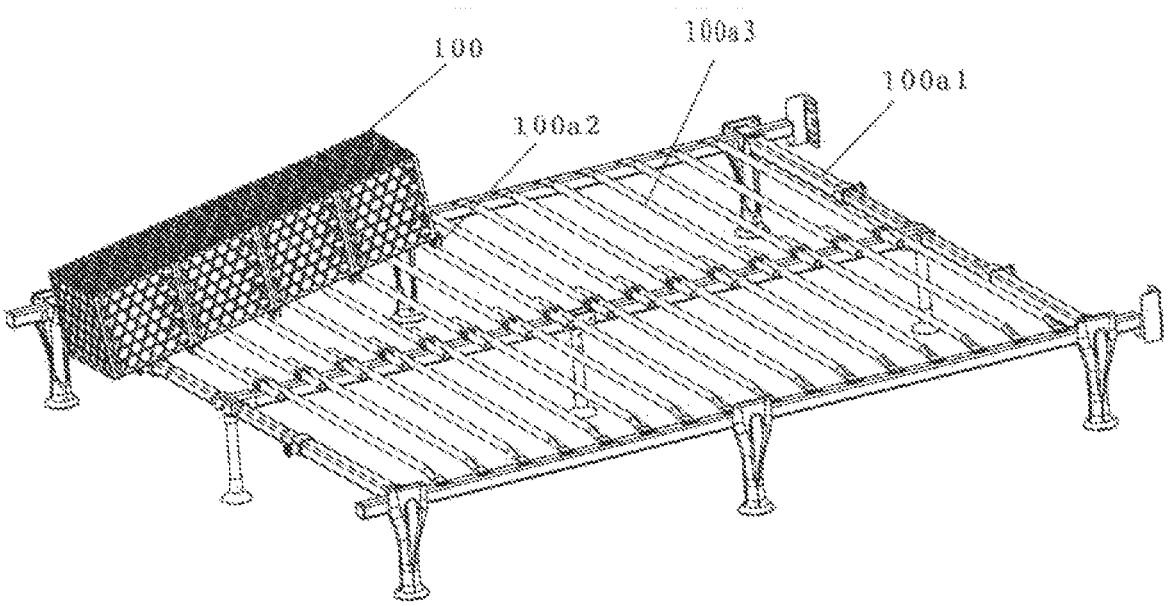
FIG. 15*a*-FIG. 15*d* are schematic views of an exemplary bed mattress formed of elastic modules.
Figure 15B:
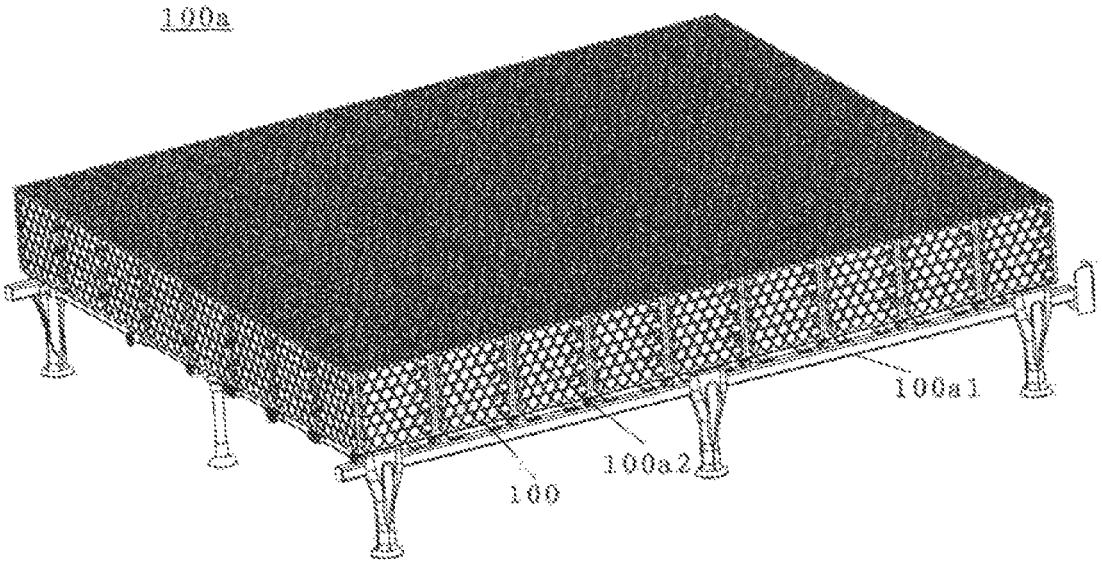
Figure 15C:
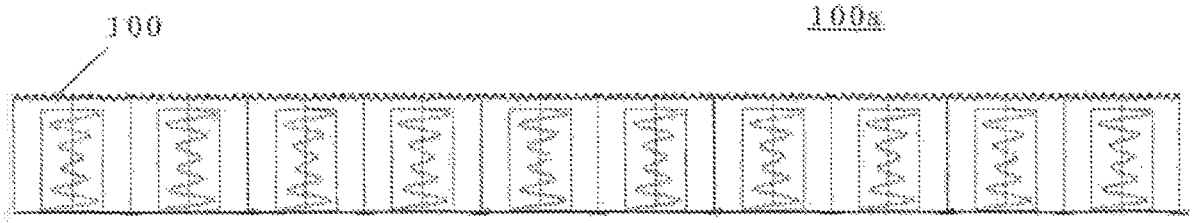
Figure 15D:
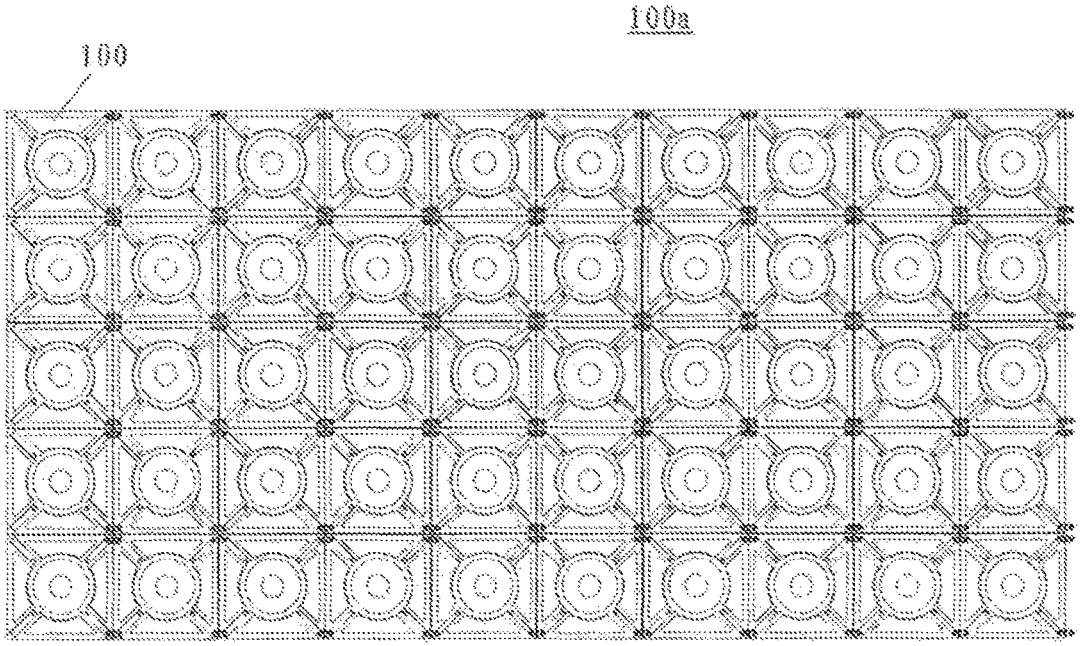

FIG. 15*a*-FIG. 15*d* schematically illustrate a furniture pad 100*a* formed of elastic modules 100. The elastic modules 100 may be directly laid flat for example on a floor with the end members 2 at the bottom of the elastic modules 100 on the floor, or may they be mounted to a bed frame 100*a*1 using frame connecting elements 100*a*2 such as clamps, clips, straps, etc. The dimension of the assembled elastic modules 100 adaptively matches the bed frame 100*a*1. FIG. 15*a* schematically illustrates the assembling process of the spring pad 100*a* with the bed frame 100*a*1, FIG. 15*b* shows the spring pad 100*a* after the assembly is completed, and FIG. 15*c* and FIG. 14*d* are respectively a side view and a top view of the spring pad 100*a*.

Figure 16A:
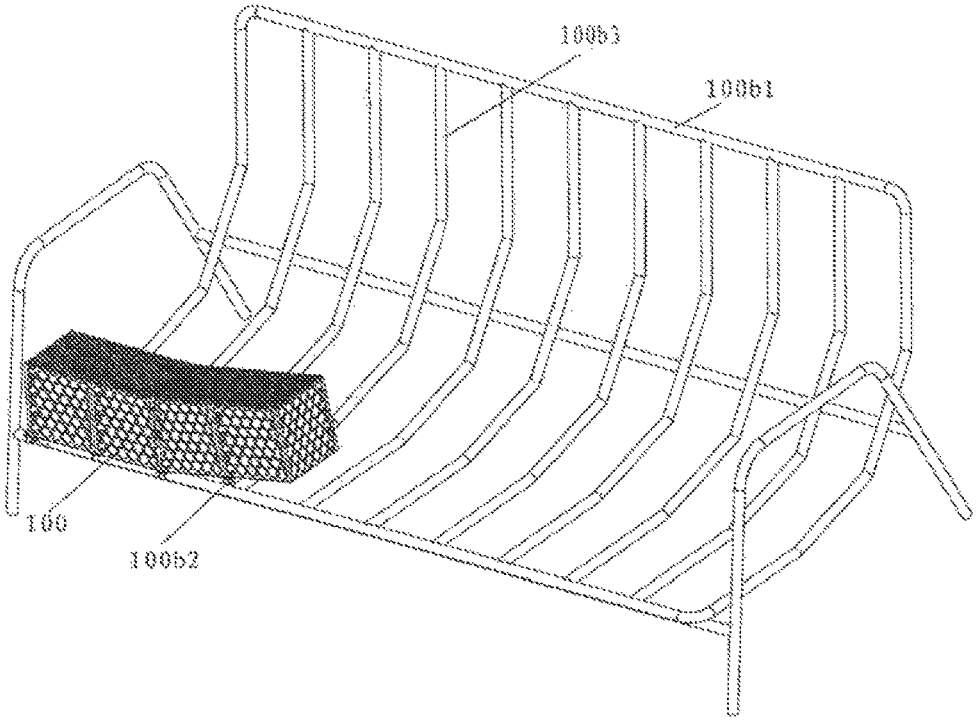
FIG. 16*a*-FIG. 16*b* are schematic views of an exemplary couch formed of elastic modules.
Figure 16B:
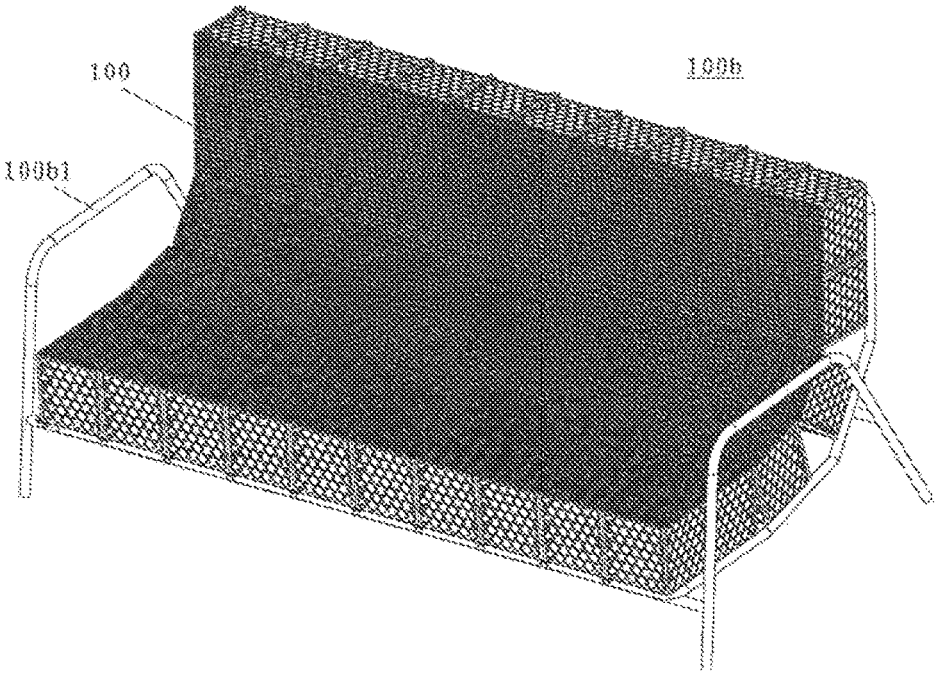

FIG. 16*a*-FIG. 16*b* schematically illustrate a spring pad 100*b* formed of elastic modules 100 for use as a couch pad. As described above, the elastic modules 100 may be directly laid flat for example on a floor via the end members 2 at the bottom of the elastic modules 100, or may be mounted to a couch frame 100*b*1 by using frame connecting elements 100*b*2. Here, the dimension of the assembled spring pad 100*b* adaptively matches the couch frame 100*b*1. FIG. 16*a* schematically illustrates an assembling process of an exemplary couch cushion 100*b* and a couch frame 100*b*1, and FIG. 16*b* schematically illustrates a perspective view of a couch assembled from the spring pad 100*b*.

To provide furniture having a backrest slightly in an arc shape, like a couch, the end member 2 may be preferably made of an elastic material, such as rubber, so that it has certain flexibility. Preferably, the end member 2 may be a relatively thin plastic sheet. Referring to FIG. 16*b*, in this case, the spring pad 100*b* uses a flexible end member 2. The elastic outer covering layer 1 can fit with a backrest portion of the frame 100*b*1 with almost no gaps to complete the assembling, offering more comfortable sitting and lying experiences to the user. In other embodiments the end member 2 is rigid.

The elastic modules 100 may have the same or different sizes and shapes. The elastic modules 100 need not be identical to each other, so long as they can be assembled together as described above.

Figure 17:
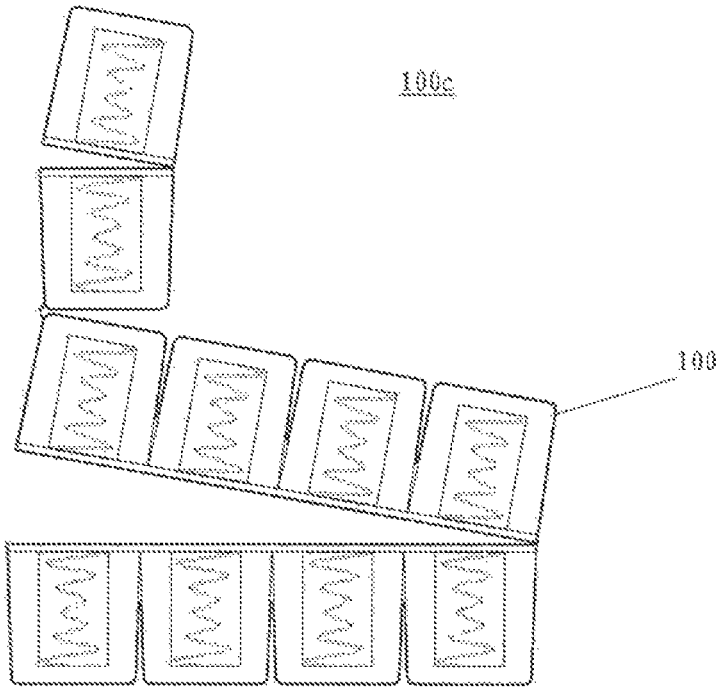
FIG. 17 schematically illustrates a folded state of a spring pad assembled from elastic modules.

As shown in FIG. 17, the spring pad assembled from the elastic modules 100 may be folded to form a configuration of the couch as displayed in FIG. 17. To allow for folding, firstly, the elastic modules 100 are connected in a row having a desired width of the spring pad 100*c*. Then, based on the desired length or height, multiple rows are assembled and attached together, to form, for example a backrest portion and seat cushion portion. In this example with the backrest portion having four rows and the seat cushion portion also having four rows, the four rows of the elastic modules of the back portion are connected with one another via the module connection structures as described above, and the four rows of the elastic modules of the cushion portion are connected with one another via the module connection structures also as described above. Finally, an articulated connection is preferably used between the elastic modules for engaging the backrest portion with the seat cushion portion, or any other connection allowing the backrest portion and the cushion portion to be pivoted relative to each other may be used. Other folding connections may of course also be used.

Figure 18:
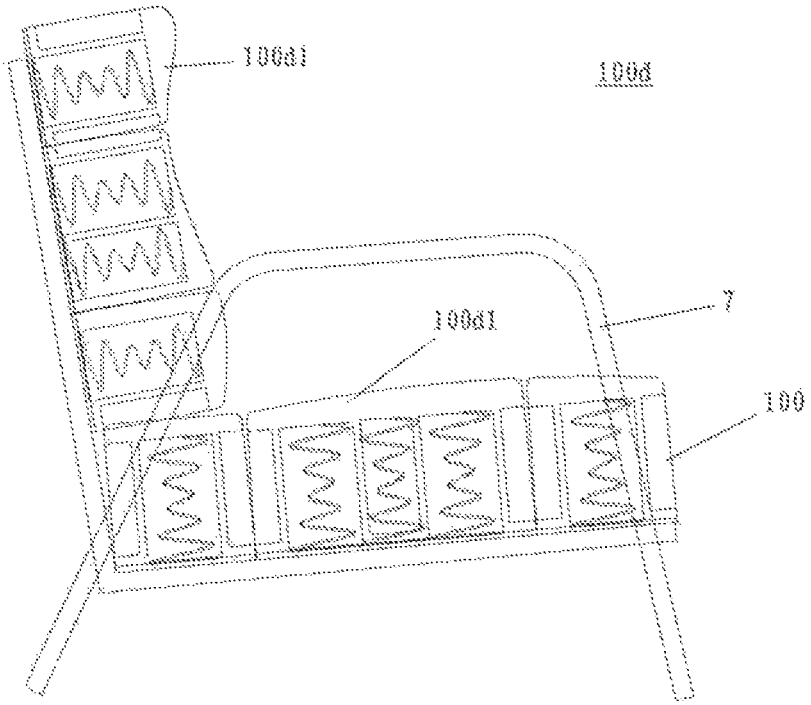
FIG. 18 schematically illustrates an exemplary couch made by mounting elastic modules onto a support frame.

Now turning to FIG. 18 a plurality of elastic modules 100 are mounted to a support frame 7 by clips 100*b*2 or equivalent designs similar to the frame connecting elements 100*a*2 (FIG. 15*a*-FIG. 15*b* and FIG. 16*a*), which enables the elastic module 100 to be detachably connected to the support frame 7 and kept relatively fixed in place on the support frame. Alternatively, clips may be arranged in a center or at an edge of the end member 2, or a plurality clips may be arranged symmetrically at four corners of the end member 2. When elastic modules 100 are to be mounted onto the support frame 7, the user only needs to for example snap or attach the clips onto a frame stem of the support frame 7 (e.g. 7*c* in FIG. 19, as well as the frame stem 100*a*3 in FIG. 15*a* and the frame stem 100*b*3 in FIG. 16*a*) to complete the connection.

In FIG. 18, the elastic modules 100 may, as described above, comprise a module connecting structure for detachably connecting them. In this way, each elastic module 100 can be mounted on the support frame 7, and also be connected to adjacent elastic modules. Alternatively, the connection between adjacent elastic modules 100 can be omitted, and each elastic module may be directly mounted on the support frame 7 via the clips 2*c*, without attaching the modules 100 to each other.

Figure 19:
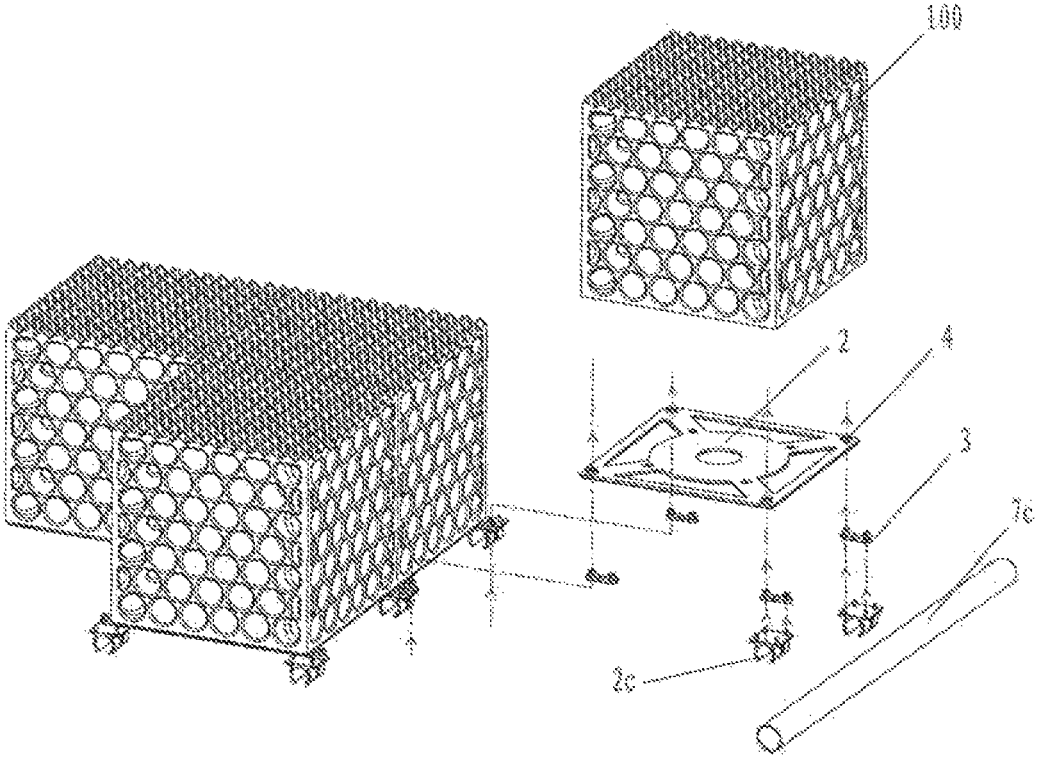
FIG. 19 is an exploded view of elastic modules, which schematically illustrates a frame connecting element for attaching elastic modules to a furniture frame.

FIG. 19 schematically illustrates an example of a clip 2*c* and a locking piece 3. A frame stem 7*c* is part of the support frame 7. The clip 2*c* in the example shown has a semi-cylindrical hollow portion forming opposed flex arms, to clip or clamp onto the frame stem or tube 7*c*. The clip 2*c* also has a sheet or plate portion joined to the semi-cylindrical hollow portion, for engaging with the locking piece 3. The semi-cylindrical hollow portion has an opening adapted to clip onto the frame stem 7*c*. The sheet portion may have four protrusions. The locking piece 3 may have a blind hole protruding upwardly along the dotted line in FIG. 19, and each locking piece 3 is formed with two such portions.

During assembling, each of the two blind holes of the locking piece 3 is aligned and engaged with one protrusion on the sheet portion of the clip 2*c*, for example, using a detachable interference fit. The sheet portion may be simultaneously connected with two locking pieces 3, and the blind hole-like portion of the locking piece 3 can be inserted into the mounting hole 4 in the end member 2, so as to allow two elastic modules to be engaged with each other.

In addition, the frame connecting element 100*a*2 in FIG. 15*a*-FIG. 15*b* and the frame connecting element 100*b*2 in FIG. 16*a* may have the same or similar configuration as the clip 2*c*.

In FIG. 18, or in the case that the elastic module 100 has an end member 2 only on one end face thereof, the other end face of the elastic module 100 opposite the end face provided with the end member 2 may have a curvature 100*d*1 determined based on ergonomics, as shown in FIG. 18. This curvature conforming to the ergonomics enables a contact surface fitting with a back structure of a human body to be directly formed immediately after the assembly of a plurality of elastic modules 100 is completed, thereby making the user comfortable.

Figure 20A:
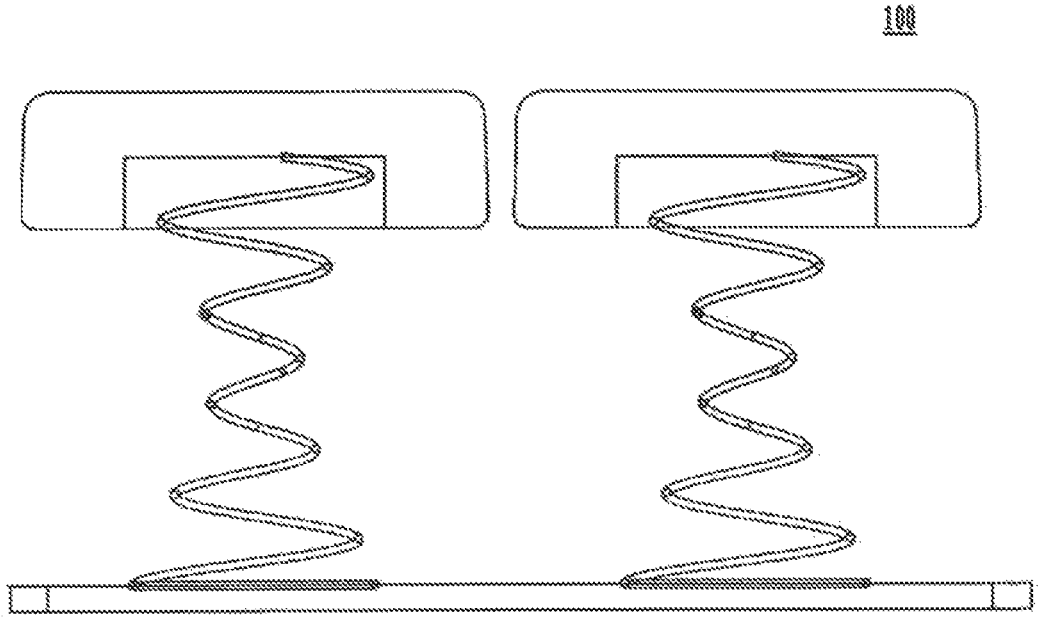
FIG. 20*a*-FIG. 20*c* schematically illustrate a spring pad formed of elastic modules.
Figure 20B:
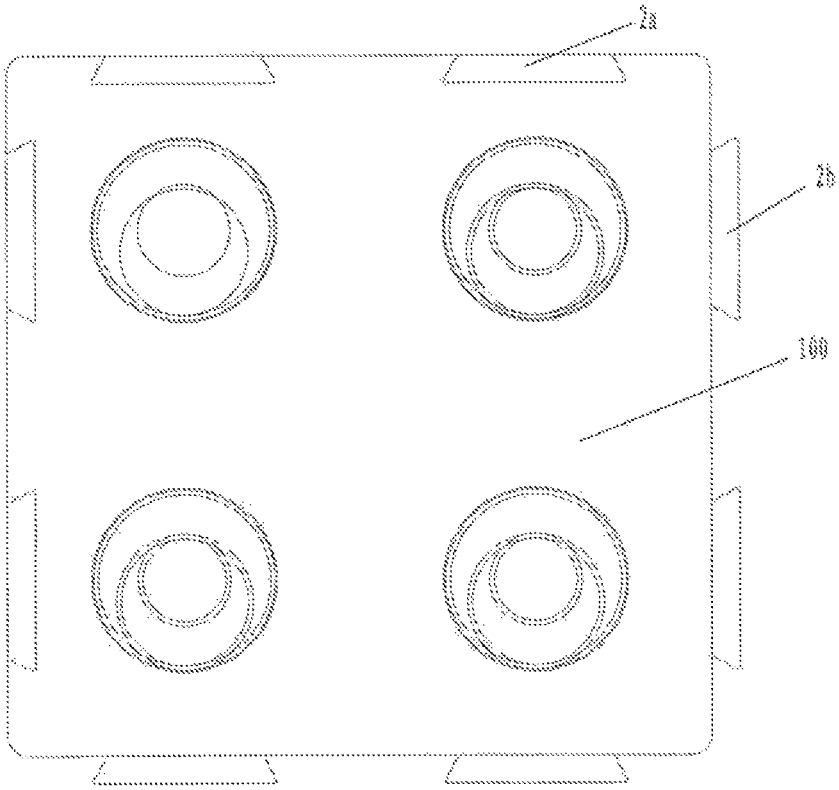
Figure 20C:
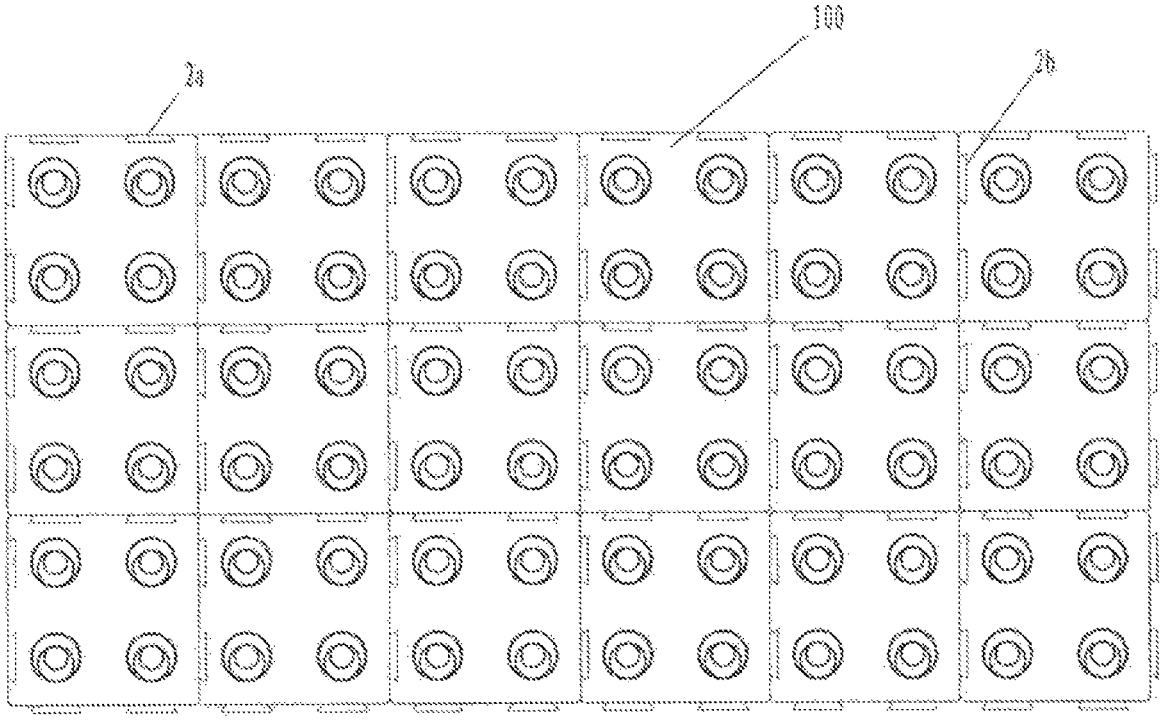
Figure 21A:
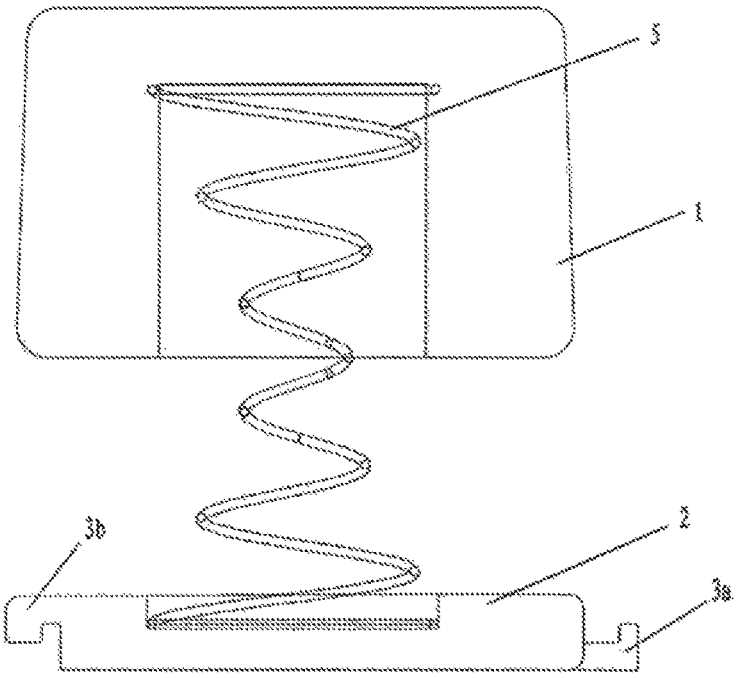
FIG. 21*a*-FIG. 21*d* schematically illustrate a spring pad formed of elastic modules.
Figure 21B:
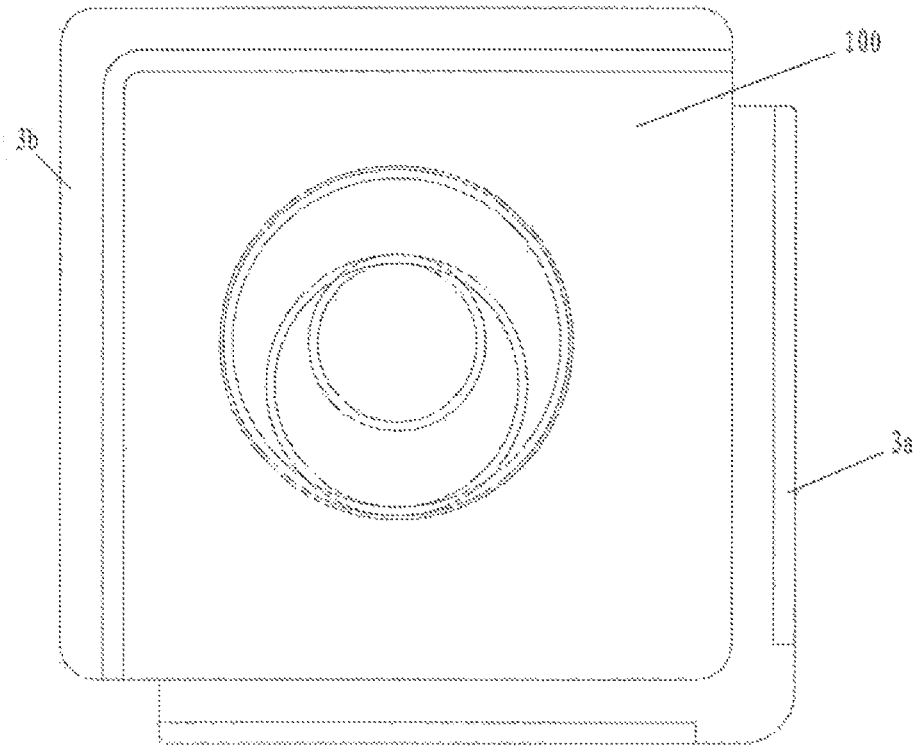
Figure 21C:
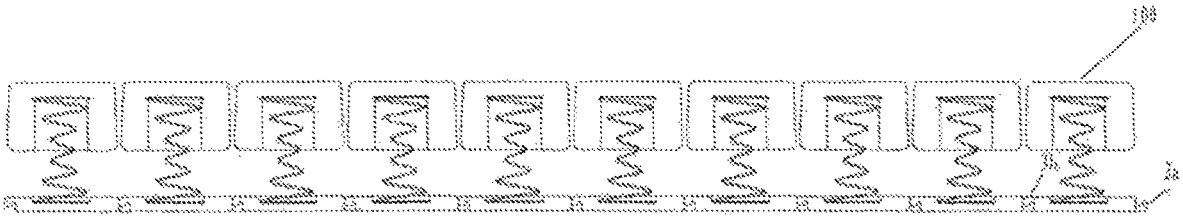
Figure 21D:
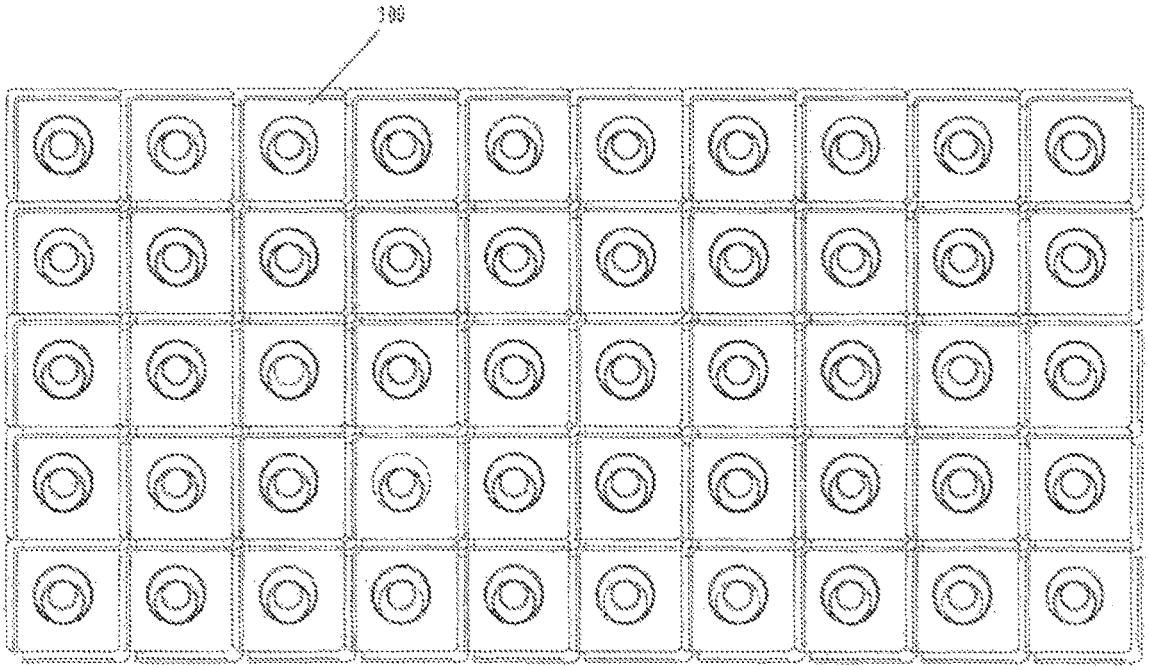

FIG. 20*a*-FIG. 20*c* are schematic diagrams of a further embodiment which illustrate that the spring 5 is partially covered by the outer covering layer 1, and the elastic modules 100 are assembled via the recesses 2*a* and protrusions 2*b* to form an integral spring pad.

FIG. 21*a*-FIG. 21*d* are schematic diagrams of a further embodiment which illustrate that the spring 5 is partially covered by the outer covering layer 1, and the elastic modules 100 are assembled via module connection structure as shown therein to form a furniture pad or mattress. This embodiment differs from FIG. 20*a*-FIG. 20*c* in that the module connecting structure is comprised of protruding ridges or hooks 3*a*, 3*b* formed at opposite edges of the end member 2. In this embodiment, one outer covering layer simultaneously covers a plurality of springs, for example, four springs 5 as shown in the figures.

A decorative or protective cloth cover, etc. may be used on the outer surface cover of the couch or bed assembled from the elastic modules 100.

The elastic module enables independent configurations to meet the needs of the user. The elastic modules may be assembled to form furniture wherein vertical deflection of one elastic module has little or no influence on other elastic modules of the spring pad or mattress. The independent configuration is also helpful for cleaning and replacing the elastic modules. Specifically, is elastic modules in the spring pad are stained or damaged, they can be easily replaced without need for replacing the entire spring pad.

Figure 22A:
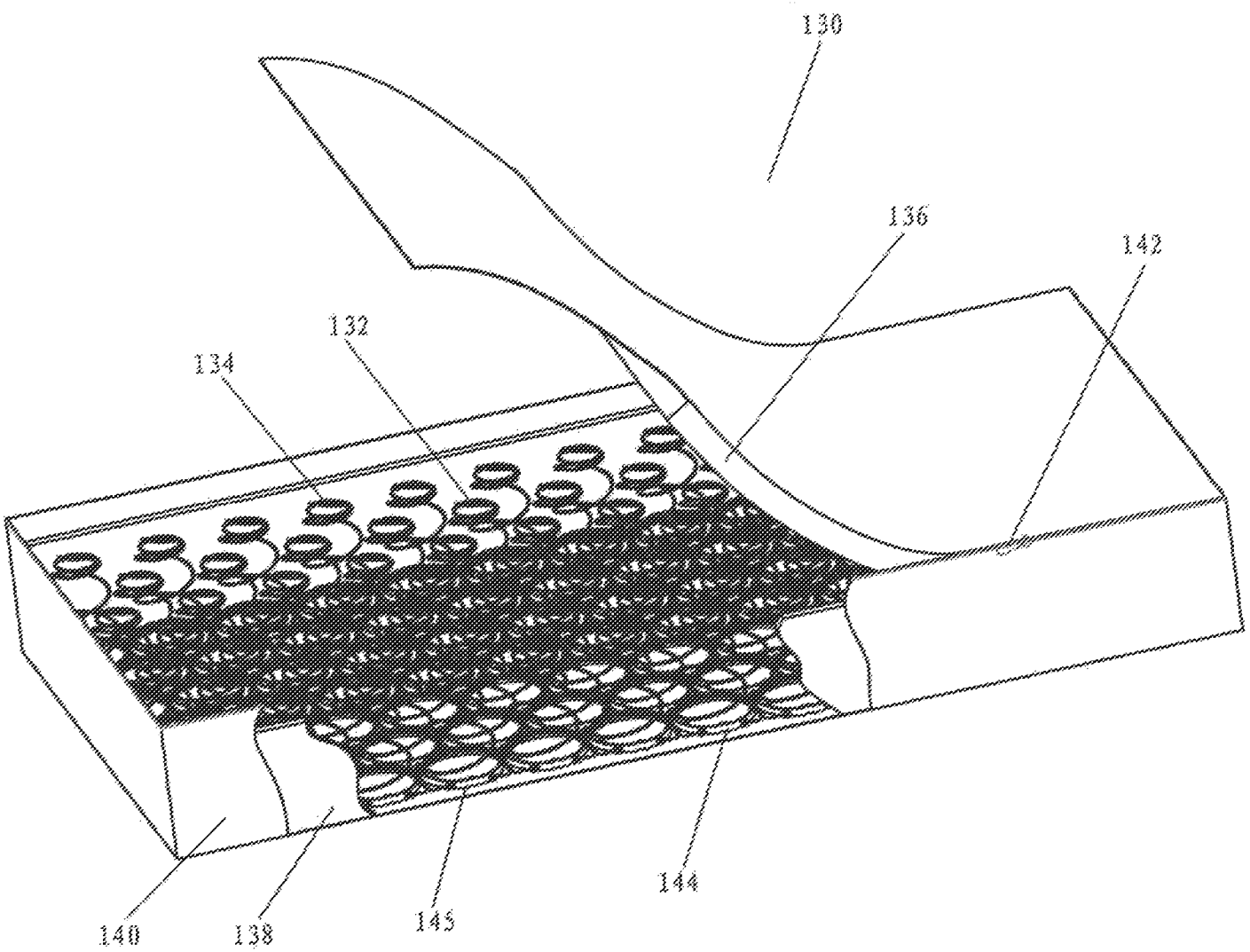
FIG. 22A is a perspective and cutaway view of a spring mattress.
Figure 23:
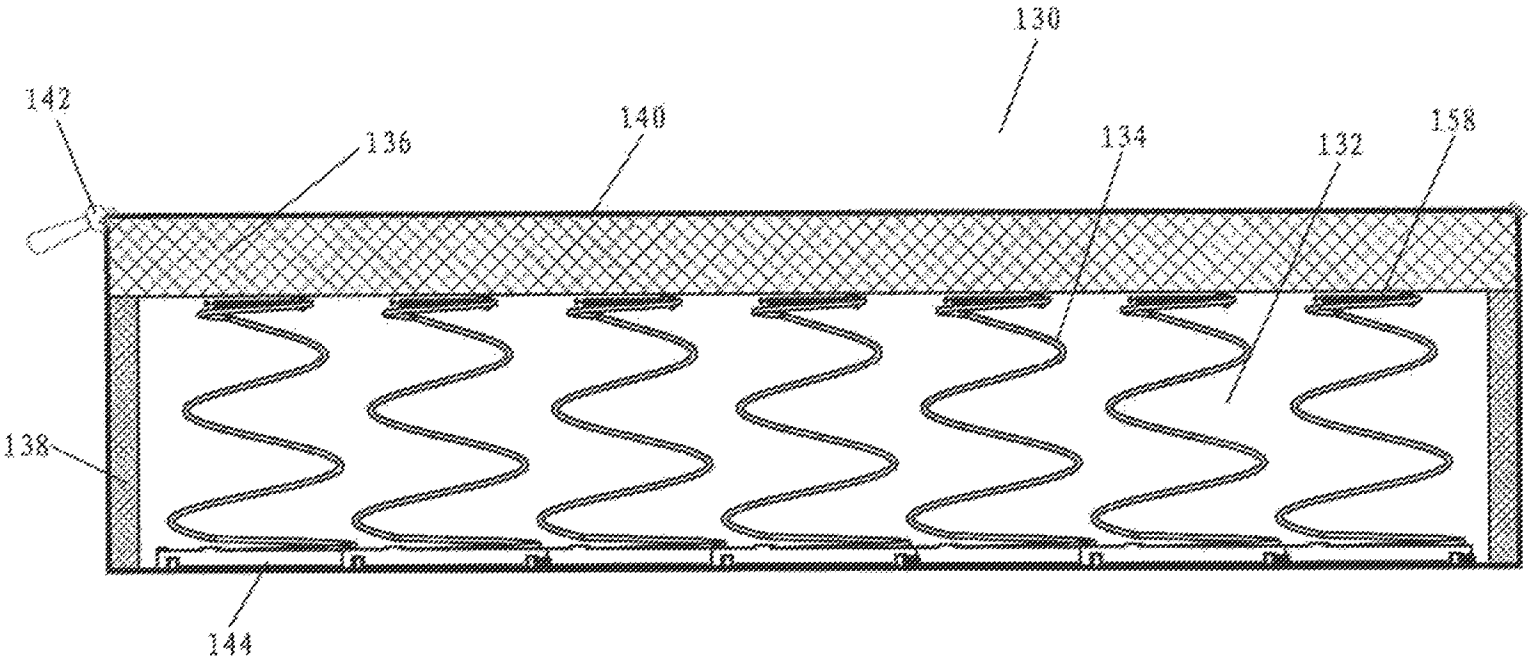
FIG. 23 is a section view of the mattress shown in FIG. 22.

As shown in FIGS. 22 and 23, a mattress 130 has a spring core 132 made up of individual spring assemblies 145 attached to each other. Each spring assembly includes at least one spring 134 and a spring cap 144. A top pad 136 is placed on top of the spring core 132. Side pads 138 are positioned around the perimeter of the spring core. The top pad 136 and the side pads 138 may be a foam material, typically 2 to 8 cm thick. In the example shown four separate side pads 138 are used. However, a single side pad 138 wrapped around the corners of the spring core 132 and/or the top pad 136 may also be used. The side pad 138 may optionally be omitted from one or more sides of the mattress depending on its intended use. As shown in FIGS. 22 and 23, the mattress 130 has no rigid frame or side pieces, each spring assembly is individually attachable to adjoining spring assemblies, and the springs themselves are attached to the spring caps, but not to each other. Similarly, the mattress needs no internal ribs, strips or other structures to attach the springs.

The side pads 138 may be attached to the top pad 136 via an adhesive, fasteners, Velcro® hook and loop tape or an equivalent. A cloth or fabric cover 140 is generally provided over the top pad 136 and the side pads 138. The cover 140 may optionally also cover the bottom of the mattress. As shown in FIG. 23, a zipper 142 may be provided on the cover 140 at the perimeter of the top pad 136 to better facilitate installation and removal of the cover. Also as shown in FIG. 23, the spring caps may rest on the floor.

The springs 134 may be metal, e.g., steel coil springs generally having a single spiral of wire, although in some embodiments multiple spirals may be used. The springs 134 are conical, tapering from a larger diameter bottom coil 160 to a smaller diameter top coil 58. The bottom coil may have a diameter of 5 to 15 cm, with the top coil typically having a diameter of 30 to 90% or 45 to 70% of the bottom coil. In most designs the springs 134 taper conically and uniformly, and all of the springs are the same.

Figure 28:
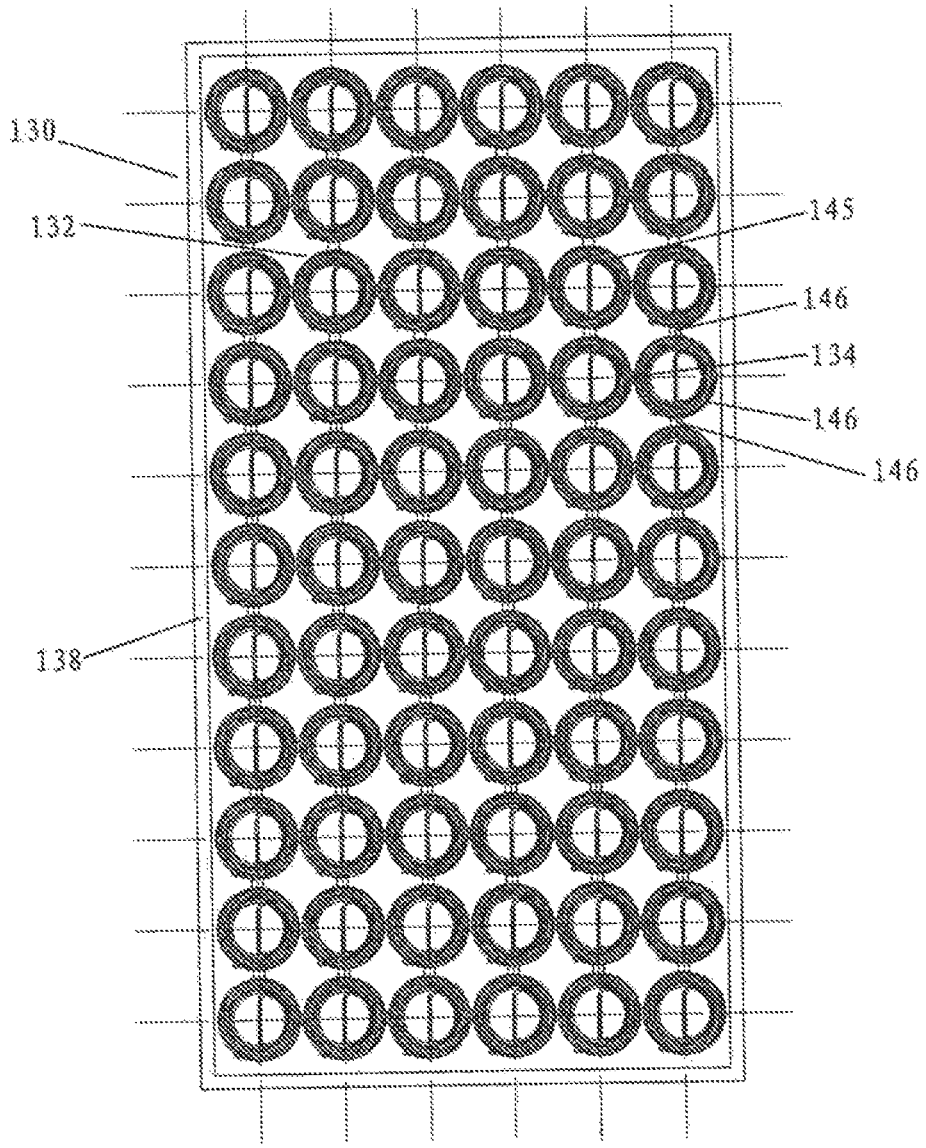
FIG. 28 is a top view of a mattress having design elements of the invention and with the top layers removed for illustration.
Figure 29:
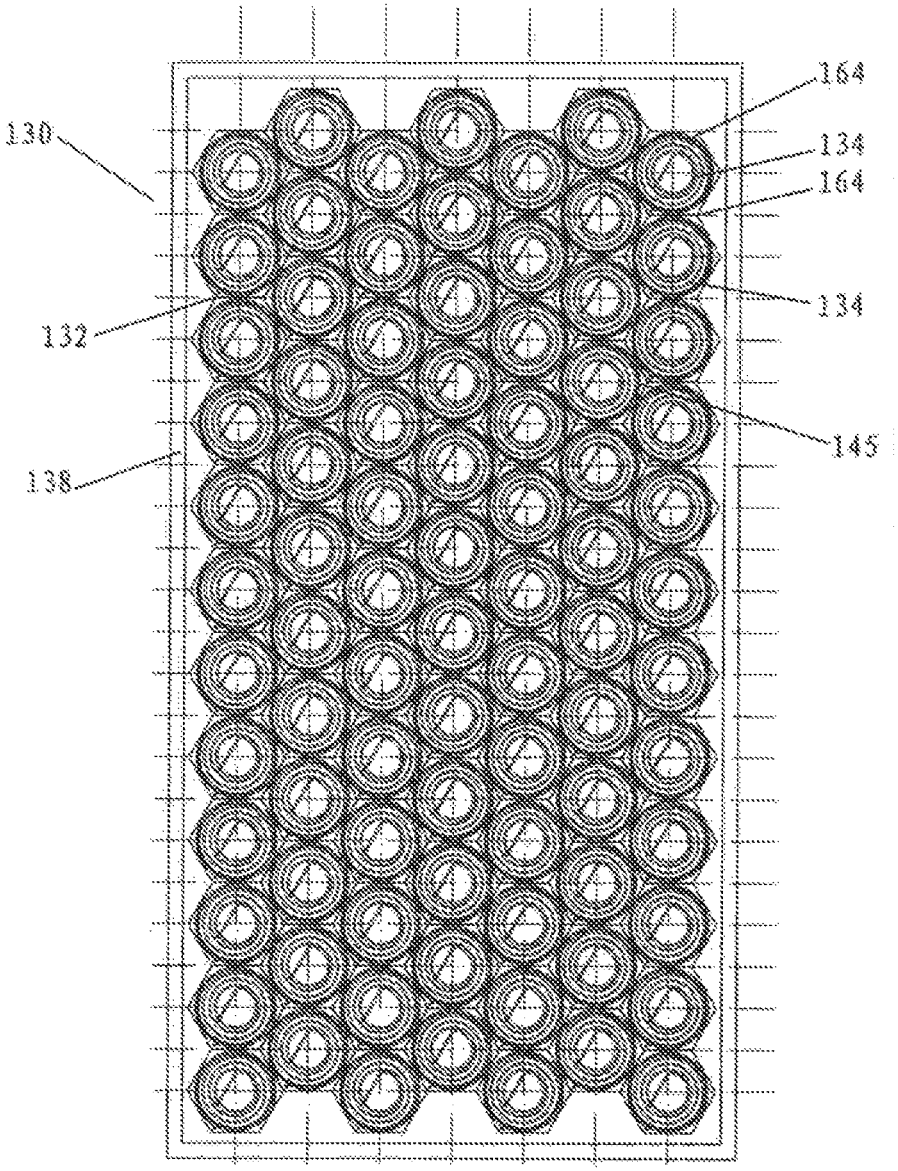
FIG. 29 is a top view of another mattress having design elements of the invention and with the top layers removed for illustration.

Referring momentarily also to FIGS. 28 and 29 the number of spring assemblies 145 used will vary with the size and firmness of the mattress. The mattress as shown in the Figures may have 11 rows and 6 columns of spring assemblies 145. The spring assemblies may be in a rectangular array as shown in FIG. 28, or in a diamond pattern as shown in FIG. 29, where the spring assemblies are more closely packed. The spring assemblies or elastic modules of FIGS. 1-21, of any type, may also be arranged in a triangle pattern, a rectangle pattern, or a hexagon pattern.

As shown in FIG. 28, each interior spring assembly 145 (excluding the corners) is attached to four other adjacent spring assemblies, while in FIG. 29 each interior spring assembly is attached to six other adjacent spring assemblies. Correspondingly, in FIG. 28, each exterior or perimeter spring assembly 145 is attached to three other adjacent spring assemblies, whereas in FIG. 29 each perimeter spring assembly is attached to four other adjacent spring assemblies. While a standard conventional mattress may have about 300 springs, the number of springs in the present mattress is reduced on reliance of its other design features.

Figure 24A:
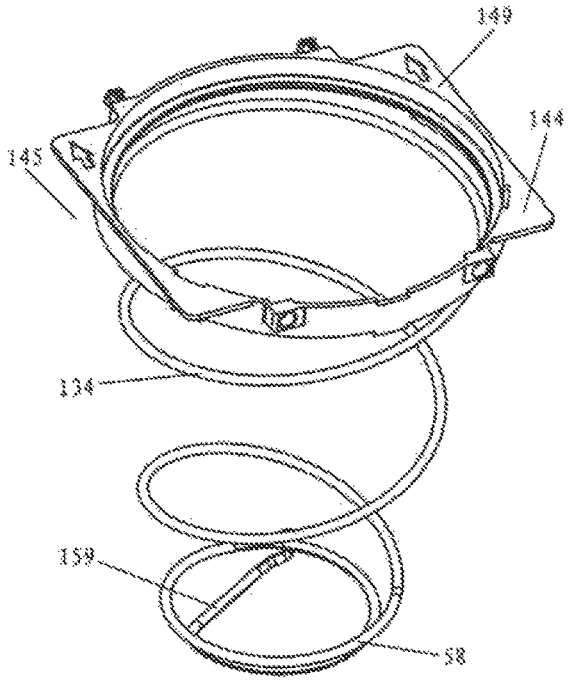
FIG. 24A is an inverted perspective view of one of the spring assemblies shown in FIGS. 1 and 2.
Figure 25:
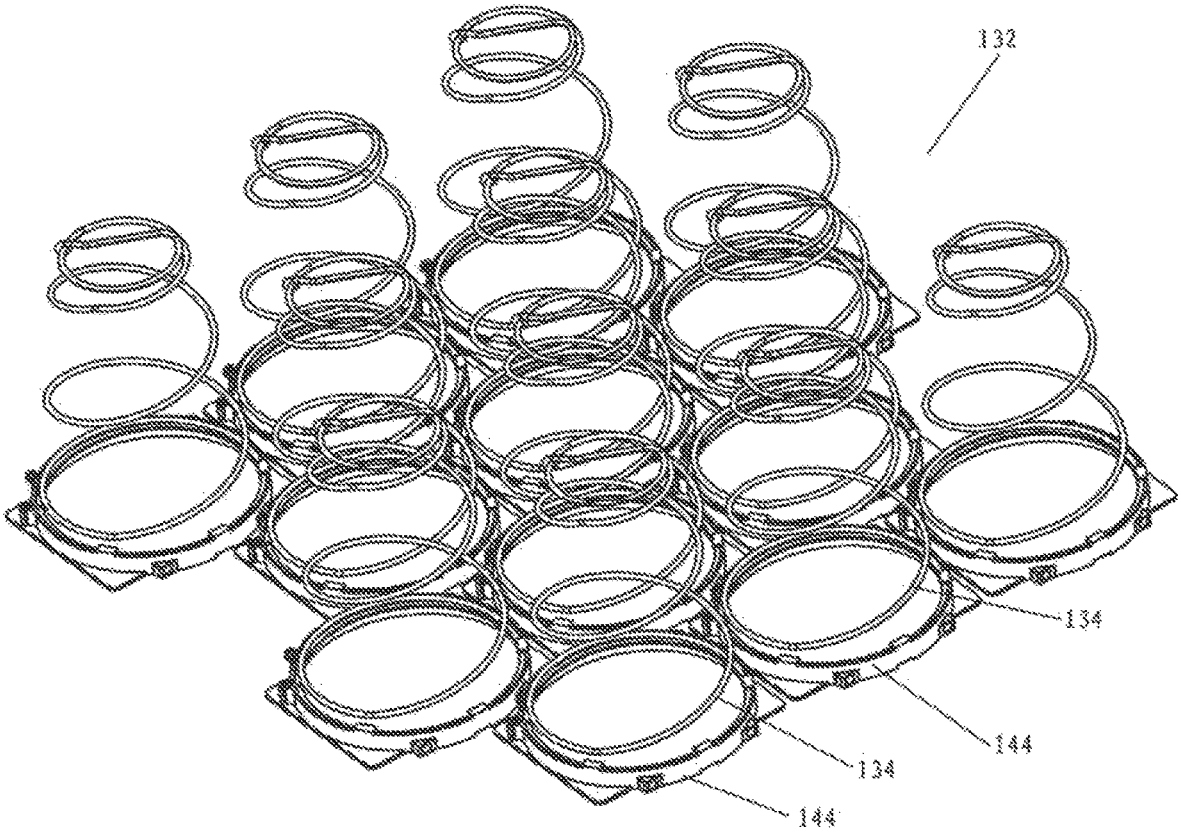
FIG. 25 is a perspective view of part of the spring core shown in FIGS. 22 and 23.

Turning to FIG. 24A, the bottom coil of the spring 134 is dimensioned to fit into the spring cap 144. A top segment 159 of the spring 134 extends across the top coil of the spring, forming a diameter or a chord of the top coil. Each spring cap 144 is generally ring-shaped with a large round central opening in the body 149 of the spring cap. FIG. 25 shows part of a spring core 132 formed by attaching spring caps 144 to each other.

Figure 24B:
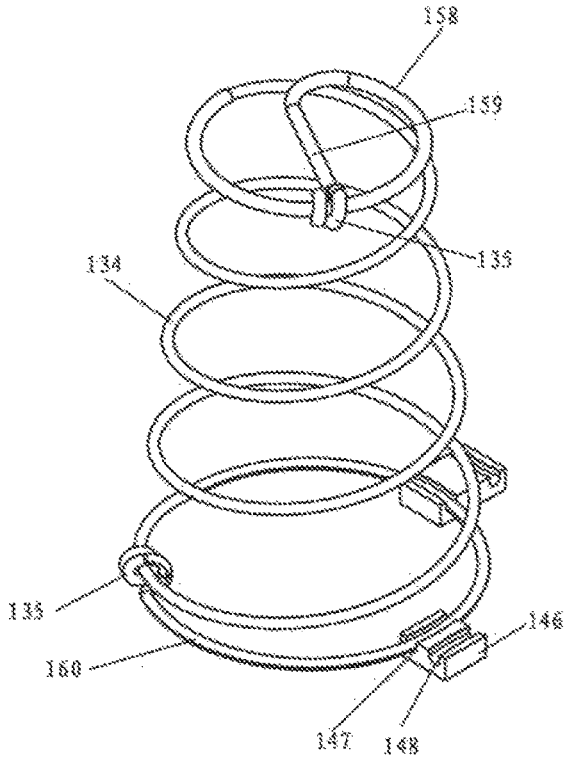
FIG. 24B is a perspective view of another spring assembly.
Figure 26:
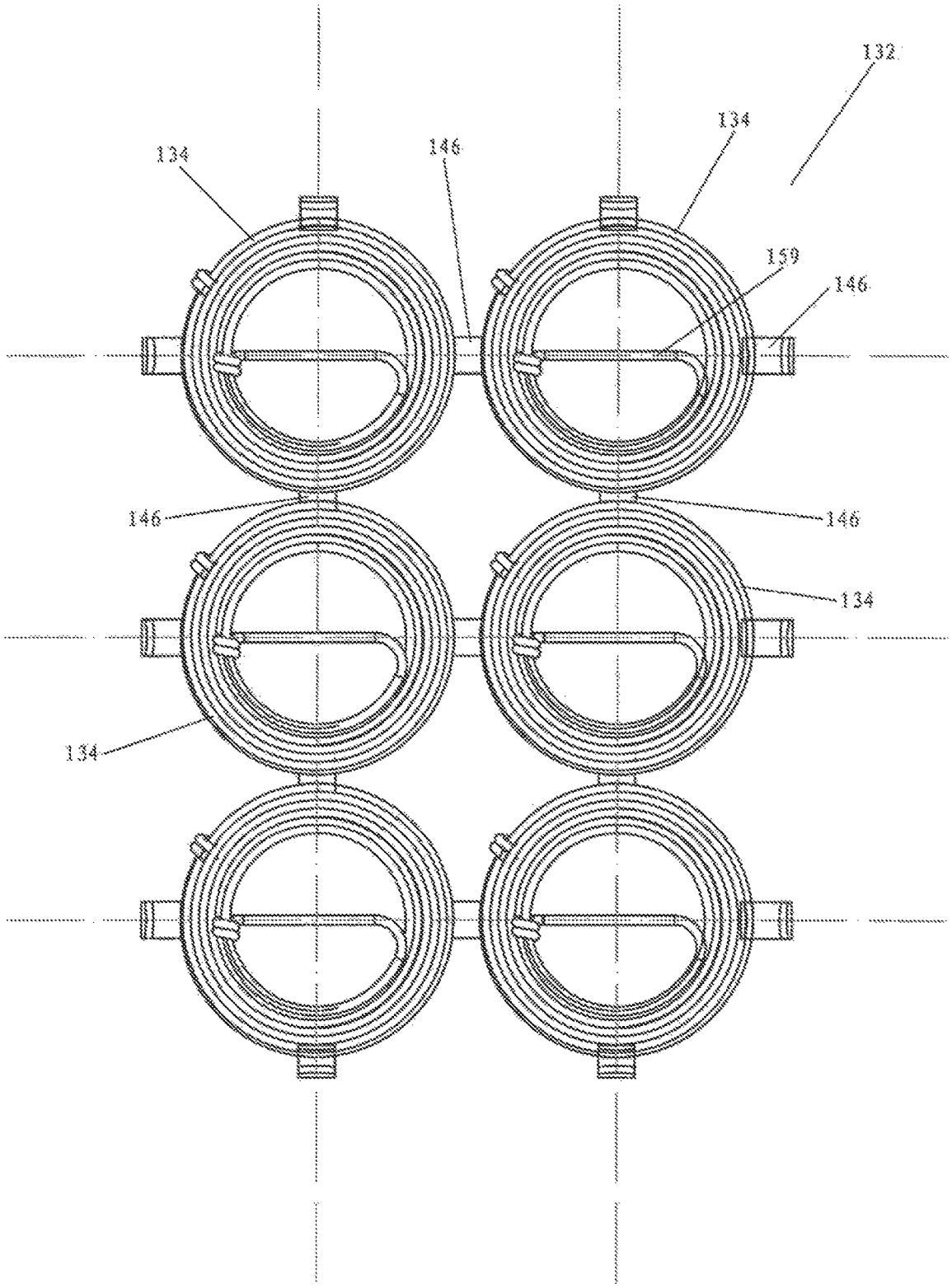
FIG. 26 is a top view of part of another spring core.

FIG. 24B shows an alternative design using a spring clip 146 instead of a spring cap 144 to attach the springs together to form a spring core 132. The spring clip 146 may be provided as a block of metal or plastic having a first slot 147 and a second slot 148. The bottom coil 160 of the spring 134 is placed into the first slot 147 and the bottom coil of an adjacent spring is placed into the second slot 148. The bottom coils 160 may optionally snap into the slots. In some designs one or more of the spring clips 146 may be permanently attached to the spring 134. Alternatively, the spring clips 146 may be separately provided and installed as needed. As shown in FIGS. 26 and 28, if the spring clips 146 are used, generally each spring 134 is attached to four adjacent springs, using four spring clips 146. Various other forms of spring clips 146 may of course also be used, as any device capable of securing the springs together may serve as a spring clip 146.

Figure 27A:
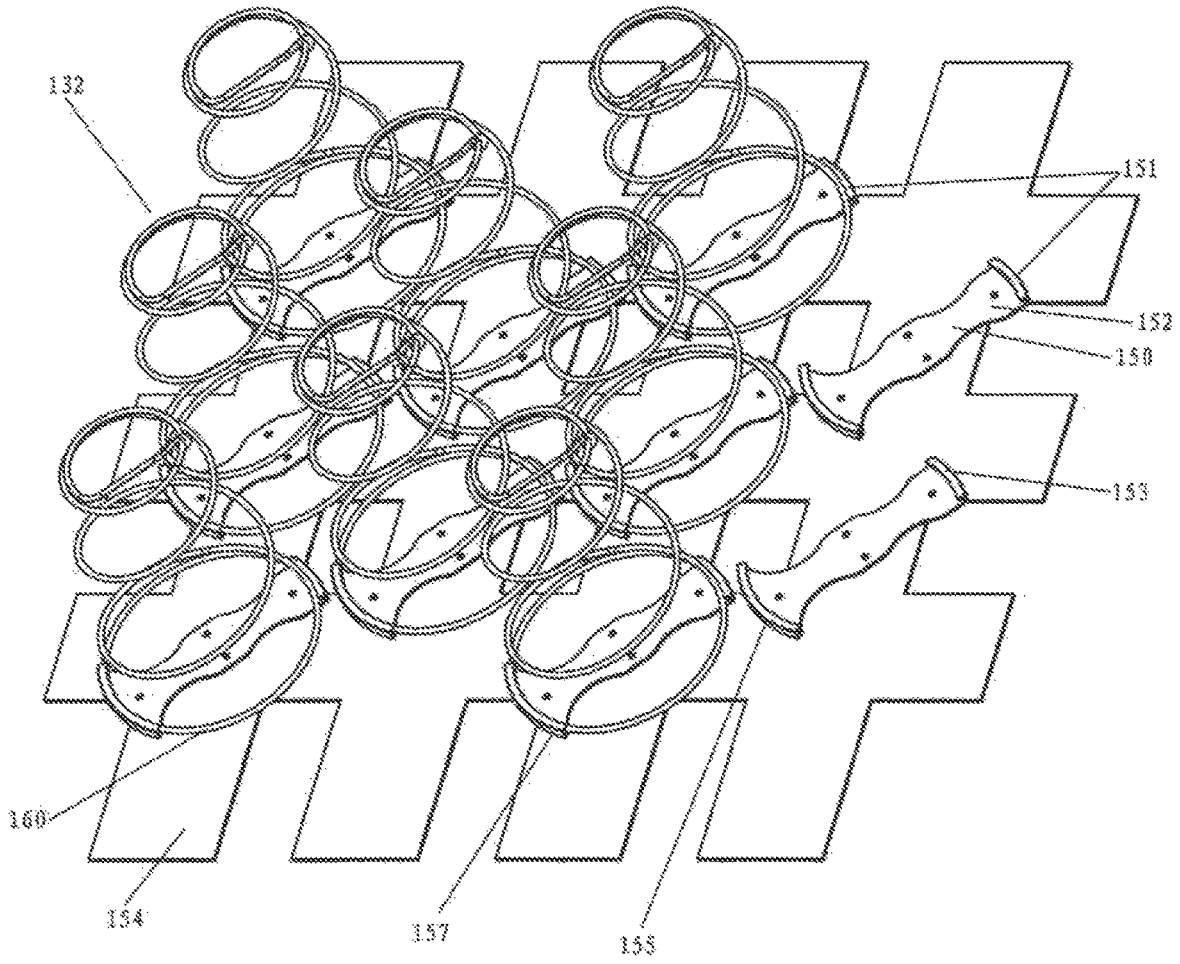
FIG. 27A is a perspective view of part of a spring core having a grid webbing or backing plate.

Referring to FIG. 27A, the mattress 130 may use spring caps 150 that are attached to a webbing or backing sheet 154. In the example of FIG. 27A the webbing is provided as a grid having equally spaced apart through openings. The webbing 154 may be a thin flexible material, so that it can be rolled up or folded when the mattress is not in use. Alternatively, the webbing 154 may be a rigid plate. In FIG. 27A the spring caps 150 are permanently attached to the webbing 154, although in other designs the spring caps may be removable from the webbing 154. The spring cap 150 has an elongated flat base 152 with first and second arc sections 151 and 155 projecting up from the base 152. The arc sections 151 and 155 may both have inward facing grooves 153 or both have outward facing grooves 157. The grooves are adapted to receive and hold the bottom coil of the spring 134. If the groves are both inward facing grooves, the bottom coil of the spring is first compressed and pushed into the grooves, and then released to expand radially outwardly into the inward facing grooves. If the grooves are both outer facing grooves, the bottom coil of the spring is first expanded, placed over the arc sections, and then released to compress inwardly into the outward facing grooves. In the design shown, all of the spring caps 150 are aligned parallel to each other, and at an acute angle (e.g. 35 to 55°) relative to the rows and columns of the webbing 154.

Figure 27B:
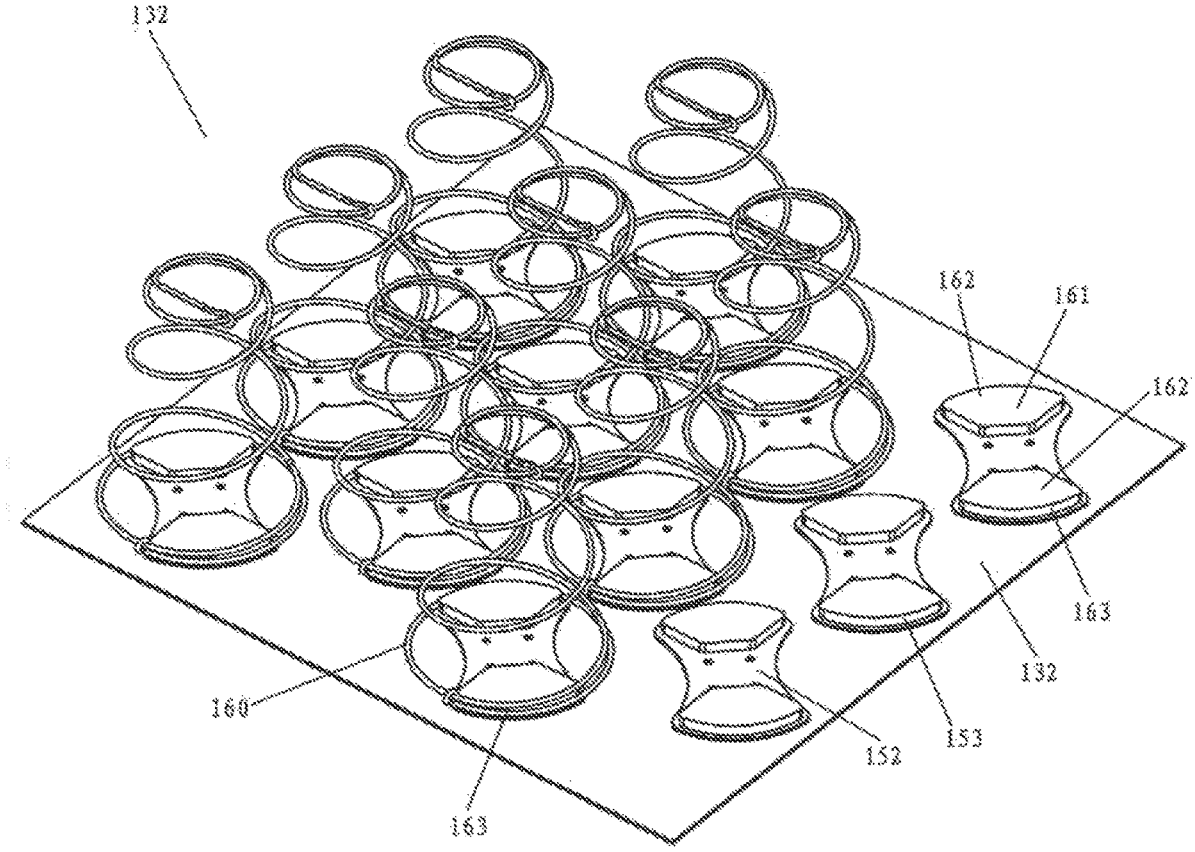
FIG. 27B is a perspective view of part of a spring core having a solid or continuous webbing or backing plate.

FIG. 27B shows a similar design using a solid webbing 56 without through holes. The spring caps 161 in FIG. 27B have spaced apart lugs 162 on a flat base 152, with an outward-facing groove 163 on each lug. The design of FIG. 27B may have elements assembled and used in the same way as described above relative to FIG. 27A. With the spring caps 150 and 161 attached (removably or permanently) to the webbing 154 and 156 in FIGS. 27A and 27B, respectively, the spring caps are not attached to each other, as in FIGS. 22-29.

Figure 27C:
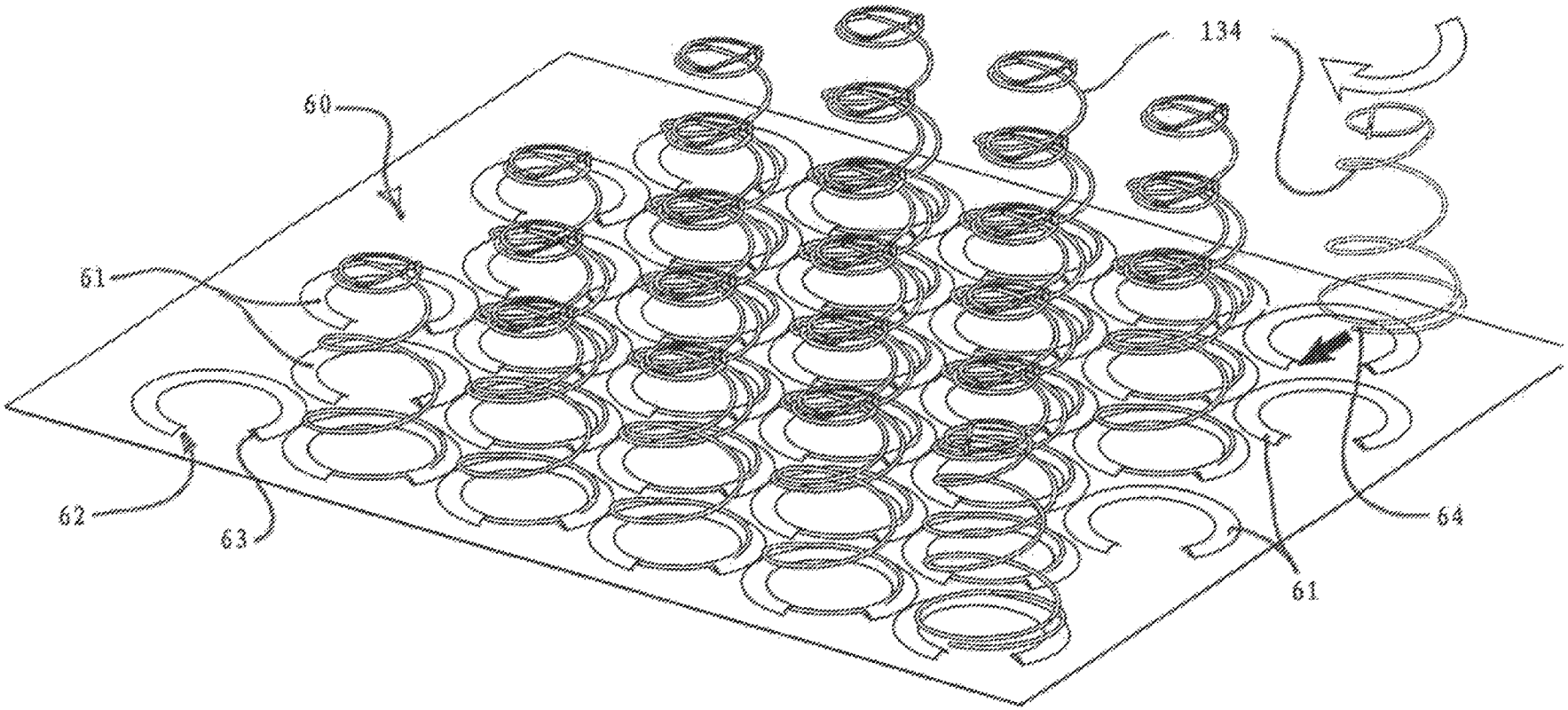
FIG. 27C is a perspective view of part of a spring core having an alternative webbing or backing plate.
Figure 27D:
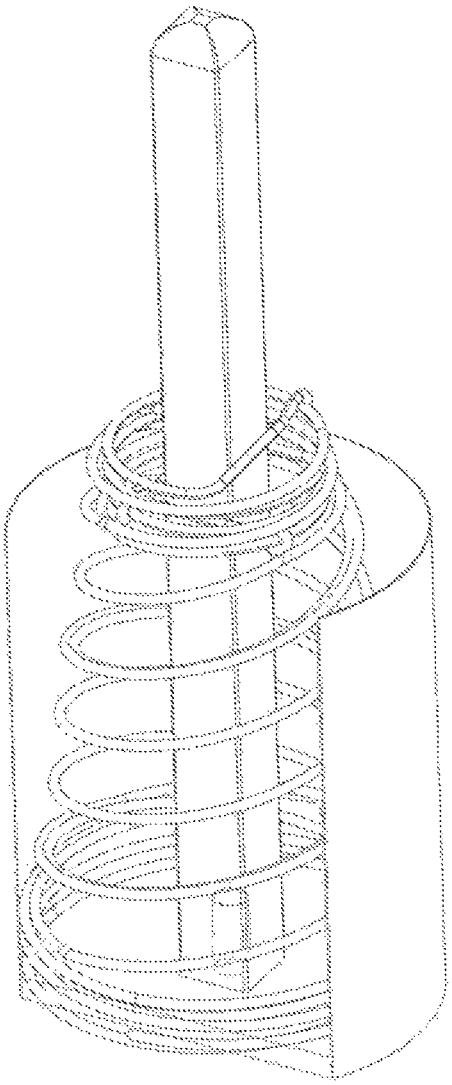
FIG. 27D is a perspective view of the springs without spring caps in a stacked form.
Figure 27E:
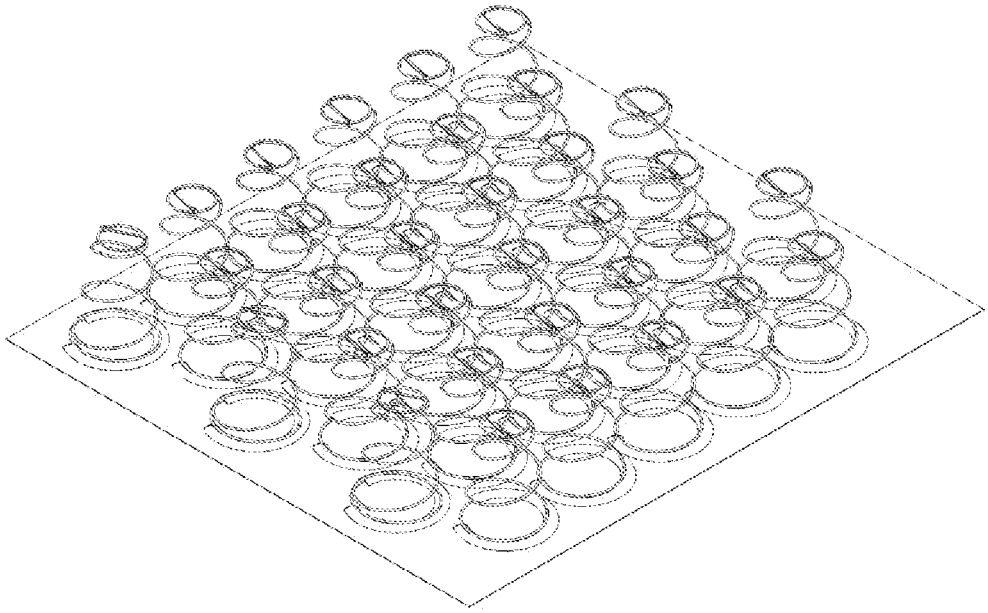
FIG. 27E is a perspective view of part of a spring core having an alternative webbing or backing plate, similar to the embodiment shown in FIG. 27C.
Figure 27F:
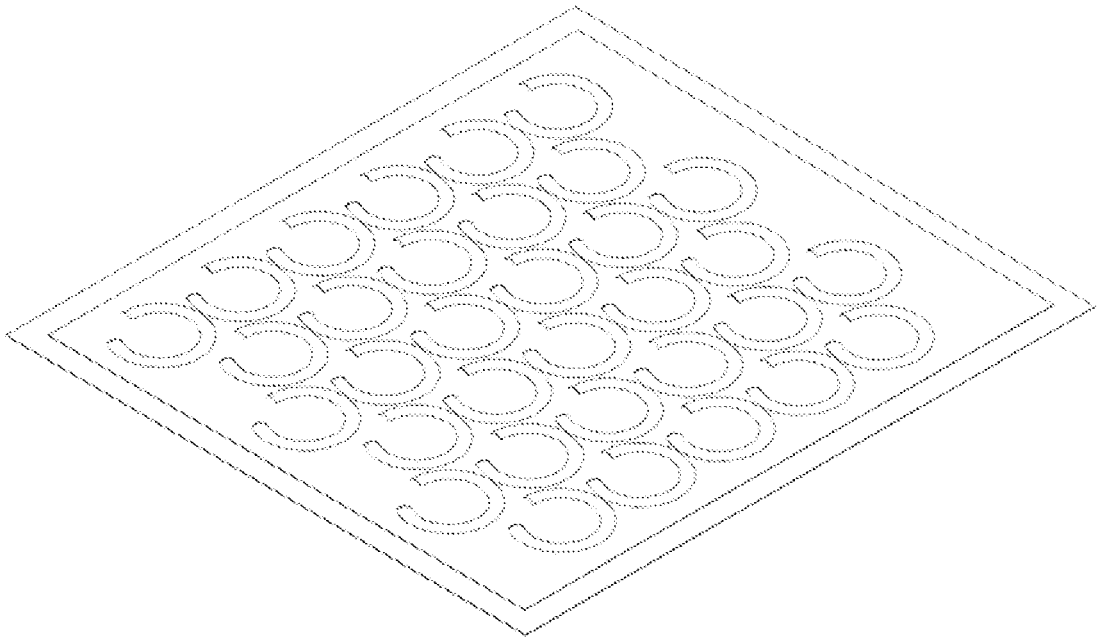
FIG. 27F is a perspective view of the alternative webbing or backing plate with a pattern of pockets or channels, similar to the embodiment with shown in FIG. 27E, but without the springs.
Figures 27G, 27H:
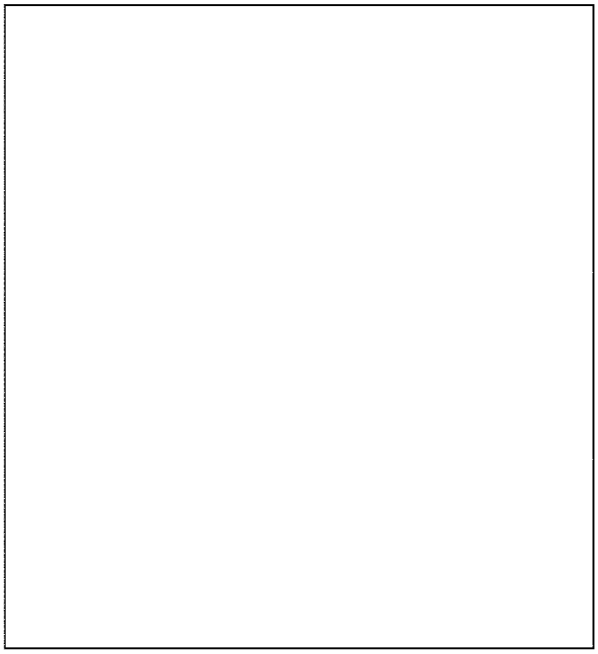
FIG. 27G is a bottom view of the alternative webbing or backing plate with a pattern of pockets or channels as shown in FIG. 27F.
FIG. 27H is a front view of the alternative webbing or backing plate with a pattern of pockets or channels as shown in FIG. 27F.
Figures 27I, 27J, 27K, 27L:
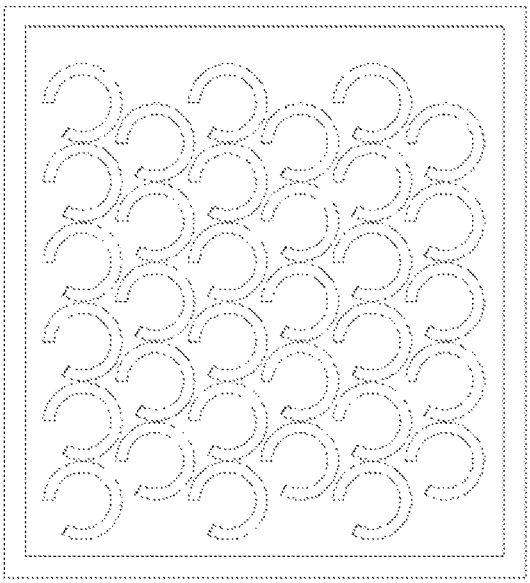
FIG. 27I is a top view of the alternative webbing or backing plate with a pattern of pockets or channels as shown in FIG. 27F.
FIG. 27J is a back view of the alternative webbing or backing plate with a pattern of pockets or channels as shown in FIG. 27F.
FIG. 27K is a left view of the alternative webbing or backing plate with a pattern of pockets or channels as shown in FIG. 27F.
FIG. 27L is a right view of the alternative webbing or backing plate with a pattern of pockets or channels as shown in FIG. 27F.

FIG. 27C shows an alternative design having a webbing 60 with a pattern of pockets or channels 61. The pocket 61 has a diameter matching the diameter of the bottom coil of the spring 134. The pocket 61 forms an arc generally of 220 to 330 degrees. The pocket 61 has an open end 62 and a closed end 63, although is some embodiments the pocket 61 may have two open ends 63. The pockets 61 may be stitched or sewn using two layers of webbing material. The springs 134 are installed onto the webbing 60 by inserting the leading free end 64 of the bottom coil of the spring into the open end 62 of the pocket, and rotating the spring 134 clockwise, typically about ¾ turn, until the spring 134 is fully installed, optionally with the leading free end 64 coming to a stop against the closed end 63 of the pocket 61. The spring 134 is then attached to the webbing 60. The spring 134 is removed using the reverse sequence, providing a quick and easy way to assemble a spring core. With the springs removed, the webbing 60 may be rolled or folded into a compact form. FIG. 27D shows several springs for use with the webbing 60 with a pattern of pockets or channels 61 as shown in FIG. 27C are stacked together.

Figure 30A:
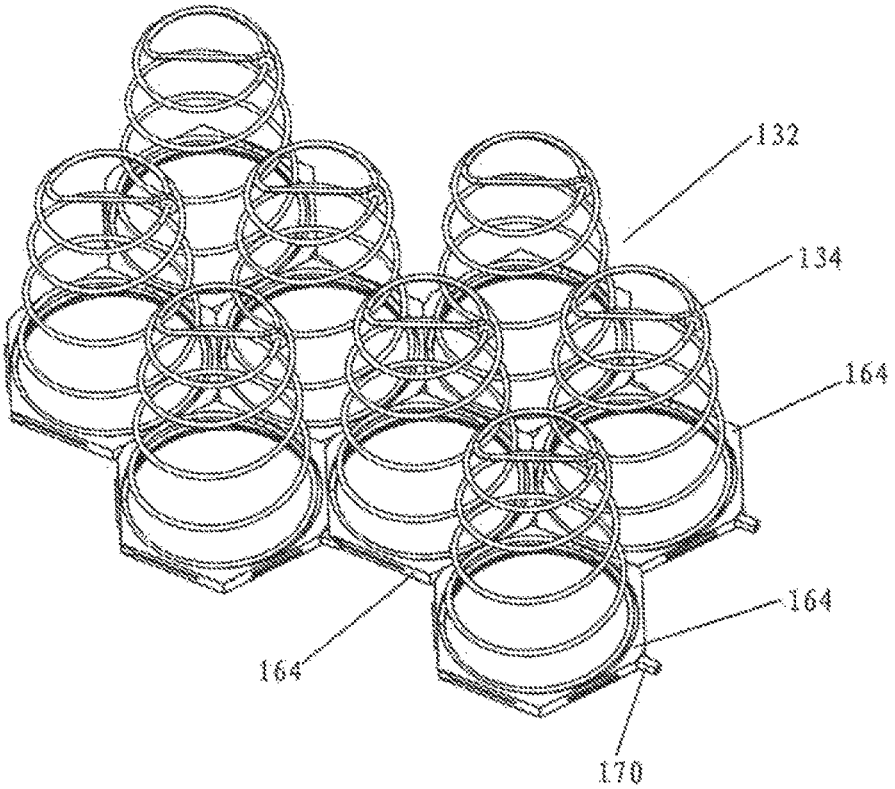
FIG. 30A is a perspective view of part of another spring core.
Figure 30B:
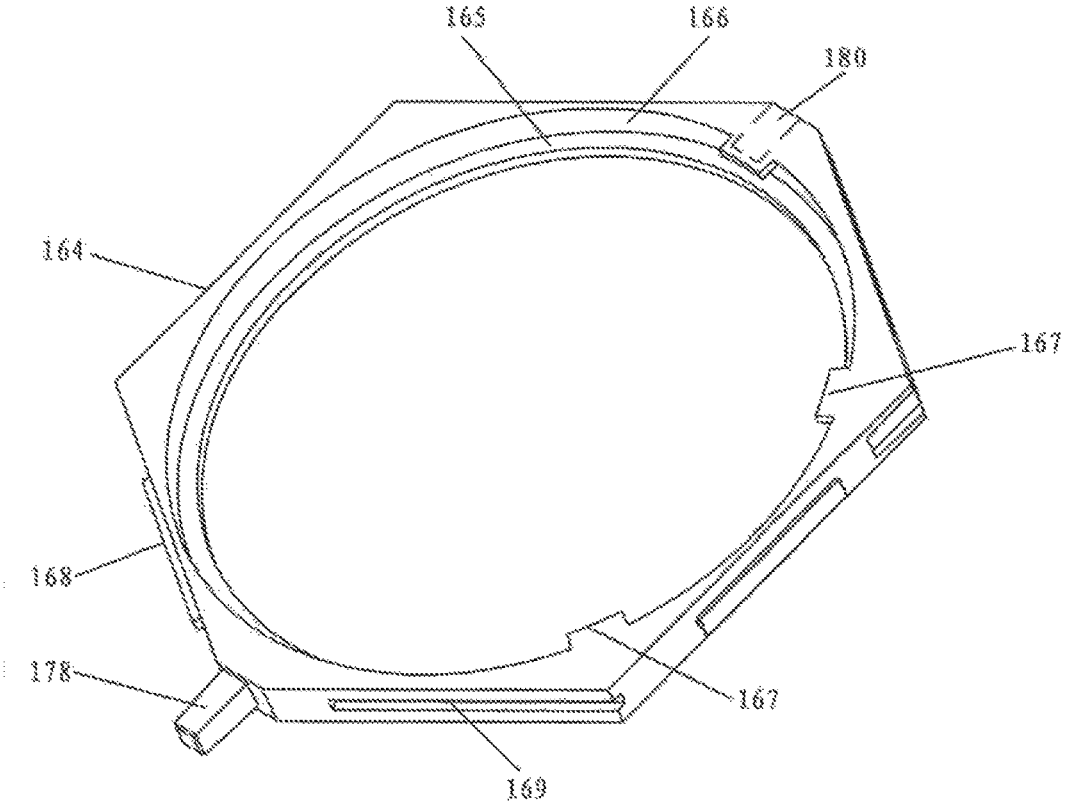
FIG. 30B is an inverted perspective view of the spring cap shown in FIG. 30A.
Figure 30C:
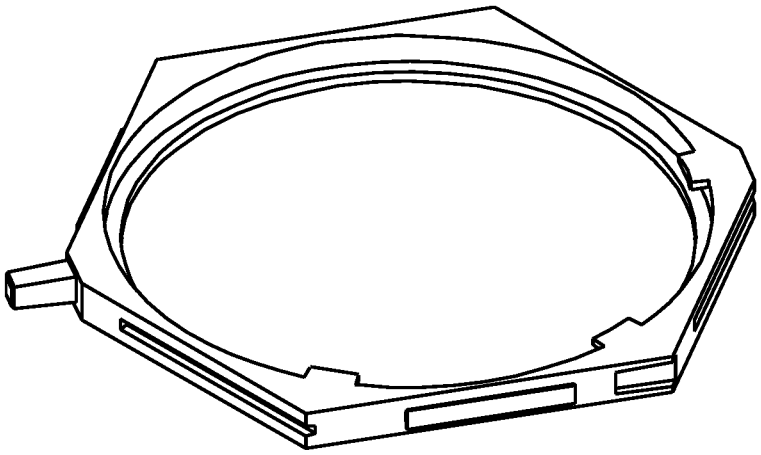
FIG. 30C is a perspective view of the spring cap shown in FIG. 30A.
Figure 30D:
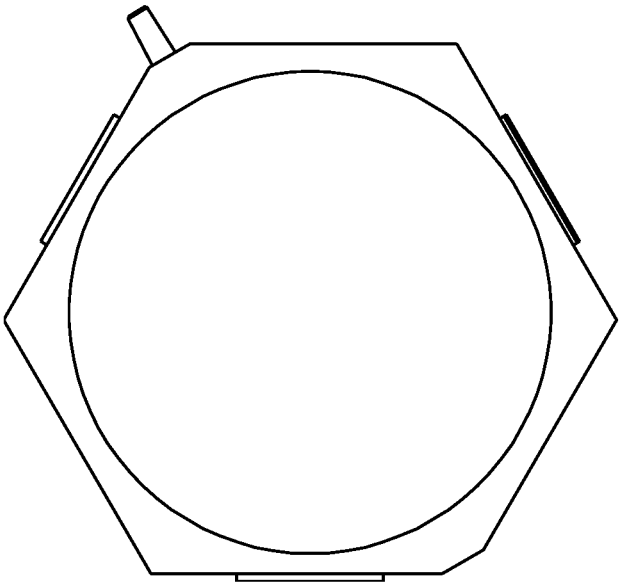
FIG. 30D is a bottom view of the spring cap shown in FIG. 30C.
Figure 30E:
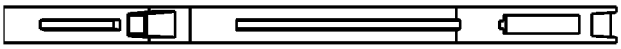
FIG. 30E is a front view of the spring cap shown in FIG. 30C.
Figure 30F:
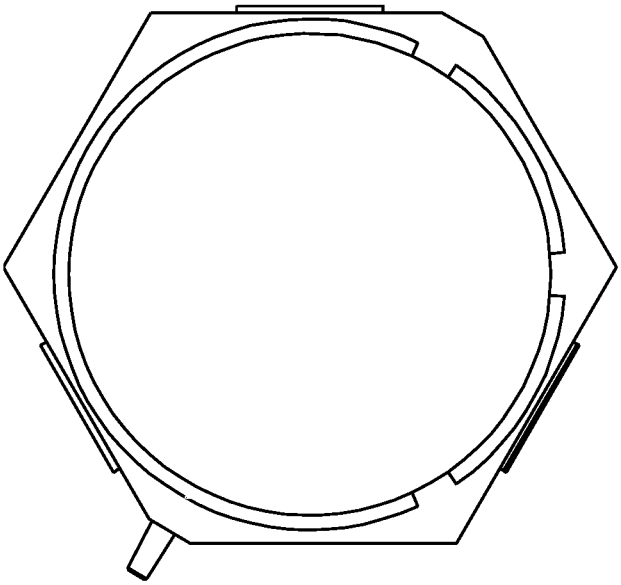
FIG. 30F is a top view of the spring cap shown in FIG. 30C.
Figure 30G:
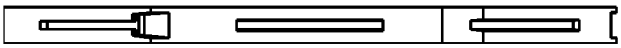
FIG. 30G is a back view of the spring cap shown in FIG. 30C.
Figure 30H:
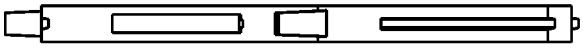
FIG. 30H is a left view of the spring cap shown in FIG. 30C.
Figure 30I:
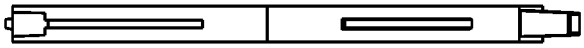
FIG. 30I is a right view of the spring cap shown in FIG. 30C.

As shown in FIG. 30B, an alternative spring cap 164 has a generally hexagonal shape, with a coil floor 165 adjoining a coil wall 166 on the top side of the spring cap. Inward tabs 167 extend radially inwardly over the coil floor 165 to help retain the bottom coil 160 of the spring 134 onto the spring cap 164. The diameter of the coil wall 166 and the circular opening through the spring cap 164 defined by coil floor 165 will vary with the specific springs used, with typical diameters ranging from 5 to 15 cm. The inward tabs 167 may be provided only on one side of the coil floor 165 to allow for easier installation of the spring 134 onto the spring cap 164. Side tabs 168 and side slots 169 may be provided on alternating sides of the spring cap 164. Each side tab 168 is dimensioned to fit into a side slot 169 of an adjacent or adjoining spring cap 164.

The spring cap 164 may also have a side post 178 projecting radially outward from an apex or corner between two sides of the spring cap 164. A corresponding side socket or recess 180 is located opposite from the side post 178. The side post 178 is dimensioned to fit into a recess of an adjacent or adjoining spring cap 164. The spring cap 164 is flat with a height of about 3 to 15 mm, made of metal or plastic. FIG. 30A shows a spring core 132 formed using spring assemblies 145 having the spring cap 164 shown in FIG. 30B. The side post 178, if used, helps to hold the spring caps 164 in a flat plane when assembled into a spring core 132. Apart from the side tabs 168 and side slots 169, the six sides are flat and smooth to allow adjoining spring caps 164 to be closely assembled to each other as shown in FIG. 30A.

Figure 31:
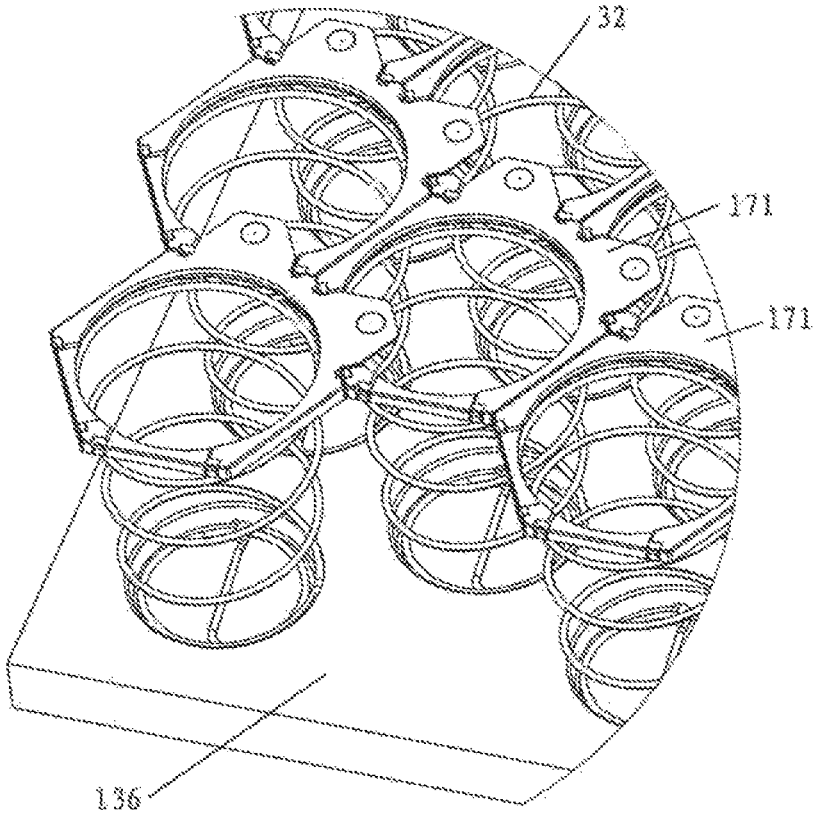
FIG. 31 is an inverted perspective view of part of another spring core.
Figure 32A:
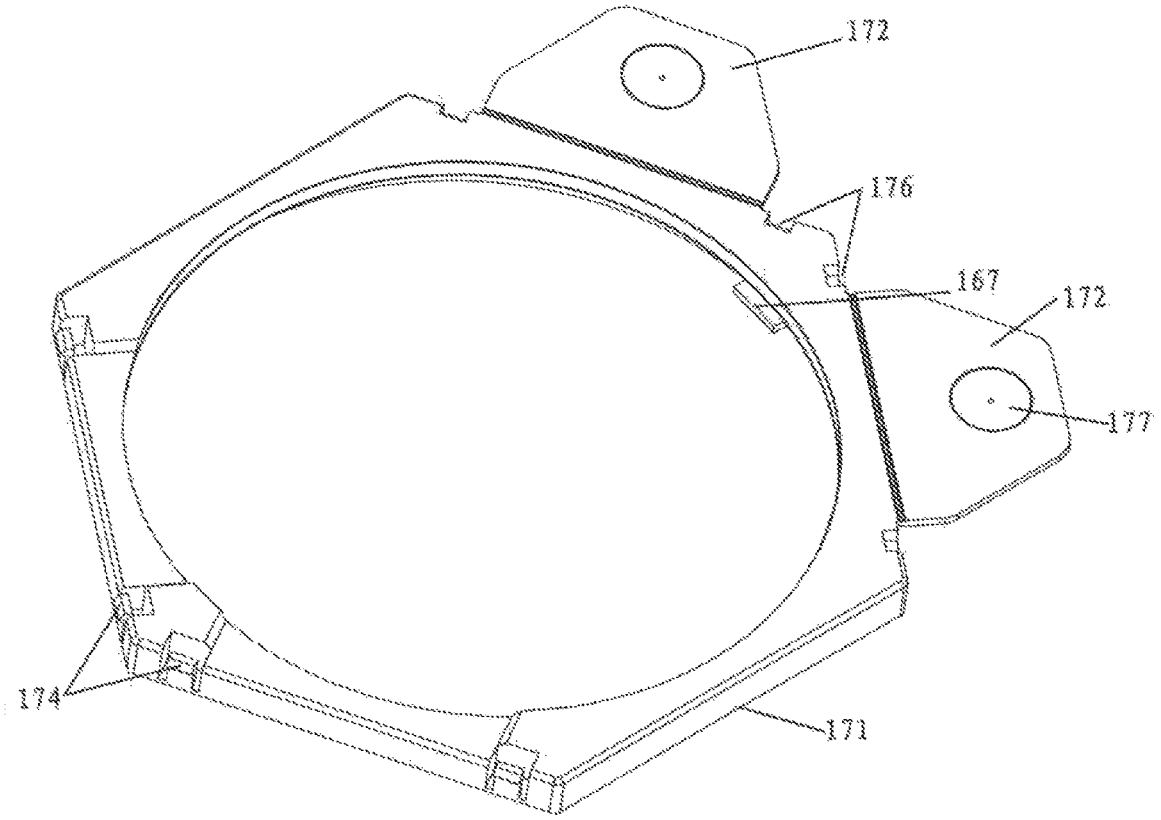
FIG. 32A is a bottom perspective view of the spring cap shown in FIG. 31.

Turning to FIGS. 31, 32A and 30B, another spring cap 171 has a hexagonal body, a coil floor 165, a coil wall 166, and tabs 167, and is otherwise similar to the spring cap 164 shown in FIG. 30B, without any side post 178, and except as described below. The spring cap 171 has side plates 172 extending radially outward from adjacent sides of the spring cap 171. A plate hook 173 projects upward from the top side of each side plate 172. The plate hook 173 has a height and curvature selected to correspond to the inside diameter of the bottom coil 160 of the spring 134. Alignment holes 177 may be provided through each side plate 172 to better allow for aligning the spring caps 171 into a stacked column, as shown in FIG. 39 and discussed below. Pairs of ring hooks 174 are provided on the bottom of the spring cap, on the sides of the spring cap 171 opposite from the side plates, adjacent to corners of the spring cap 171. Pairs of notches 176 are provided on opposite sides of each side plate 172, with the notches 176 positioned and adapted to engage with the ring hooks 174 of an adjoining spring cap 171.

Figure 32B:
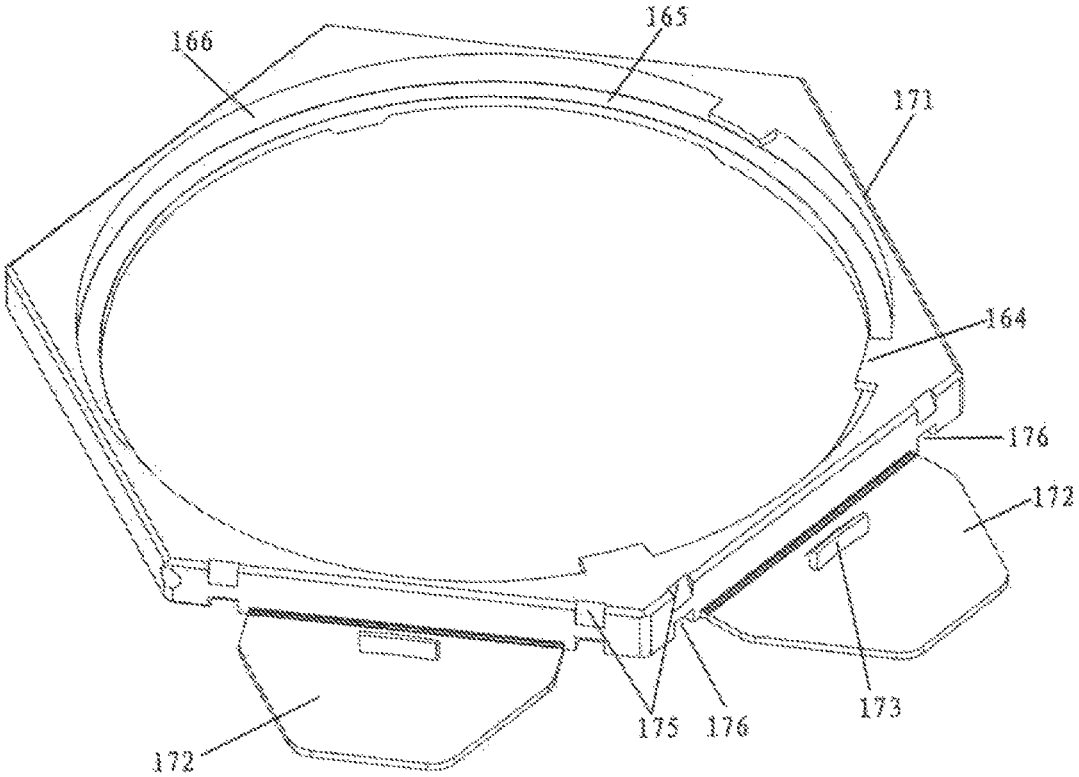
FIG. 32B is a bottom perspective view of the spring cap shown in FIG. 32A.
Figure 32C:
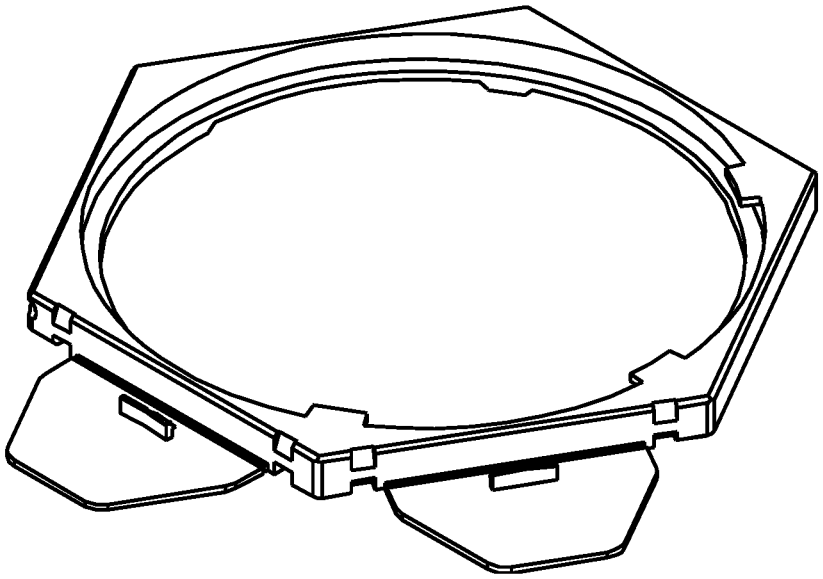
FIG. 32C is a perspective view of the spring cap shown in FIG. 32A.
Figure 32D:
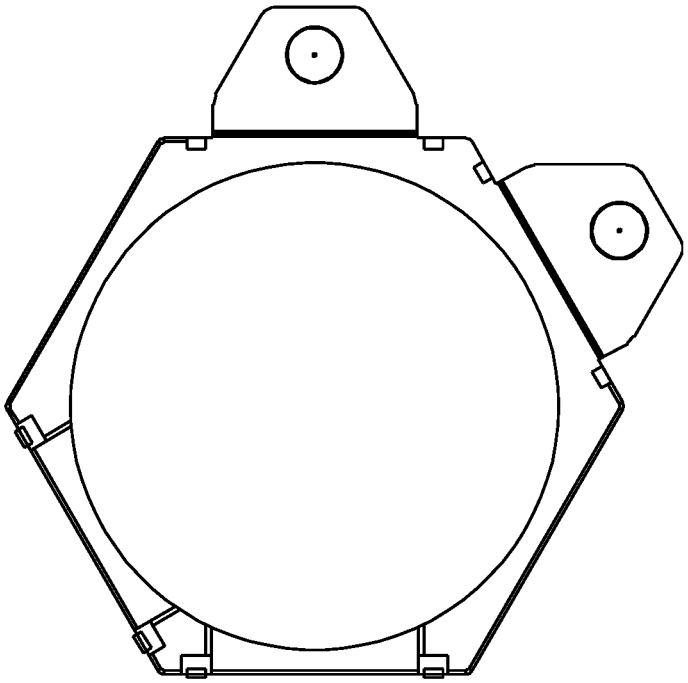
FIG. 32D is a bottom view of the spring cap shown in FIG. 32C.
Figure 32E:
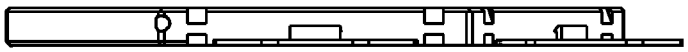
FIG. 32E is a front view of the spring cap shown in FIG. 32C.
Figure 32F:
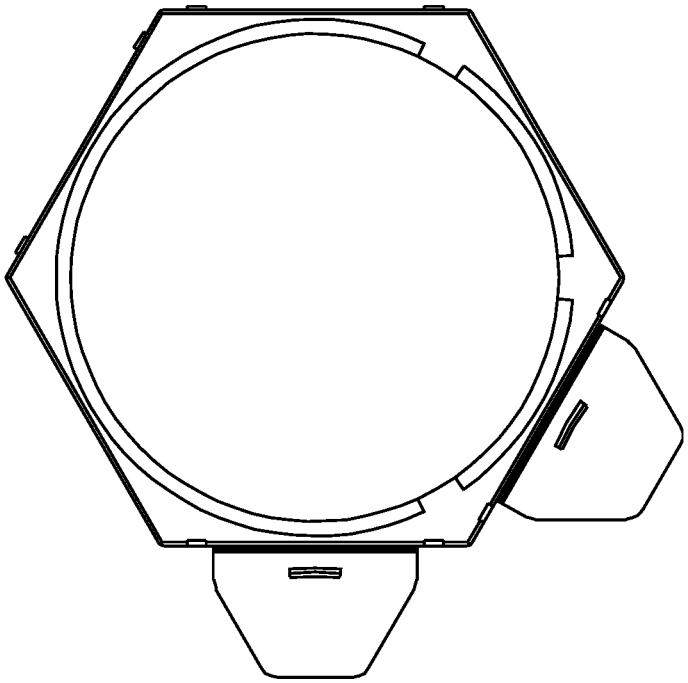
FIG. 32F is a top view of the spring cap shown in FIG. 32C.
Figure 32G:
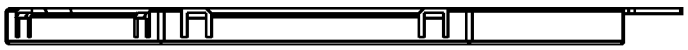
FIG. 32G is a back view of the spring cap shown in FIG. 32C.
Figure 32H:
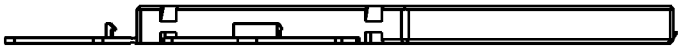
FIG. 32H is a left view of the spring cap shown in FIG. 32C.
Figure 32I:
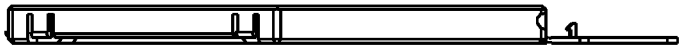
FIG. 32I is a right view of the spring cap shown in FIG. 32C.

FIG. 31 is a bottom view of a spring core 32 formed using springs 134 and spring caps 171. The bottom coil 160 of the spring 134 is held in the spring cap 171 between the coil tabs 167 and the coil floor 165. If the spring 134 is rotated slightly when pressed onto the spring cap 171, the bottom coil 160 may momentarily slightly contract during installation and then return to its original diameter. In this case, friction may also help to hold the bottom coil 160 in place via a radial outward spring force holding the bottom coil 160 against the coil wall 166. The plate hooks 173 engage with the inner surface of a corresponding segment of the opening of the spring cap of an adjoining spring assembly, e.g., at the lead line of element 166 in FIG. 32B. The ring hooks 174 engage the notches 176 of adjoining spring caps 171. As shown in FIG. 32B, ramps 175 at the top of spring cap 171 aligned with the notches 176 may be used to guide the ring hooks 174 into the notches 176. The ring hooks 174 and the plate hook 173 have a limited amount of resiliency or flexibility due to their design and dimensions, and also optionally resulting from resiliency characteristics of the material used to manufacture the spring cap 171, for example a plastic material. The plate hooks 173 and the ring hooks 174 may snap into place during assembly of the spring core.

Figure 33A:
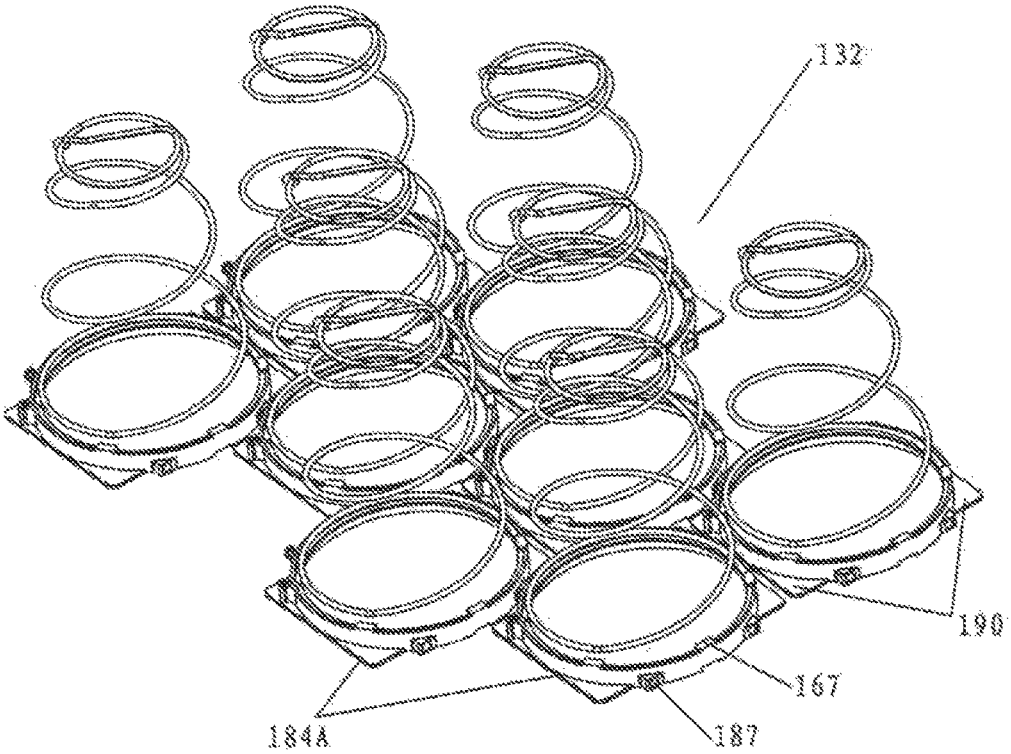
FIG. 33A is a perspective view of part of another spring core.
Figure 33B:
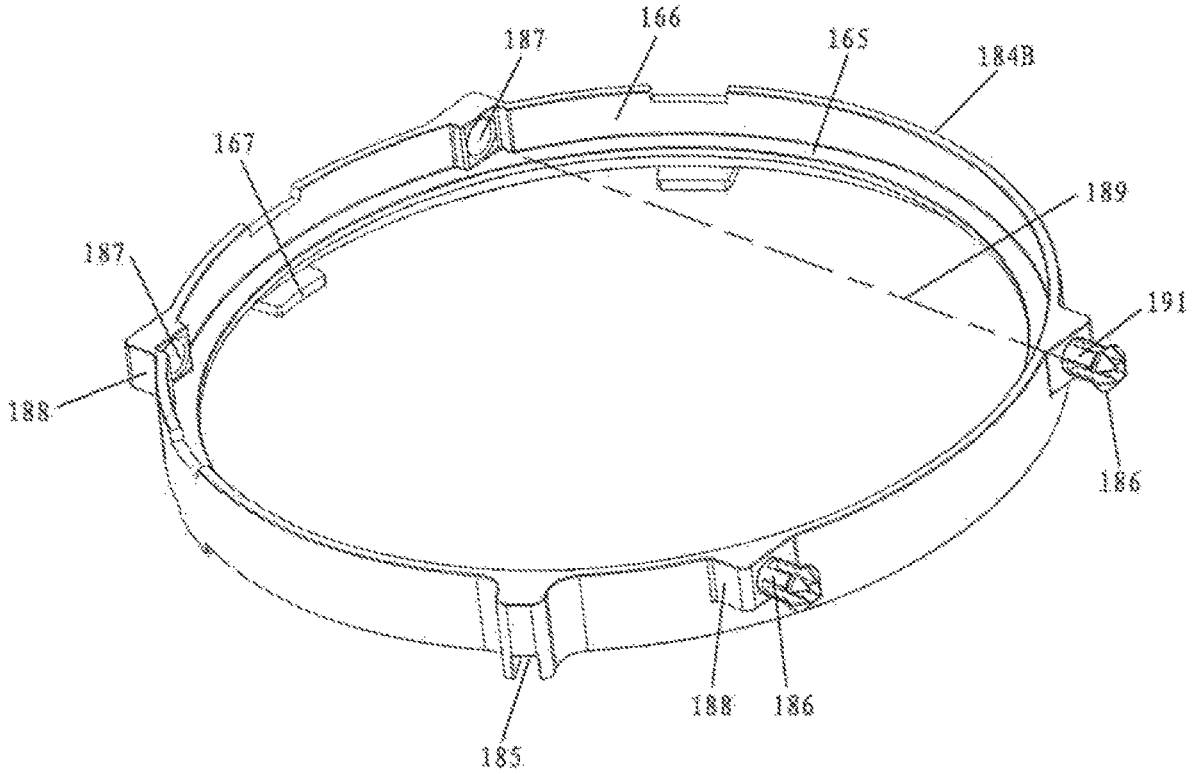
FIG. 33B is a top perspective view of another spring cap.
Figure 33C:
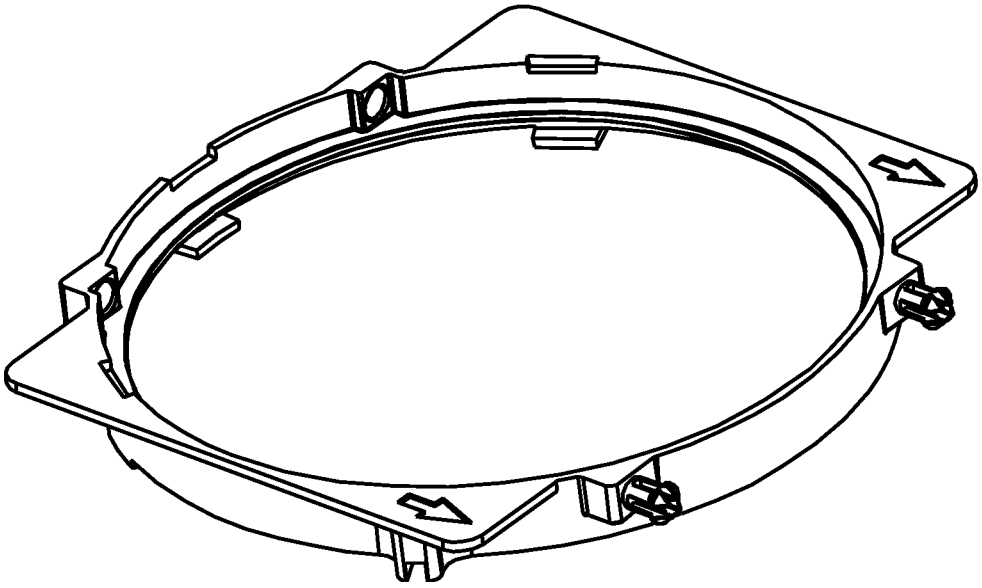
FIG. 33C is a perspective view of the spring cap shown in FIG. 32A.
Figure 33D:
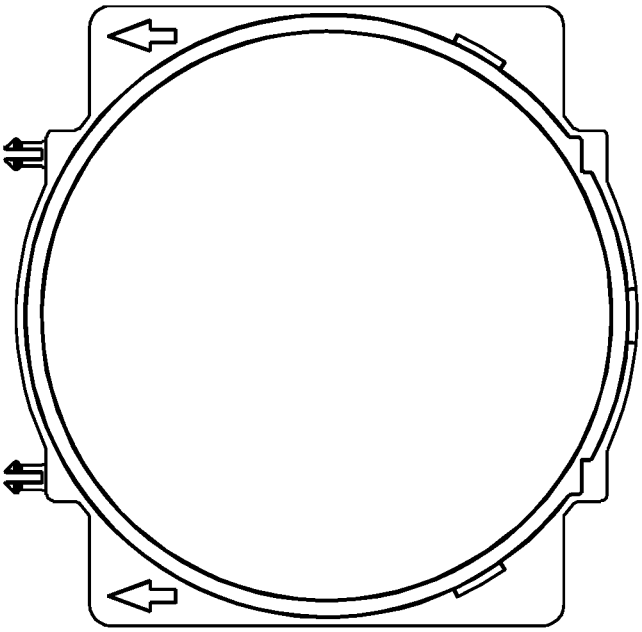
FIG. 33D is a bottom view of the spring cap shown in FIG. 33C.
Figure 33E:
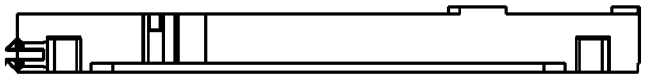
FIG. 33E is a front view of the spring cap shown in FIG. 33C.
Figure 33F:
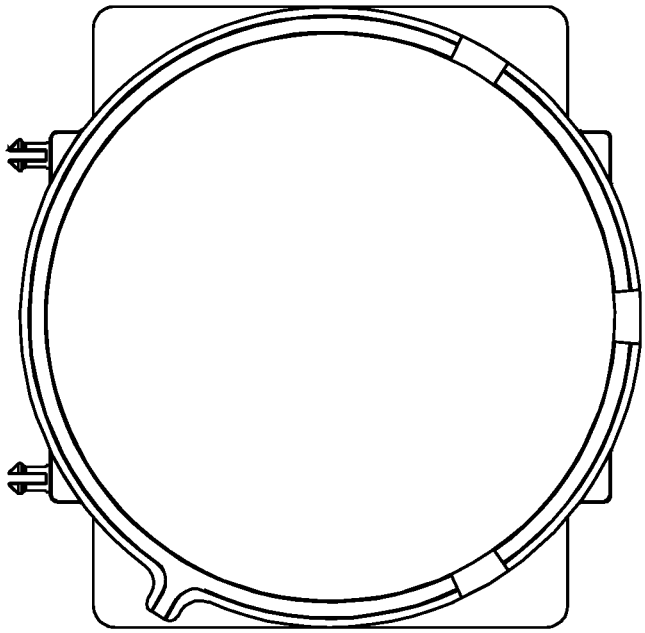
FIG. 33F is a top view of the spring cap shown in FIG. 33C.
Figure 33G:
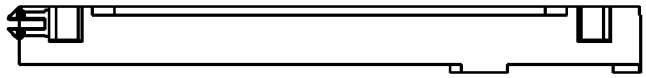
FIG. 33G is a back view of the spring cap shown in FIG. 33C.
Figure 33H:
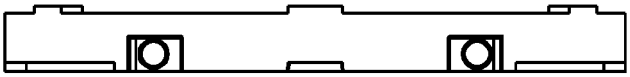
FIG. 33H is a left view of the spring cap shown in FIG. 33C.
Figure 33I:
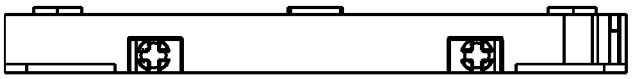
FIG. 33I is a right view of the spring cap shown in FIG. 33C.

Referring to FIG. 33B, another spring cap 184B has a coil floor 165, a coil wall 166 and coil tabs 167 as described above. The spring cap 184B may also have a spring end socket 185 to hold the end of the wire of the spring 134. A pair of split pins 186 project outward from bosses 188 on a first side of the spring cap 184B. A corresponding pair of pin holes 187 extend through bosses 188 on a second side of the spring cap 184B, opposite from the first side, with the pin holes 187 aligned with the split pins 186. The outer end of each split pin 186 may be tapered or angled. FIG. 33A shows a part of a spring core 132 formed using springs 134 and spring caps 184A, which are the same as the spring caps 184B but further include corner tabs 190. The corner tabs 190, if used, may help the spring cap 184A rest flat on the floor. The corner tabs 190 may also stiffen the spring cap 184A against twisting and bending, and also help to keep the spring caps 184A aligned when stacked into a column for storage, as described below.

As shown in FIGS. 33A and 33B, the spring core 132 is formed by installing a spring 134 into each spring cap 184A (or 184B). The spring caps 184A are then attached to each other by pushing the split pins 86 into the pin holes 187 of an adjoining spring cap 184A. Each split pin 86 may have multiple flexible arms 191 that bend inward as the split pin passes into the pin hole 187, and then return to their original position, thereby tending to securely hold adjoining spring caps 184A together. In an alternative method, the spring caps 184A may first be attached to each other, with a spring 134 then subsequently installed into each spring cap 184A.

Referring back to FIG. 24B, the ends of most springs 134 are terminated in an end winding 135 where the wire forming the spring is wound around itself. When installing a spring into a spring cap, the spring may be rotated until the bottom end winding 135 comes to rest against a stopping surface, such as a boss 188. In this way, all of the springs 134 in a spring core 132 will have the same orientation, as shown for example in FIG. 33A with all of the top segments 159 of the springs 134 parallel to each other, and the mattress 130 may have more consistent firmness. For springs not having a bottom end winding 135, the bottom end of the spring wire may be bent into a vertical segment and inserted into spring end socket 185, if used.

Figure 34A:
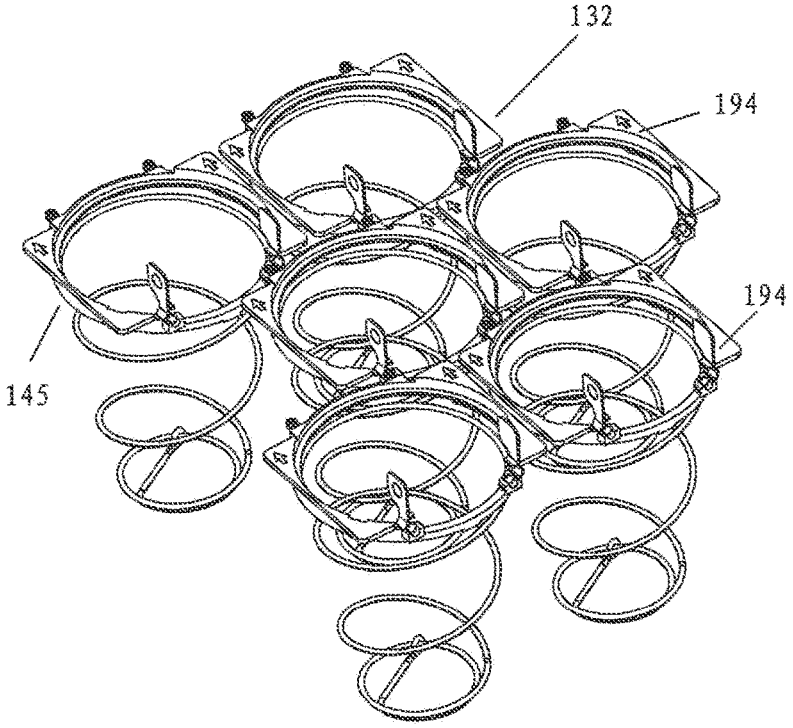
FIG. 34A is an inverted perspective view of part of another spring core.
Figure 34B:
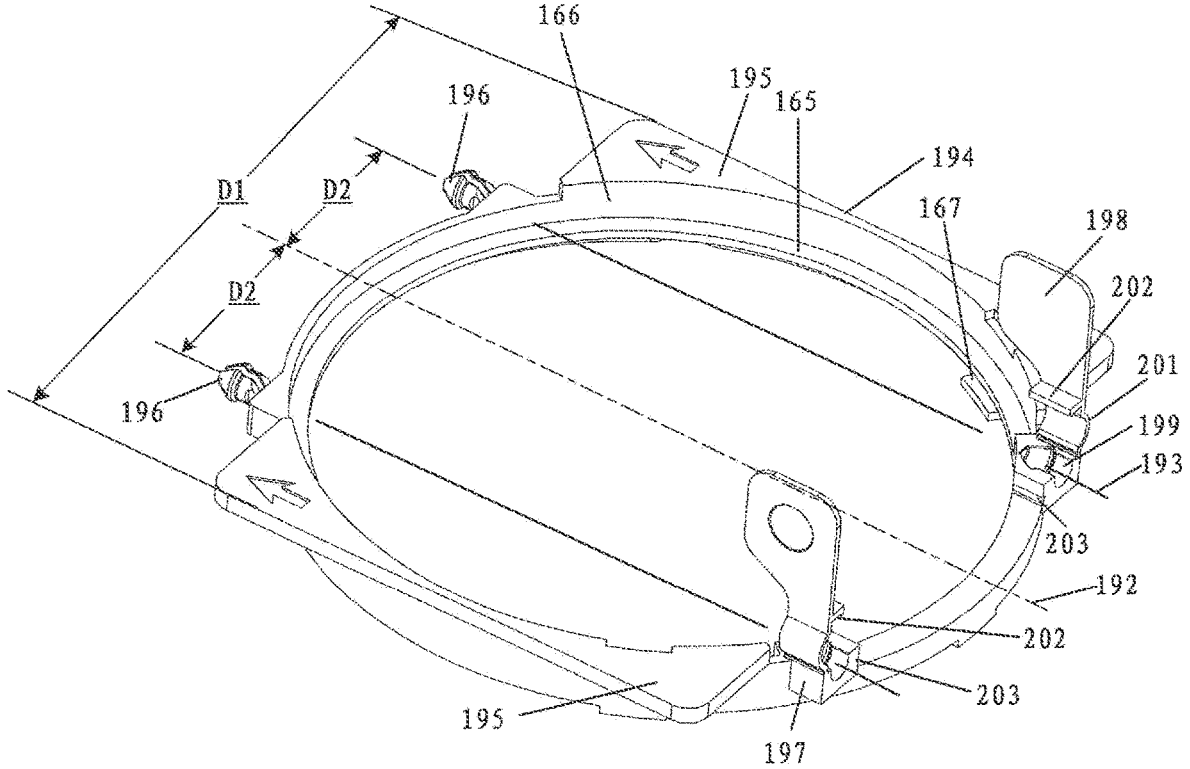
FIG. 34B is a top perspective view of the spring cap shown in FIG. 34A.
Figure 34C:
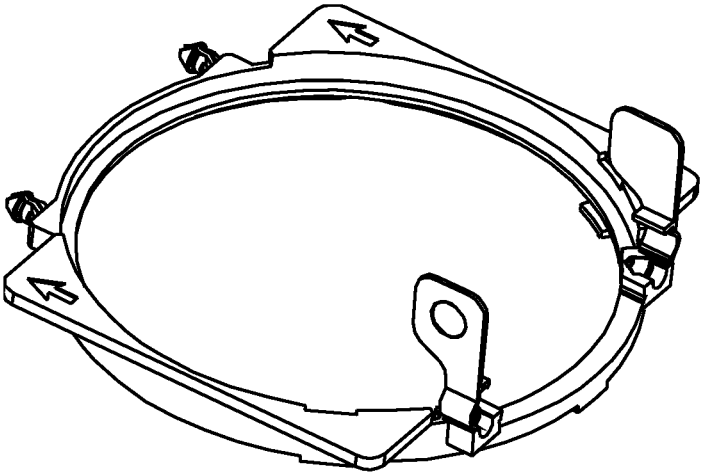
FIG. 34C is a perspective view of the spring cap shown in FIG. 32A.
Figure 34D:
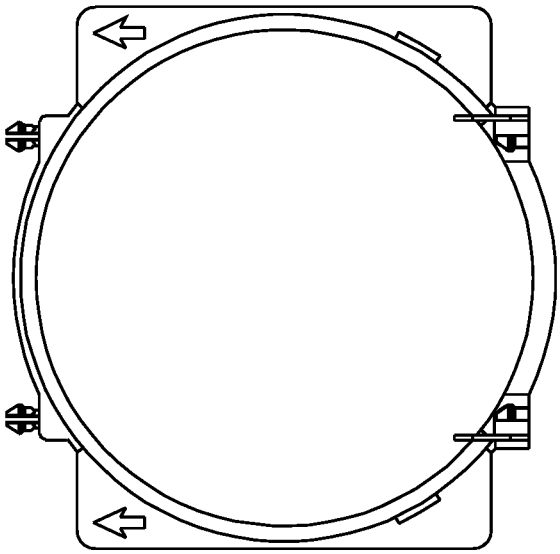
FIG. 34D is a bottom view of the spring cap shown in FIG. 34C.
Figure 34E:
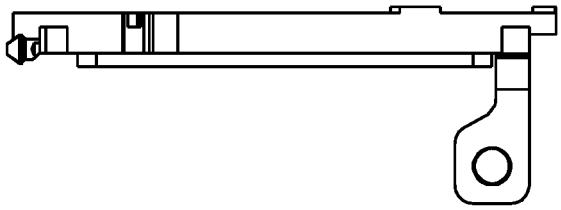
FIG. 34E is a front view of the spring cap shown in FIG. 34C.
Figure 34F:
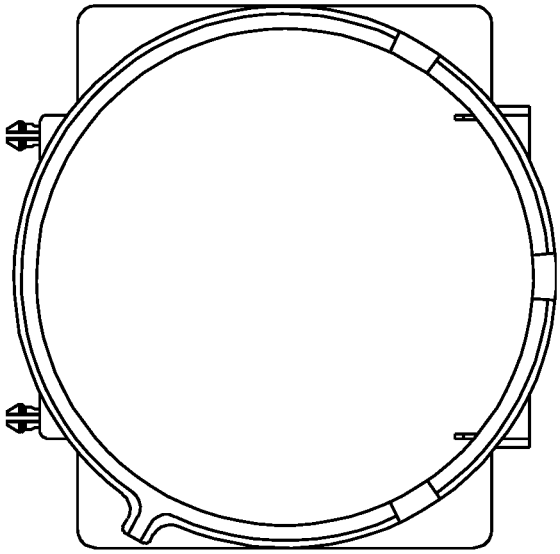
FIG. 34F is a top view of the spring cap shown in FIG. 34C.
Figure 34G:
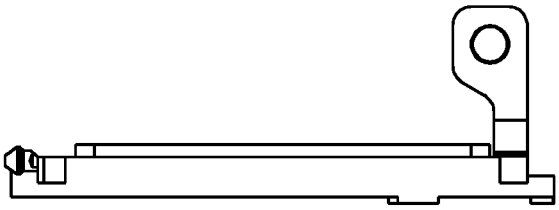
FIG. 34G is a back view of the spring cap shown in FIG. 34C.
Figure 34H:
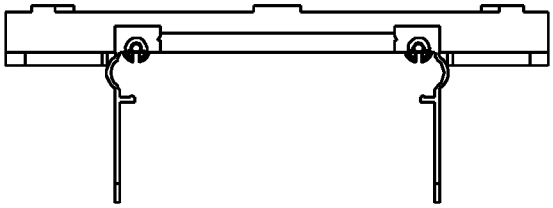
FIG. 34H is a left view of the spring cap shown in FIG. 34C.
Figure 34I:
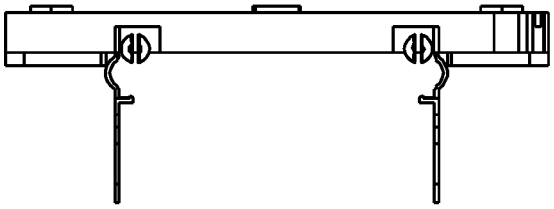
FIG. 34I is a right view of the spring cap shown in FIG. 34C.

Referring now to FIG. 34B, another spring cap 194 may be the same as spring cap 184A but with corner tabs 190 at the top of the spring cap instead of at the bottom, and with the corner tabs 190 provided as part of side frames 195 on opposite sides of the spring cap 194. In addition, the spring cap 194 has modified split pins 196 and pin holes 199 extending through bosses 197. A flex tab 198 is pivotally attached to each boss 197. The flex tab has a collar 201 adapted to close around the split pin 196 of an adjoining spring cap 194. A latch hook 202 on the bottom surface of the flex tab 198 engages with a lip 203 on the boss 197 when the flex tab 198 is pivoted downward into a closed position.

As shown in FIGS. 34A and 34B, a spring core 132 is formed by installing springs 134 into spring caps 194. The spring caps 194 are then attached to each other by inserting the split pins 196 of a first spring cap 194 into the pin holes 199 of a second adjoining spring cap 194, with the flex tabs 198 in the up or open position as shown in FIGS. 34A and 34B. The flex tabs 198 are then pivoted into the down or closed position. The latch hook 202 snaps into or onto the lip holding the flex tab 198 into the down position. The collar 201 prevents the split pin 196 from withdrawing out of the pin hole 199. Consequently, the spring caps 194 cannot be inadvertently separated when the mattress is in use. To disassemble the mattress 130, the flex tabs 198 are pulled up to the open position. This allows the split pins to move out of the pin holes 199, allowing the spring caps 194 to be separated. The flex tabs 198 may be attached to the bosses 197 via a so-called living hinge, if the spring caps 194 are molded of plastic material. Of course, solid pins may be used in place of split pins.

As shown in FIG. 34B, the split pins 196 are aligned with the pin holes 199, i.e., a single center line on a chord 193 of the circular opening of the spring cap passes centrally through both the split pin and the pin hole, on each side of the spring cap. In addition, the chord 193 is located by a dimension D2 from the centerline 192 of the spring cap, with D2 equal to one quarter of the width D1 of the spring cap. As a result, when assembled into a spring core 132 as shown in FIGS. 33A, 34A and 35A, each row of spring assemblies 145 is offset from adjoining rows by one half of the width of a spring cap.

Figure 35A:
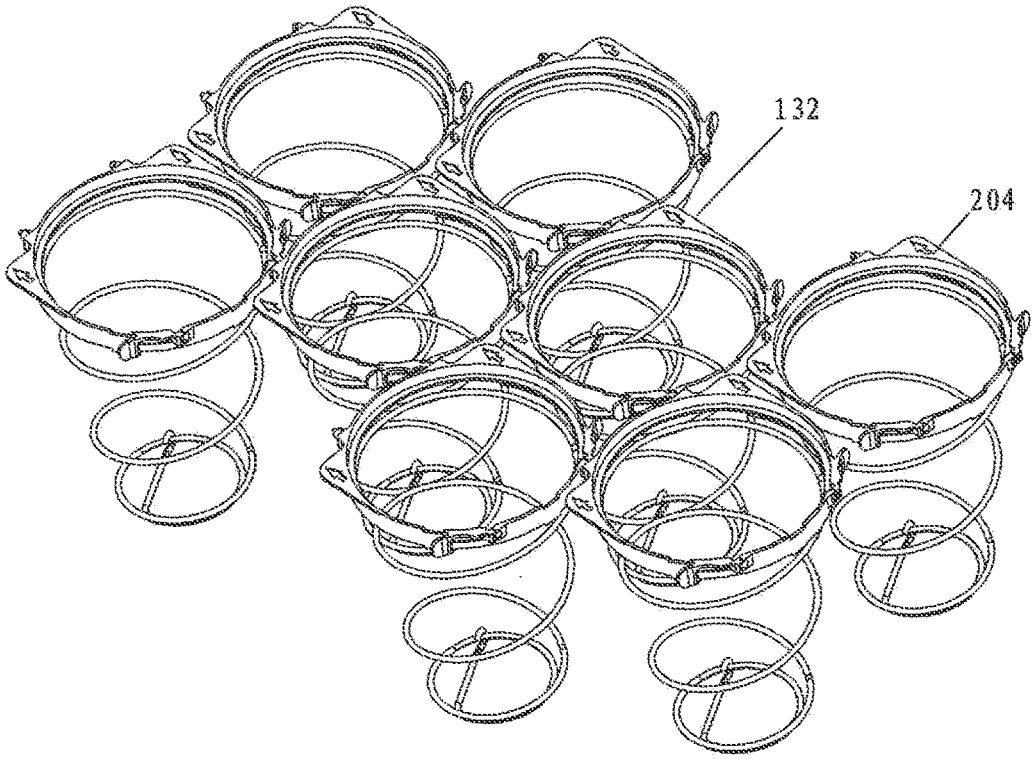
FIG. 35A is an inverted perspective view of part of another spring core.
Figure 35B:
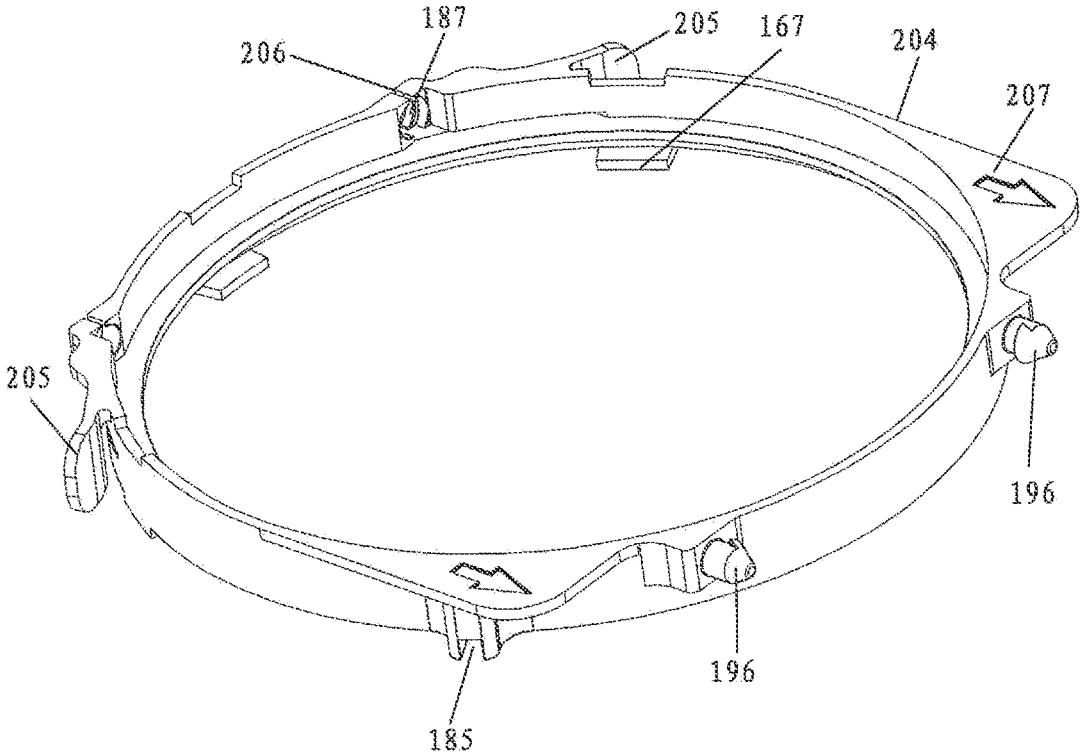
FIG. 35B is a top and rear perspective view of the spring cap shown in FIG. 35A.
Figure 35C:
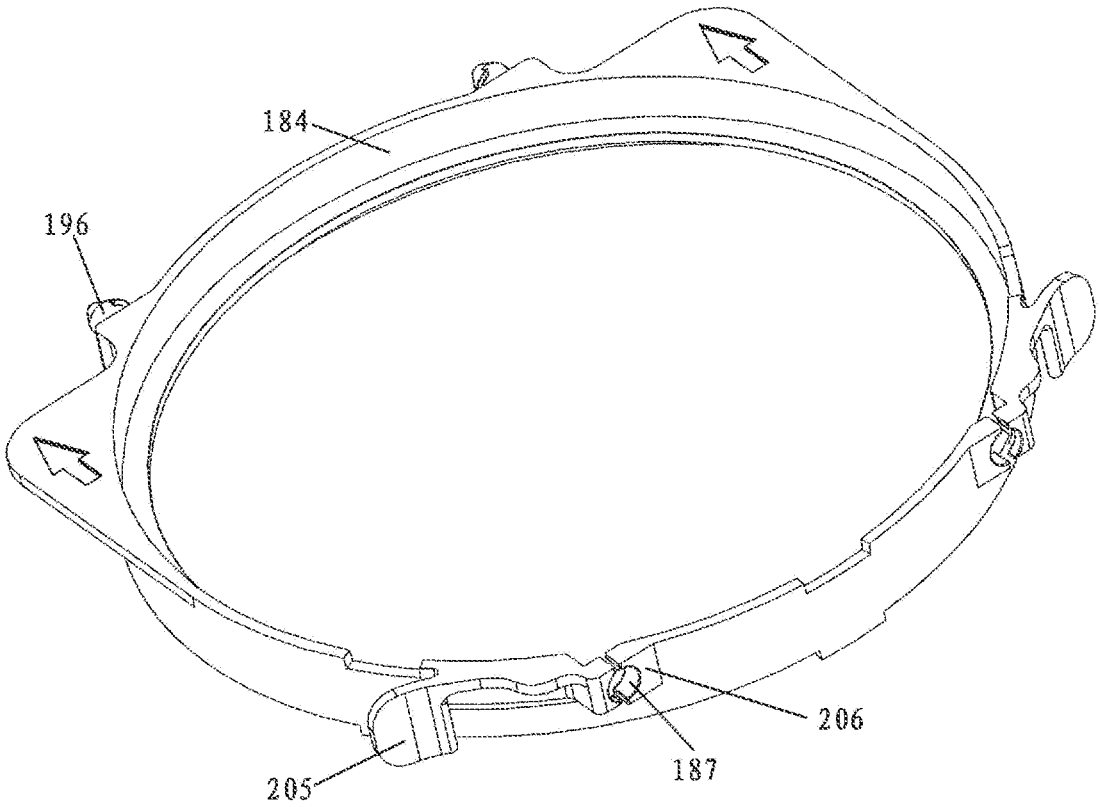
Figure 35D:
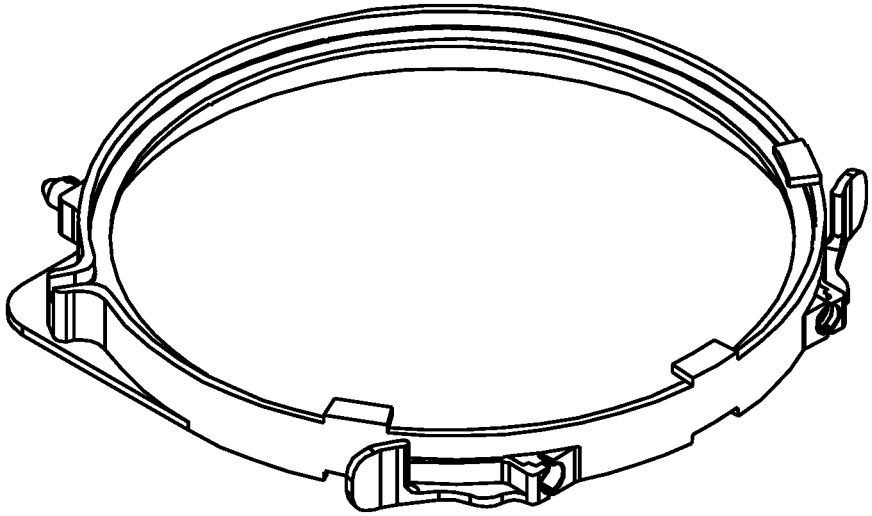
FIG. 35D is a perspective view of the spring cap shown in FIG. 35A.
Figure 35E:
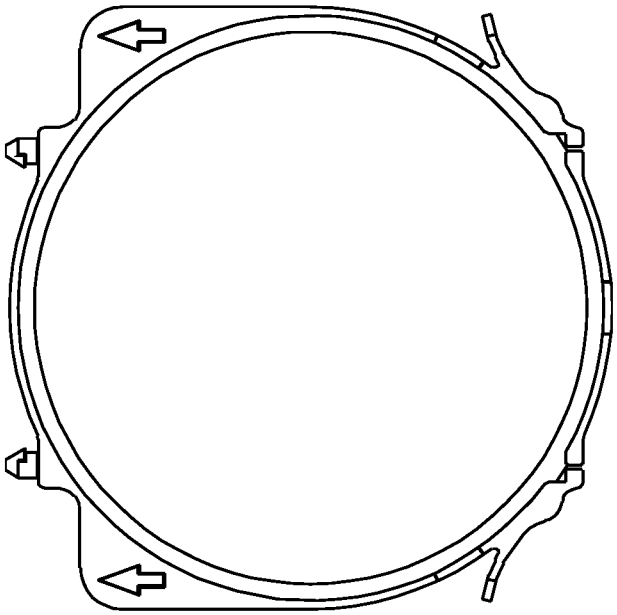
FIG. 35E is a bottom view of the spring cap shown in FIG. 35D.
Figure 35F:
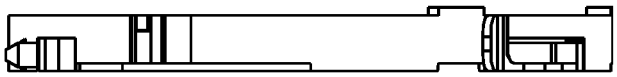
FIG. 35F is a front view of the spring cap shown in FIG. 35D.
Figure 35G:
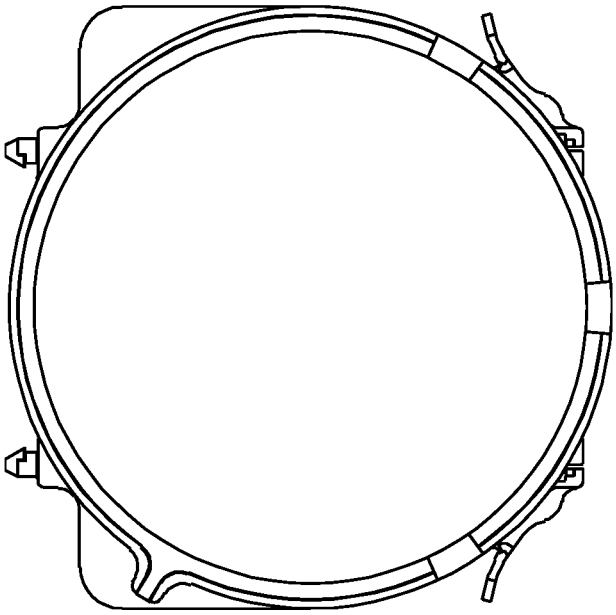
FIG. 35G is a top view of the spring cap shown in FIG. 35D.
Figure 35H:
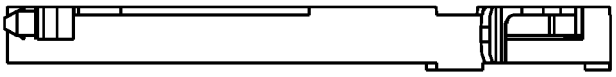
FIG. 35H is a back view of the spring cap shown in FIG. 35D.
Figure 35I:
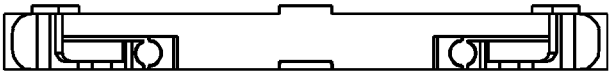
FIG. 35I is a left view of the spring cap shown in FIG. 35D.
Figure 35J:
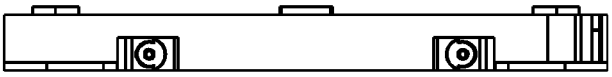
FIG. 35J is a right view of the spring cap shown in FIG. 35D.

Referring now to FIGS. 35A, 35B and 35C, another spring cap 204 may be the same as the spring cap 184B shown in FIG. 33B but further includes a corner frame 207 adjacent to each boss having a split pin 196. On the opposite side, the pin holes 187 pass through split bosses 206. A release tab 205 is attached to the outer half of each split boss 206. A spring core 132 using the spring caps 204 may be assembled by installing springs 134 into the spring caps 204, and then attaching the spring caps 204 to each other by inserting the split pins 196 through the pin holes 187. The split bosses 206 may resiliently momentarily move apart to allow the head of the split pin 196 to pass through the pin hole 187. The split pin 196 then cannot be withdrawn without pressing the release tab 205. This prevents inadvertent separation of the spring caps 204 when the mattress is in use. In some cases it may be easier to assemble the spring caps 204 together before installing the springs.

Figure 36A:
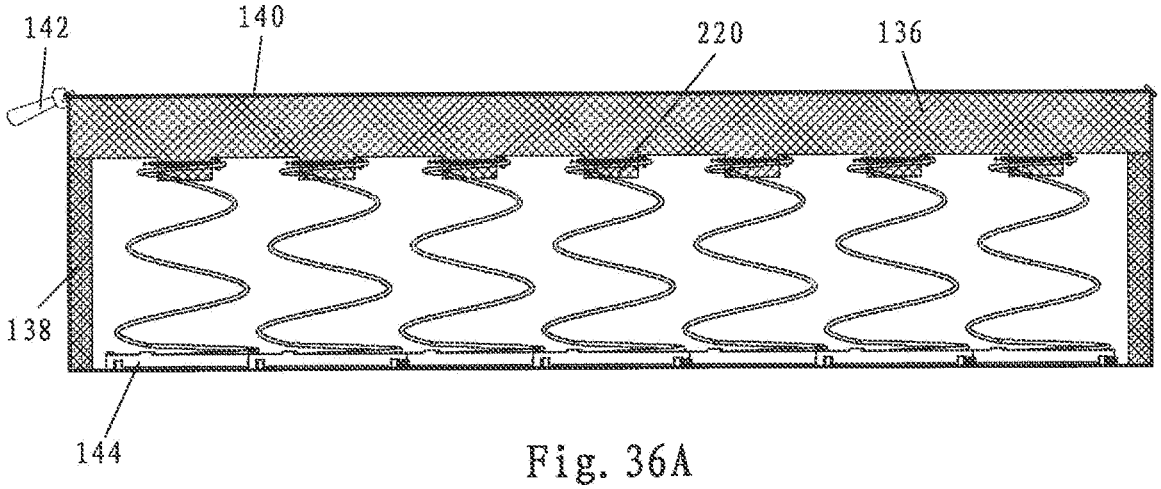
FIG. 36A is a section view of another mattress.
Figure 36B:
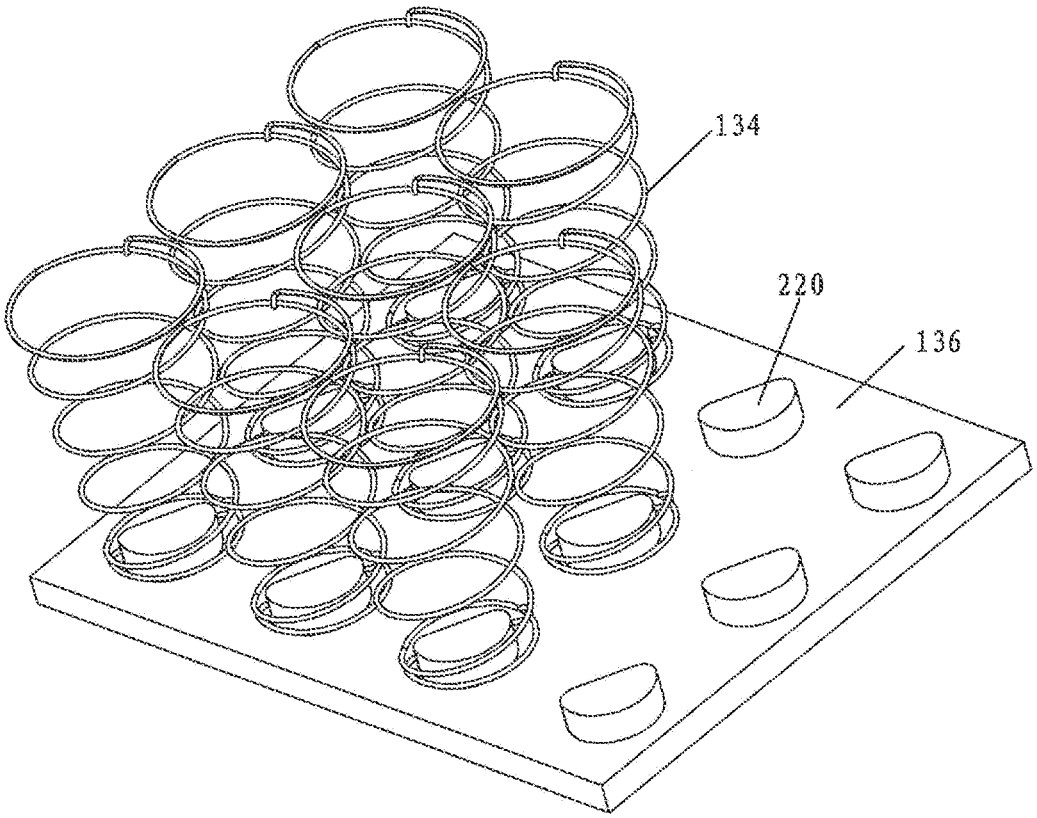
FIG. 36B is bottom perspective view of part of the spring core and top pad of the mattress shown in FIG. 36A.
Figure 36C:
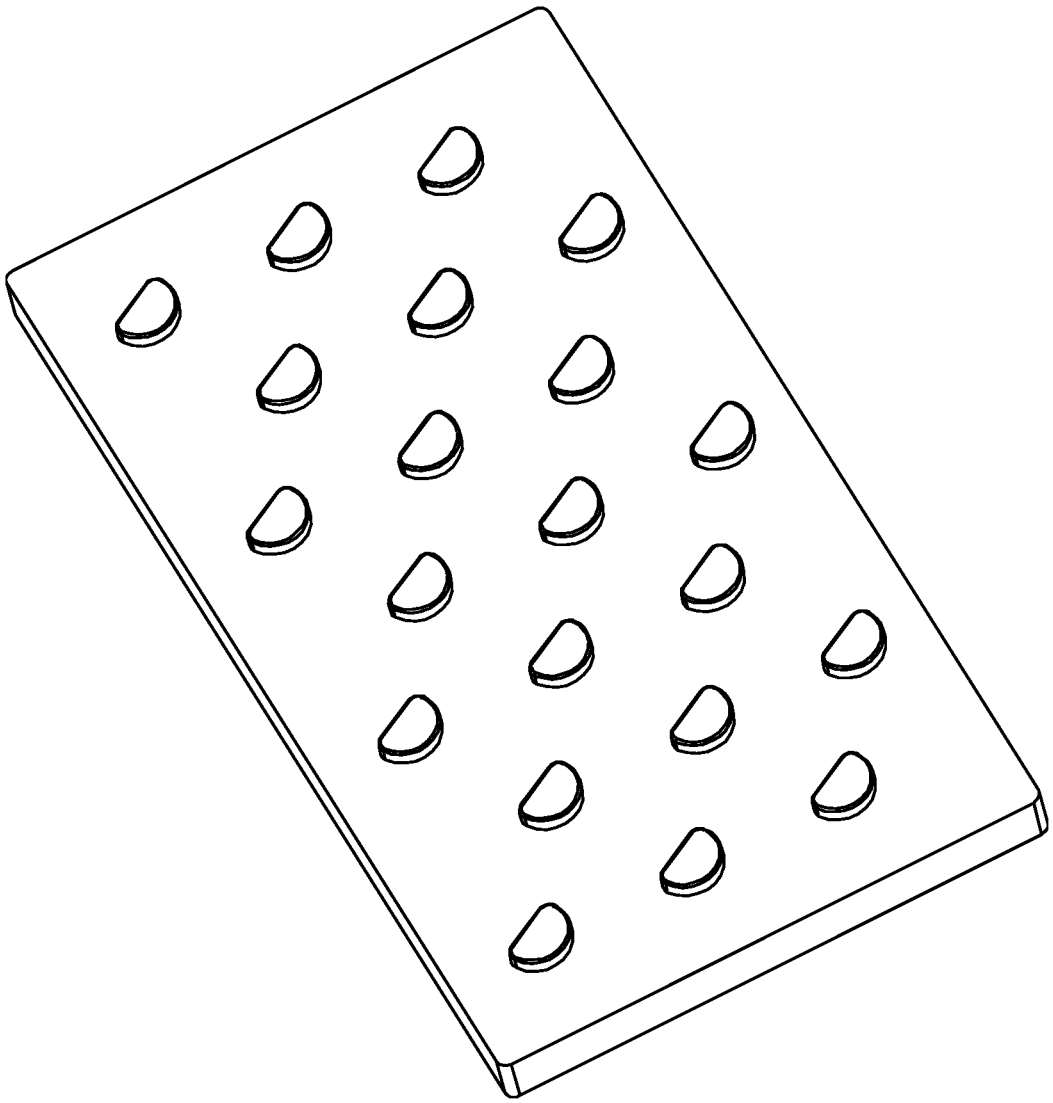
FIG. 36C is a perspective view of the top pad of the mattress shown in FIG. 36A, without the springs.
Figure 36D:
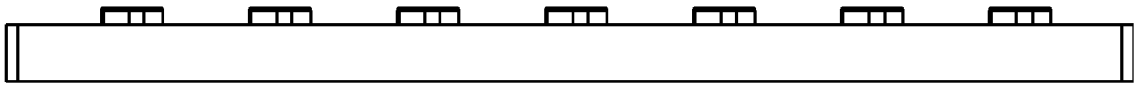
FIG. 36D is a bottom view of the top pad shown in FIG. 36C.
Figure 36E:
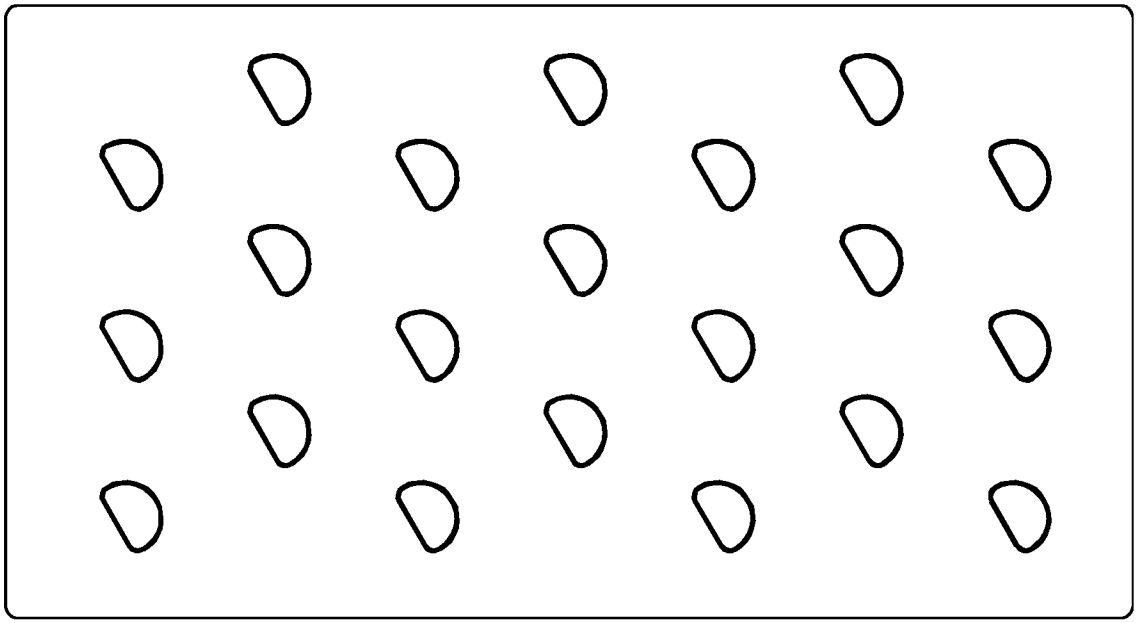
FIG. 36E is a front view of a projection or boss shown in FIG. 36C.
Figure 36F:
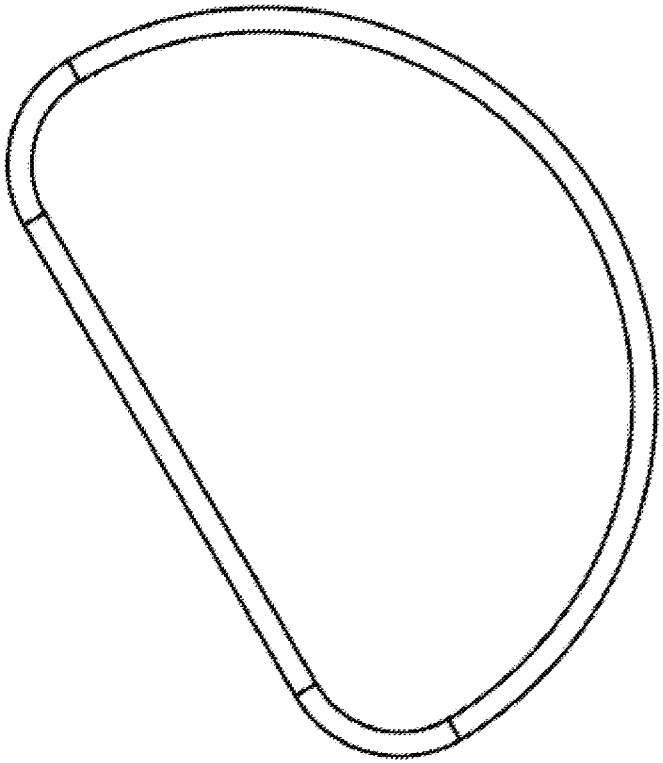
FIG. 36F is an enlarged view of a spring cap shown in FIG. 36E.
Figure 36G:
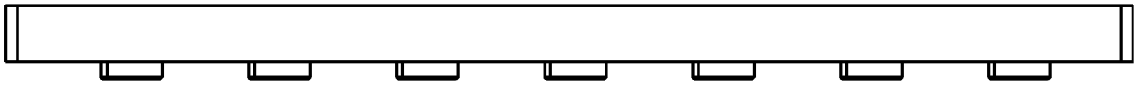
FIG. 36G is a top view of the top pad shown in FIG. 36C.
Figure 36H:
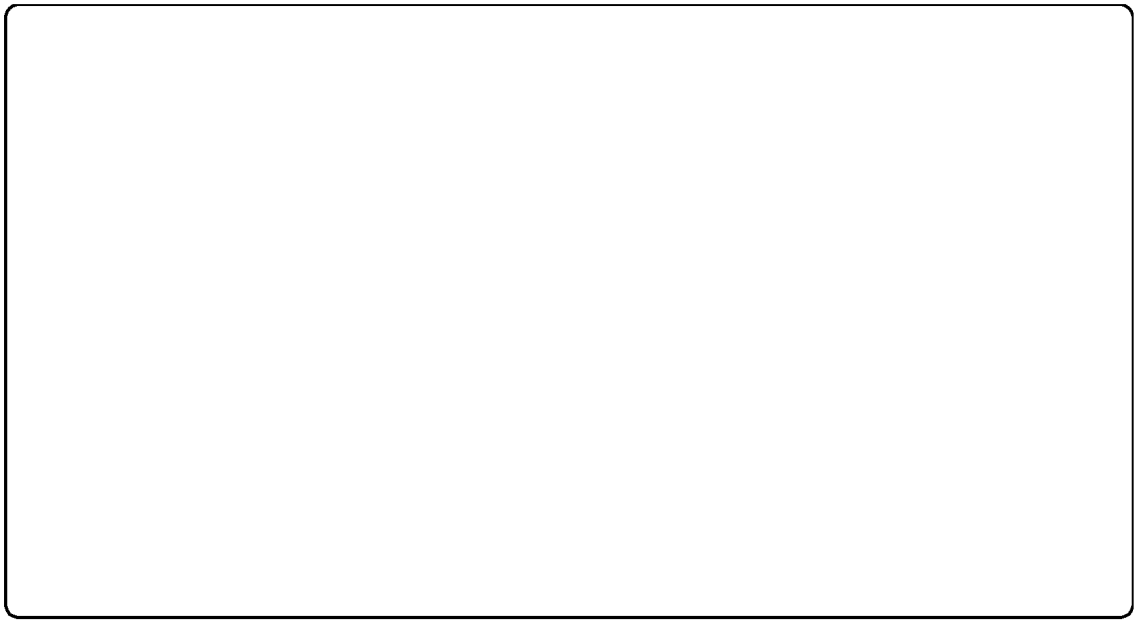
FIG. 36H is a back view of the top pad shown in FIG. 36C.
Figure 36I:
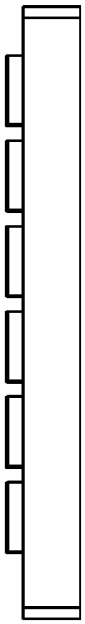
FIG. 36I is a left view of the top pad shown in FIG. 36C.
Figure 36J:
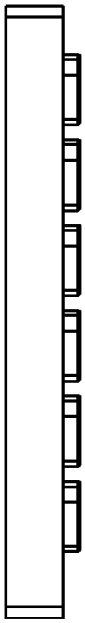
FIG. 36J is a right view of the top pad shown in FIG. 36C.

As shown in FIGS. 36A and 36B, a projection or boss 220 may be provided on the bottom surface of the top pad 136, with the top coil of each spring around a boss. This can help keep the springs 134 aligned and vertical when the mattress 130 is in use. The boss 220 may be D-shaped to better secure the top end of the spring 134, with top segment 159 of the spring 134 against the straight side of the boss.

Figure 37A:
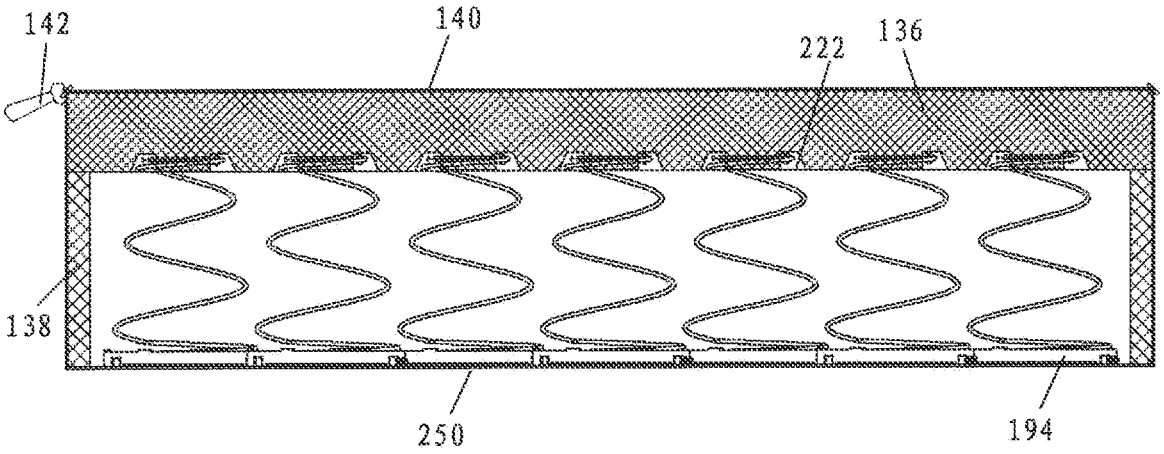
FIG. 37A is a section view of another mattress.
Figure 37B:
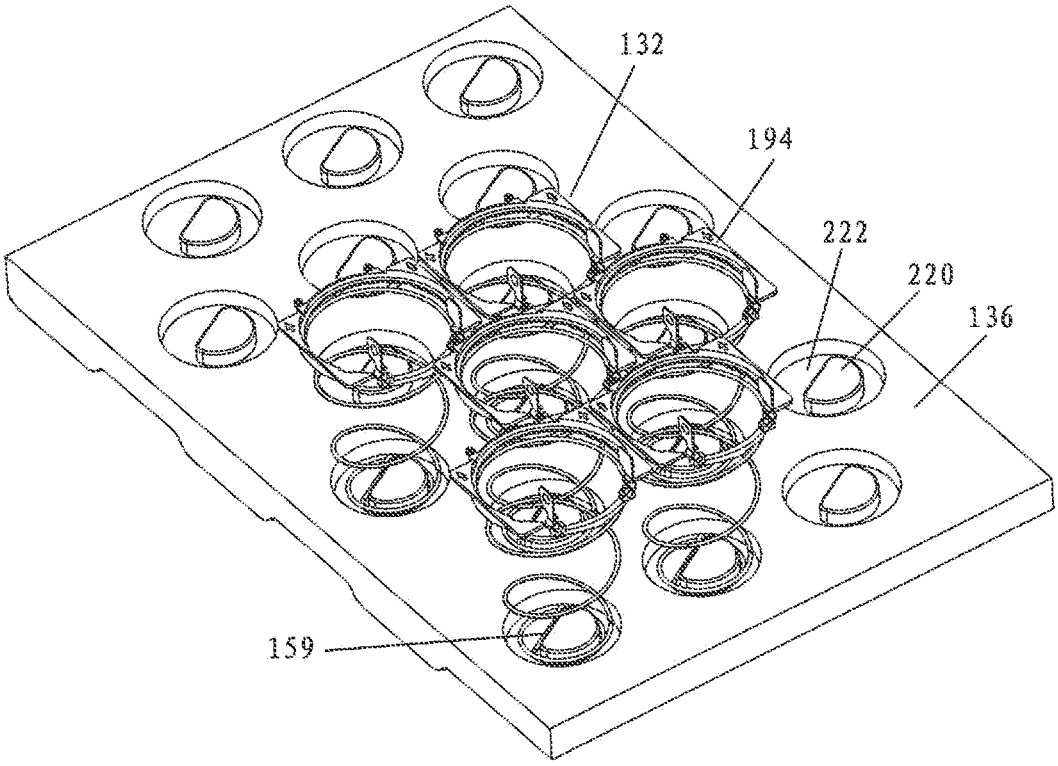
FIG. 37B is bottom perspective view of part of the spring core and top pad of the mattress shown in FIG. 37A.
Figure 37C:
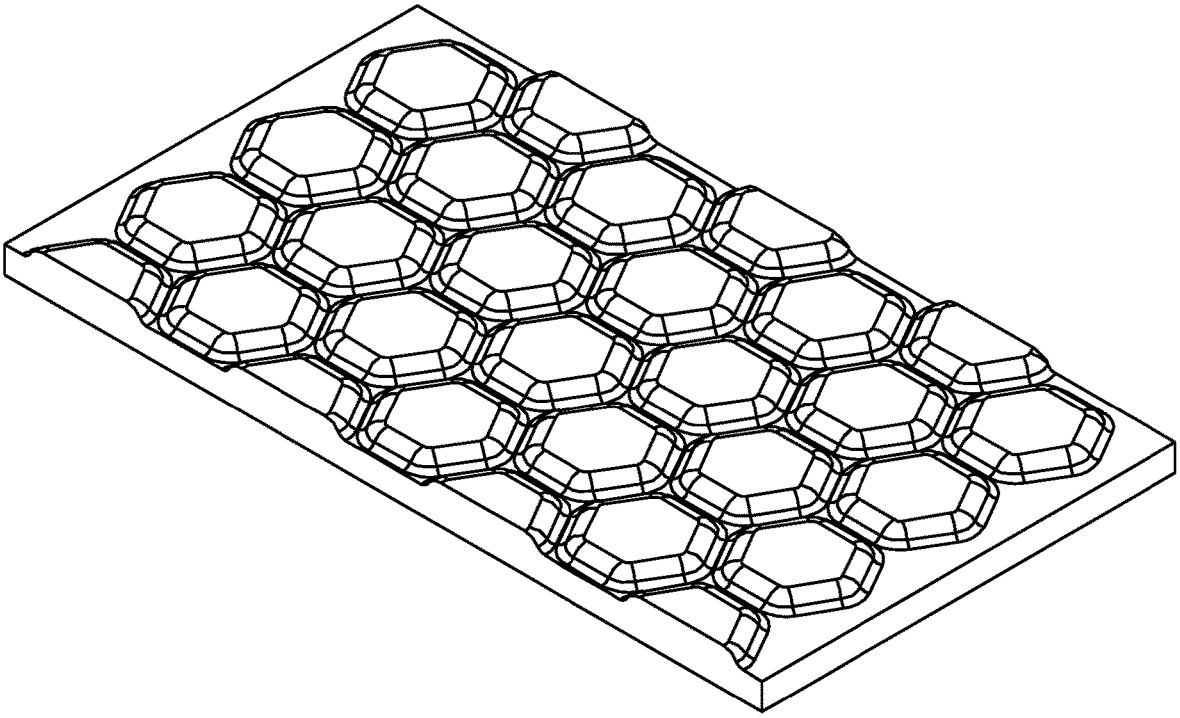
FIG. 37C is a perspective view of the top pad of the mattress shown in FIG. 37A, without the springs.
Figure 37D:
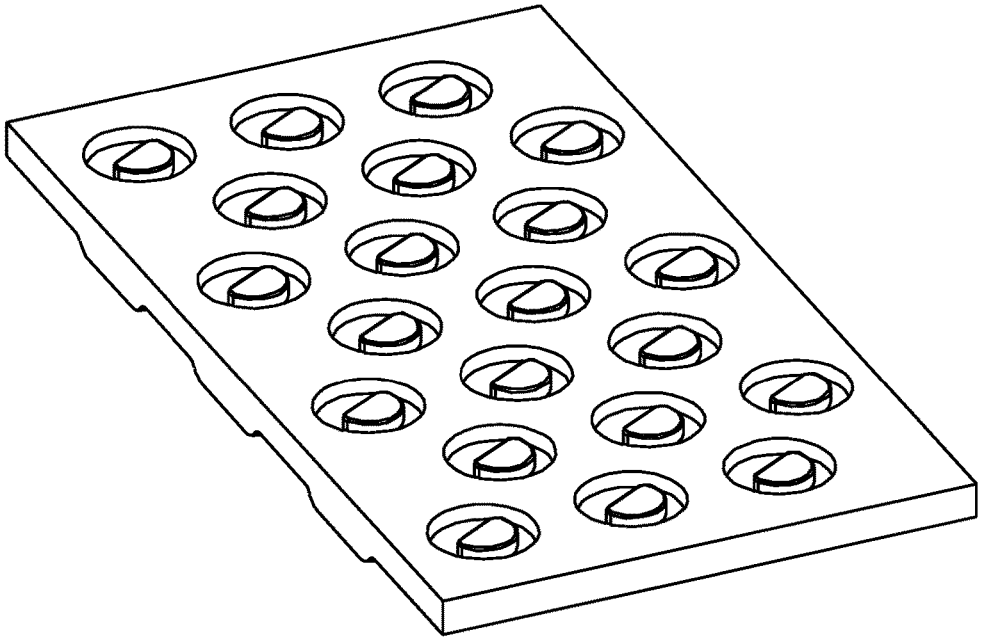
FIG. 37D is a perspective view of the top pad of the mattress shown in FIG. 37A, without the springs.
Figure 37E:
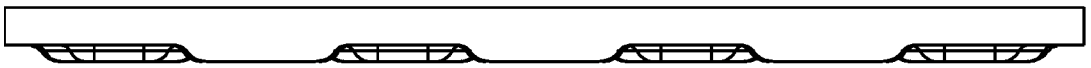
FIG. 37E is a bottom view of the top pad shown in FIG. 37C.
Figure 37F:
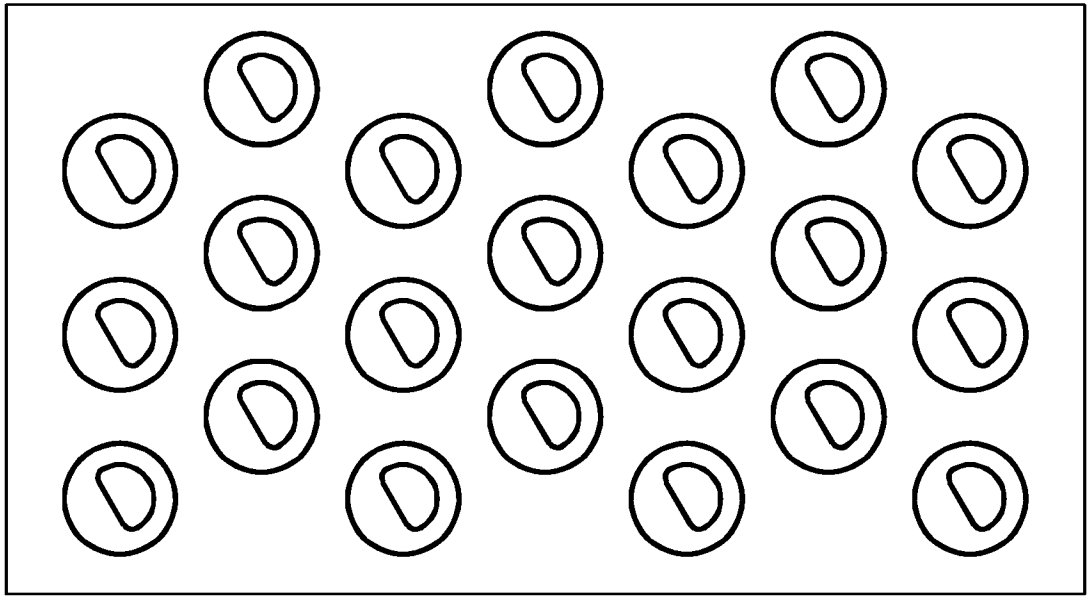
FIG. 37F is a front view of the top pad shown in FIG. 37C.
Figure 37G:
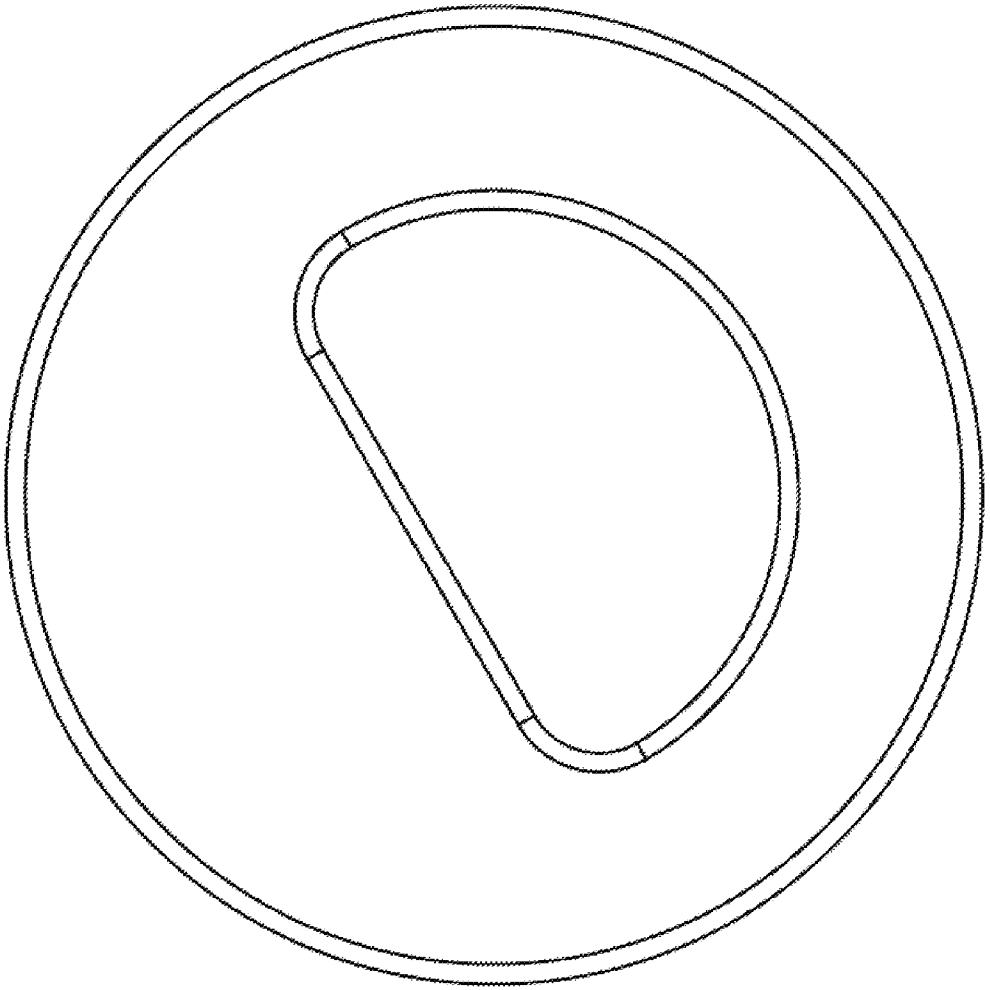
FIG. 37G is an enlarged view of a boss positioned within a recess shown in FIG. 37F.
Figure 37H:
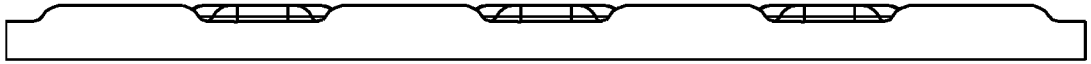
FIG. 37H is a top view of the top pad shown in FIG. 37C.
Figure 37I:
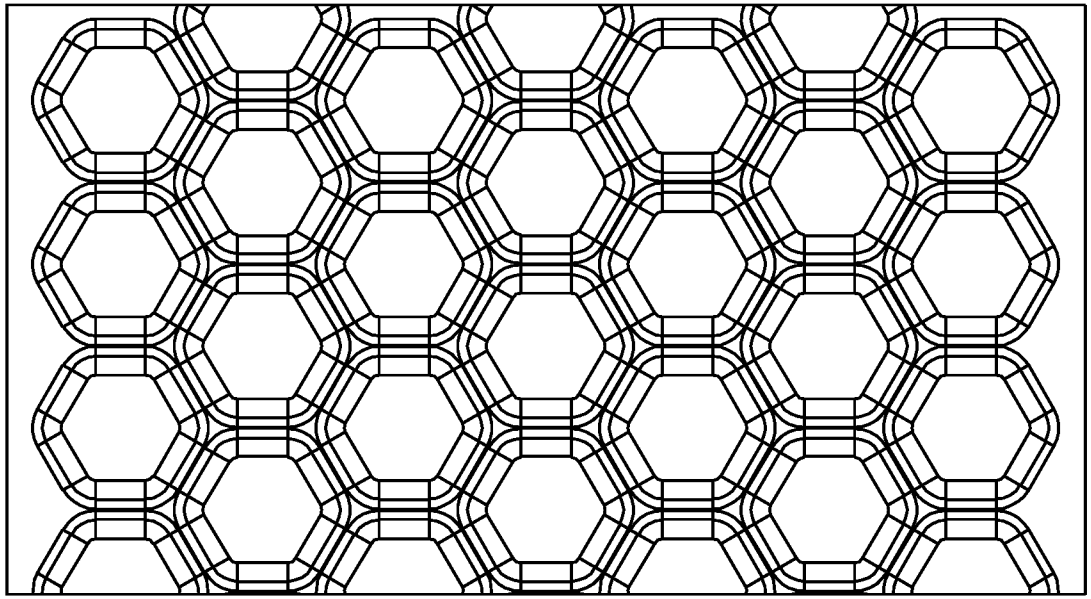
FIG. 37I is a back view of the top pad shown in FIG. 37C.
Figure 37J:
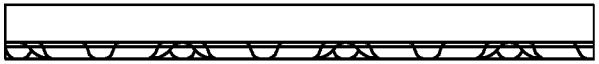
FIG. 37J is a left view of the top pad shown in FIG. 37C.
Figure 37K:
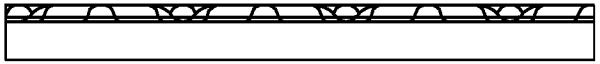
FIG. 37K is a right view of the top pad shown in FIG. 37C.
Figure 38A:
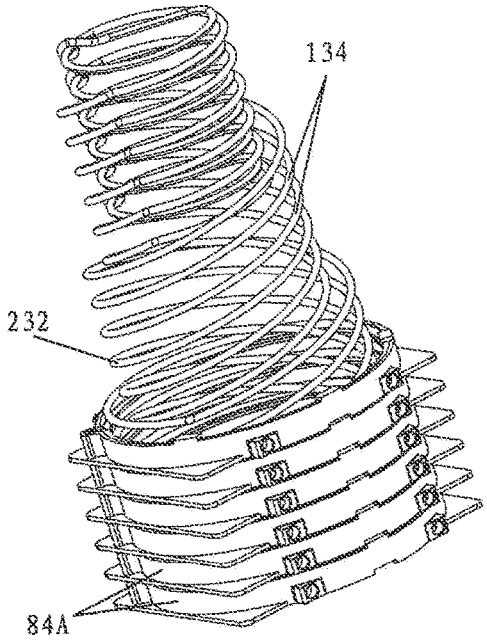
FIG. 38A is a perspective view of the springs and spring caps of the spring core in a stacked column for storage or transport.
Figure 40A:
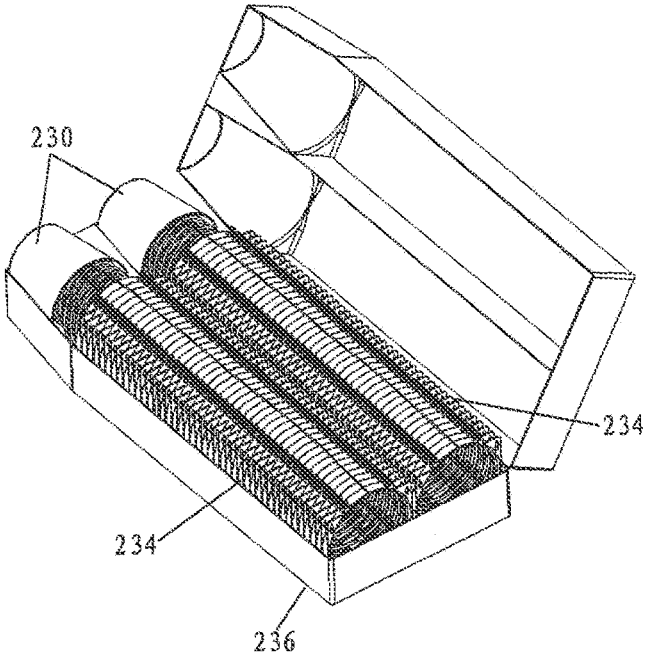
Figure 39A:
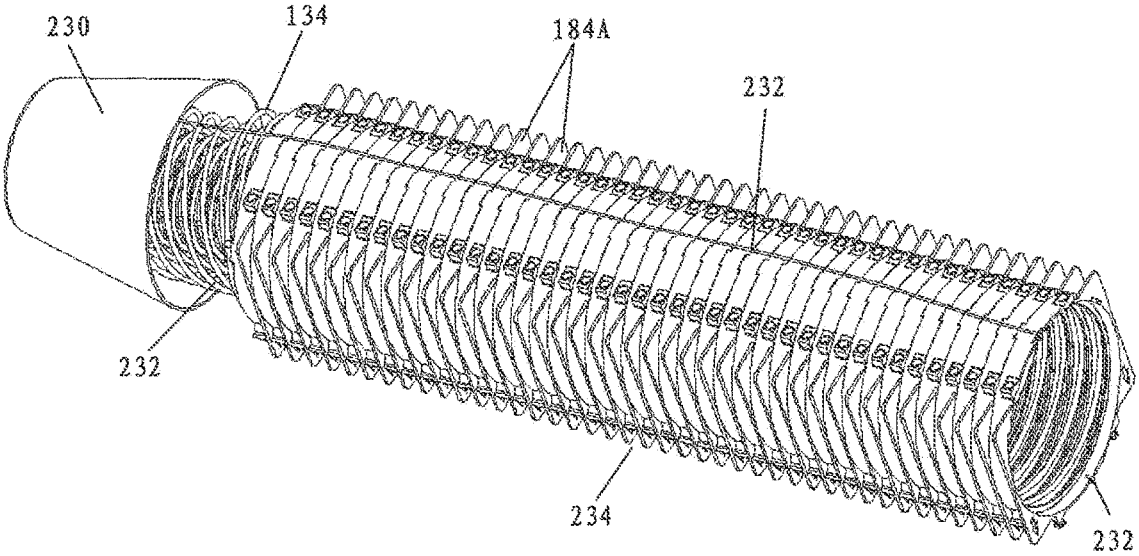
FIG. 39A is a perspective view of the springs and spring caps of a smaller size mattress in a stacked column for storage or transport.
Figure 38B:
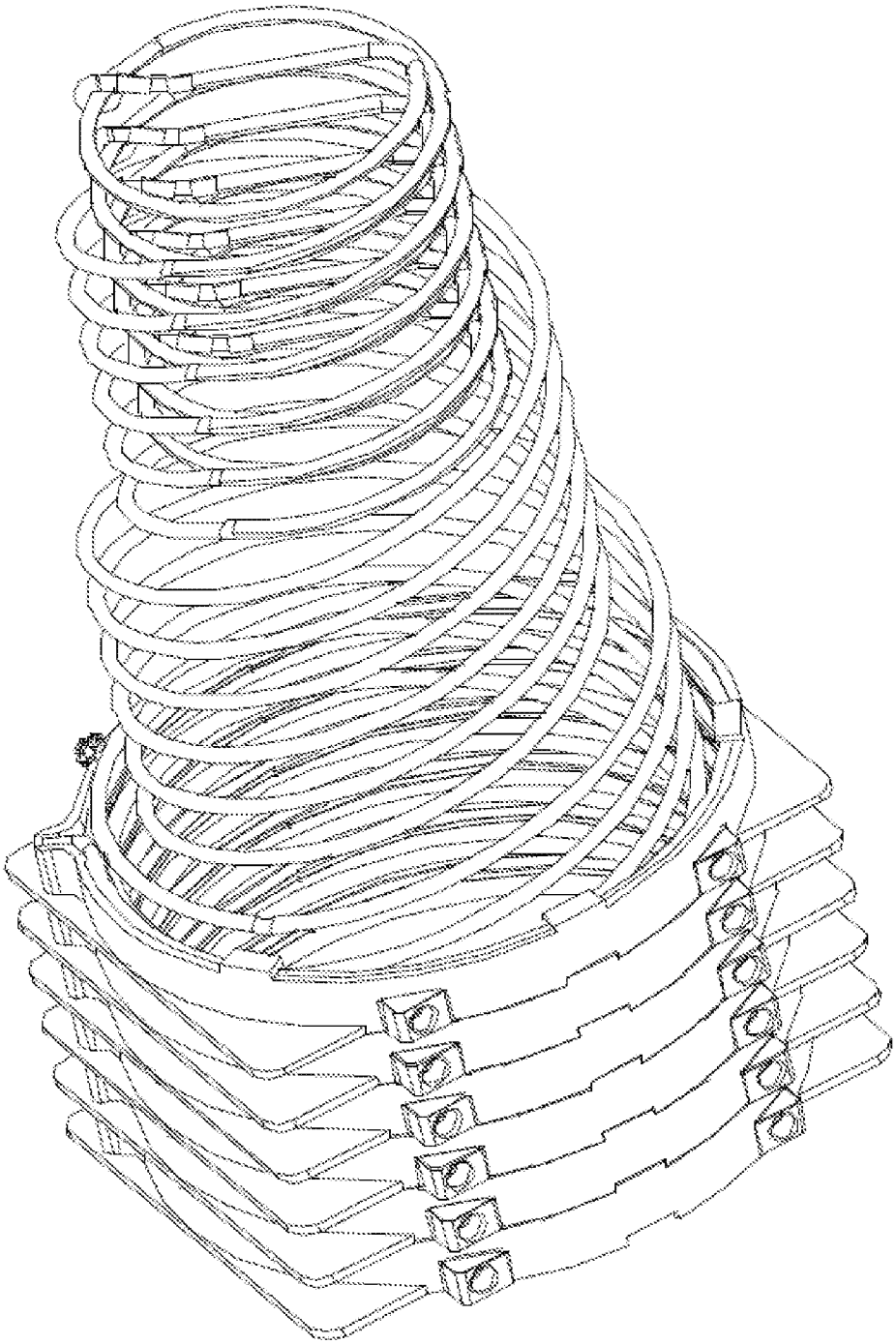
FIG. 38B is a perspective view of the springs and spring caps of the spring core in a stacked column for storage or transport, as shown in FIG. 38A.
Figure 38C:
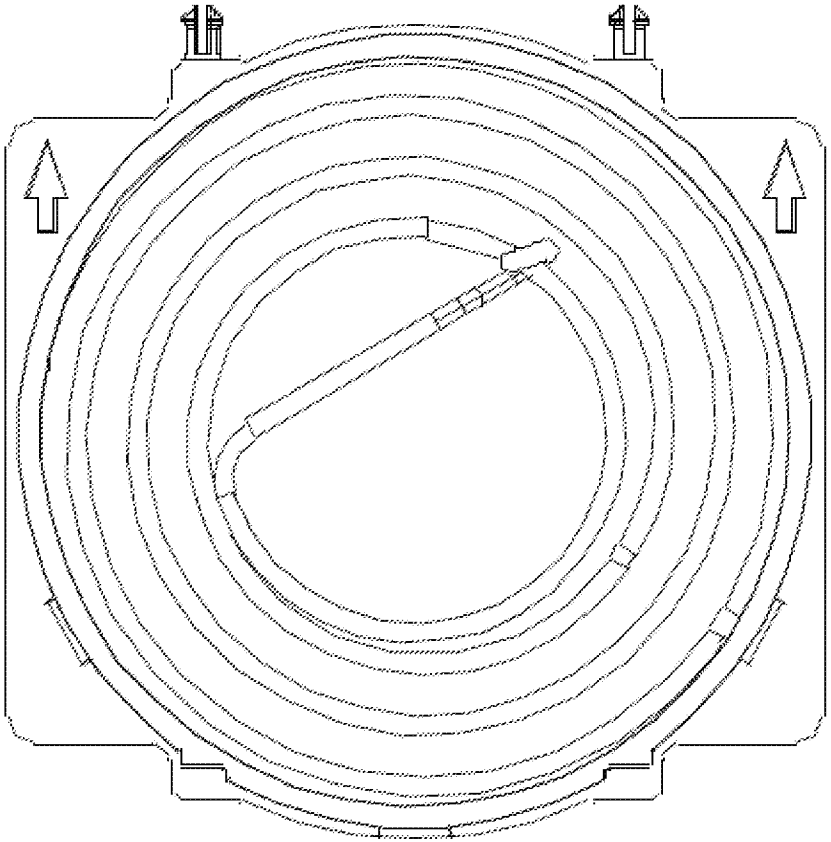
FIG. 38C is a bottom view of the stacked column of springs and spring caps shown in FIG. 38B.
Figure 38D:
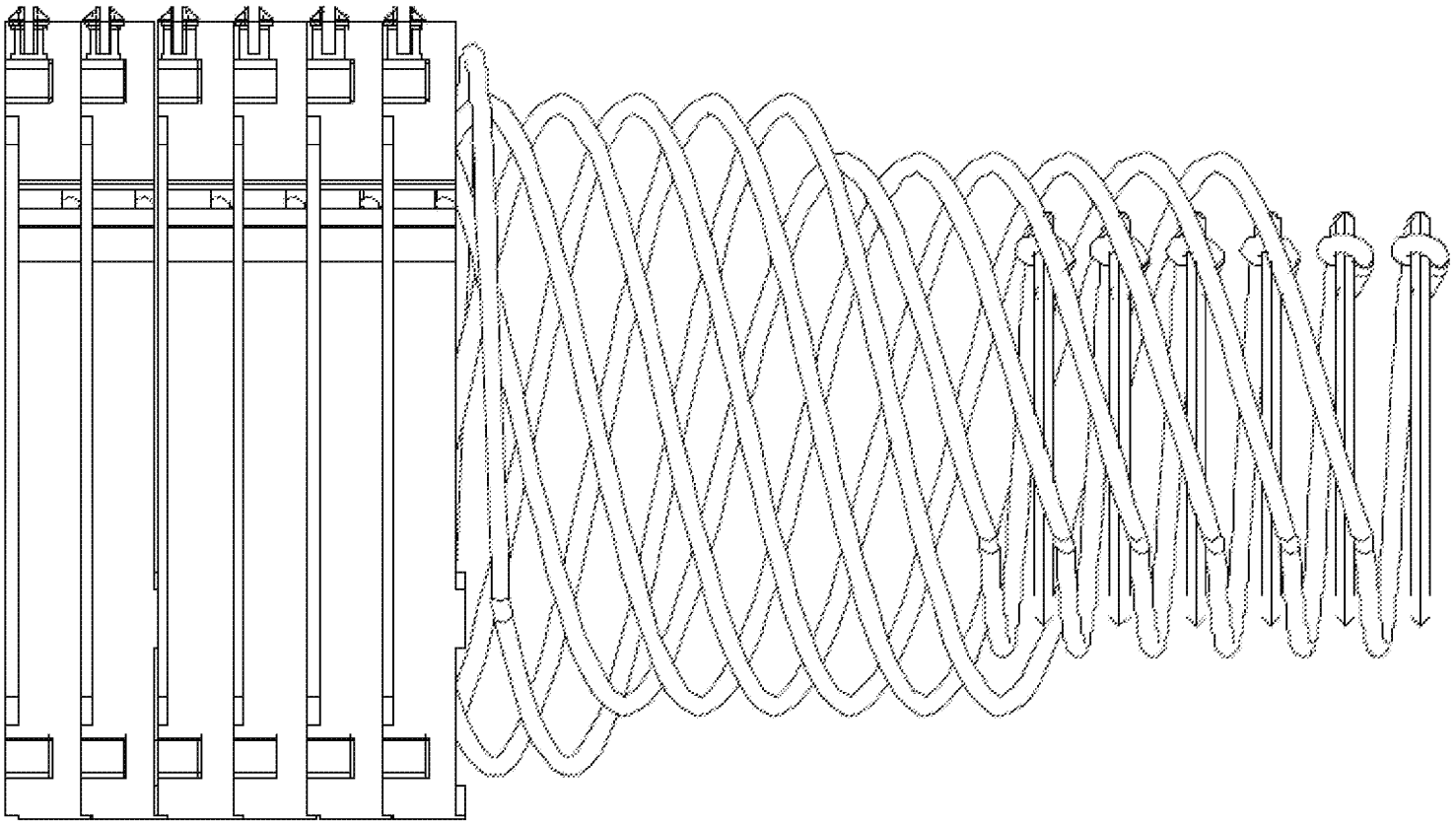
FIG. 38D is a front view of the stacked column of springs and spring caps shown in FIG. 38B.
Figure 38E:
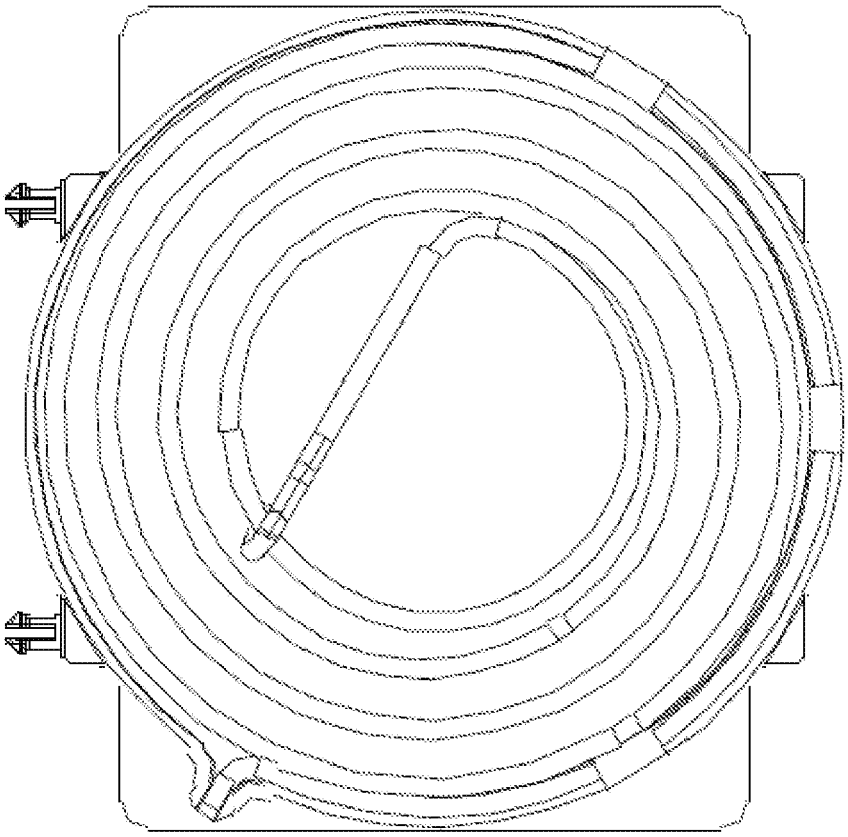
FIG. 38E is a top view of the stacked column of springs and spring caps shown in FIG. 38B.
Figure 38F:
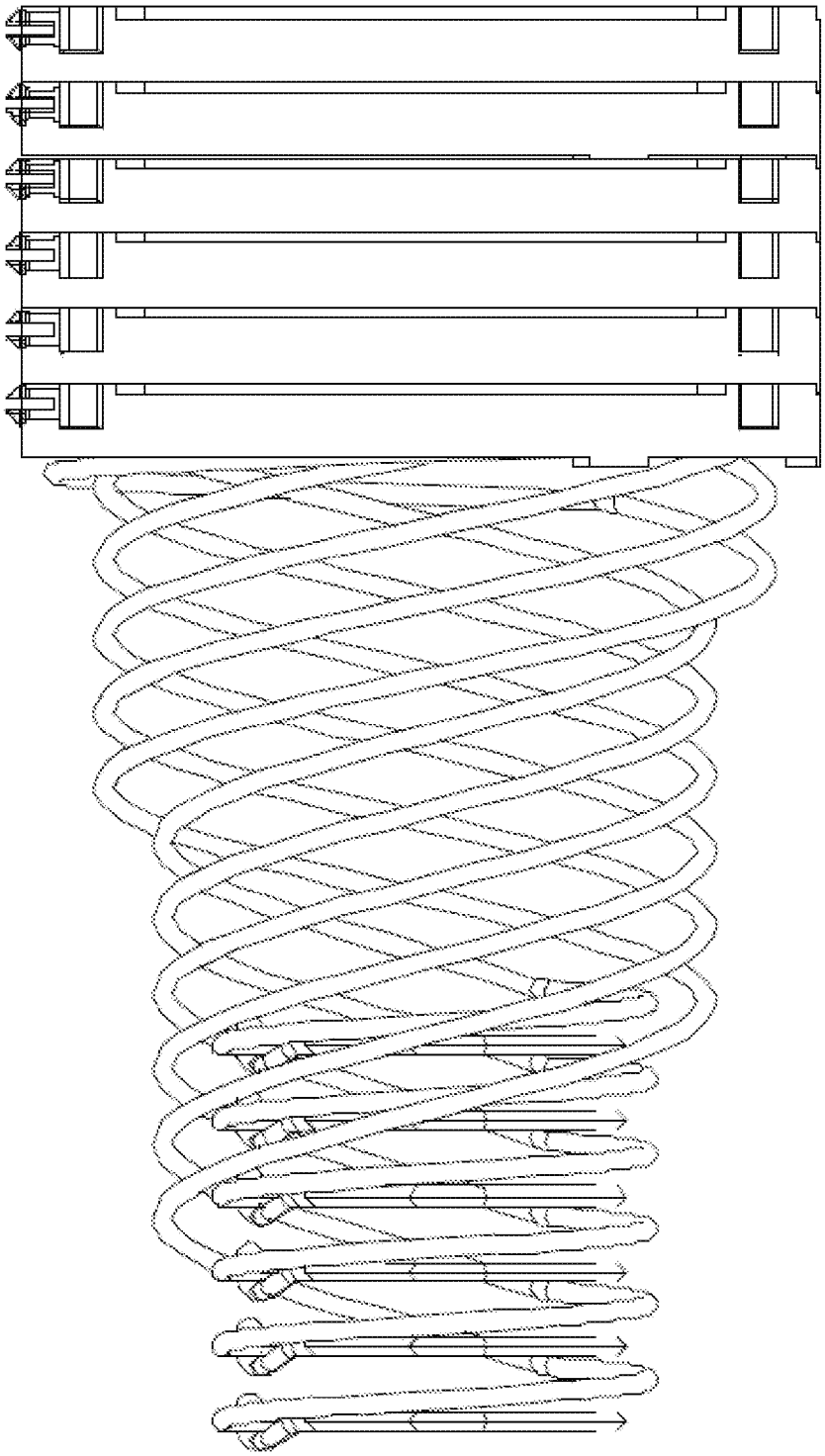
FIG. 38F is a back view of the stacked column of springs and spring caps shown in FIG. 38B.
Figure 38G:
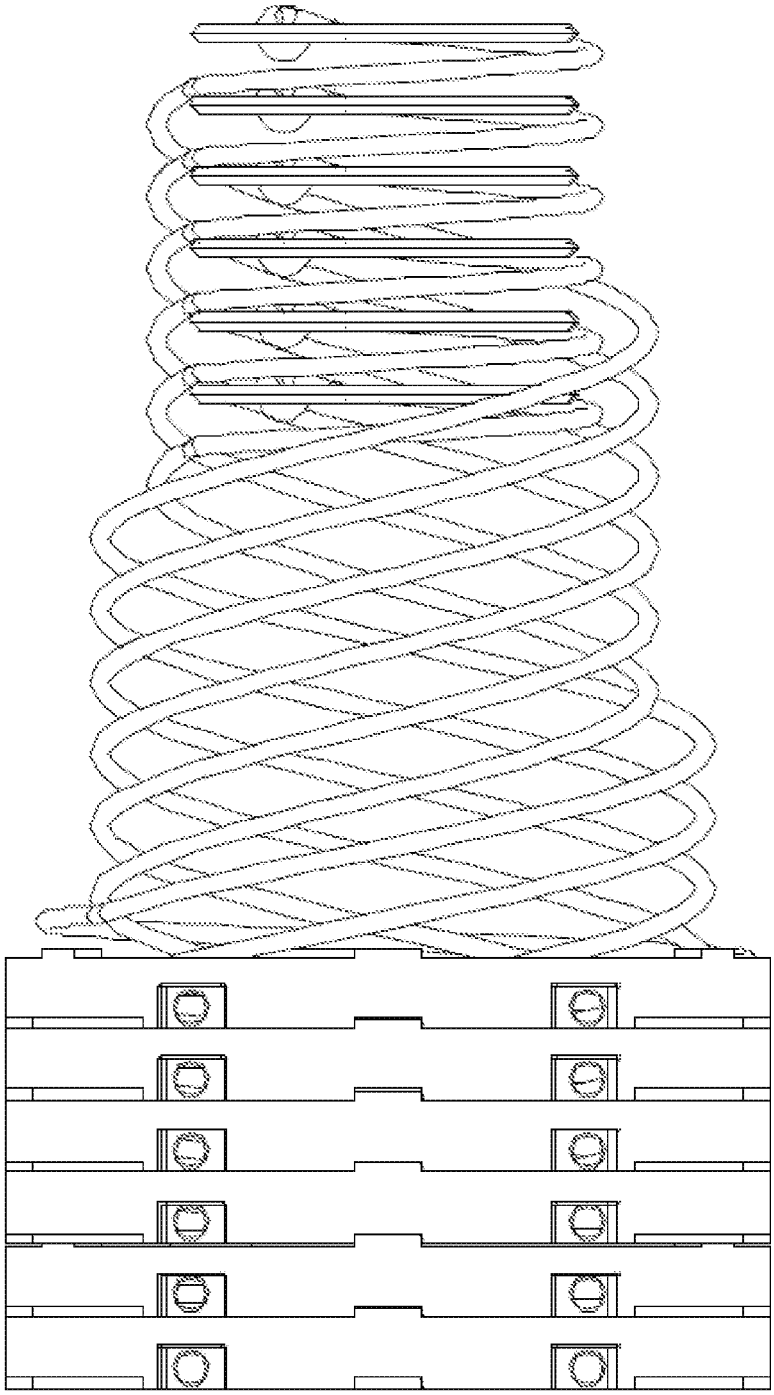
FIG. 38G is a left view of the stacked column of springs and spring caps shown in FIG. 38B.
Figure 38H:
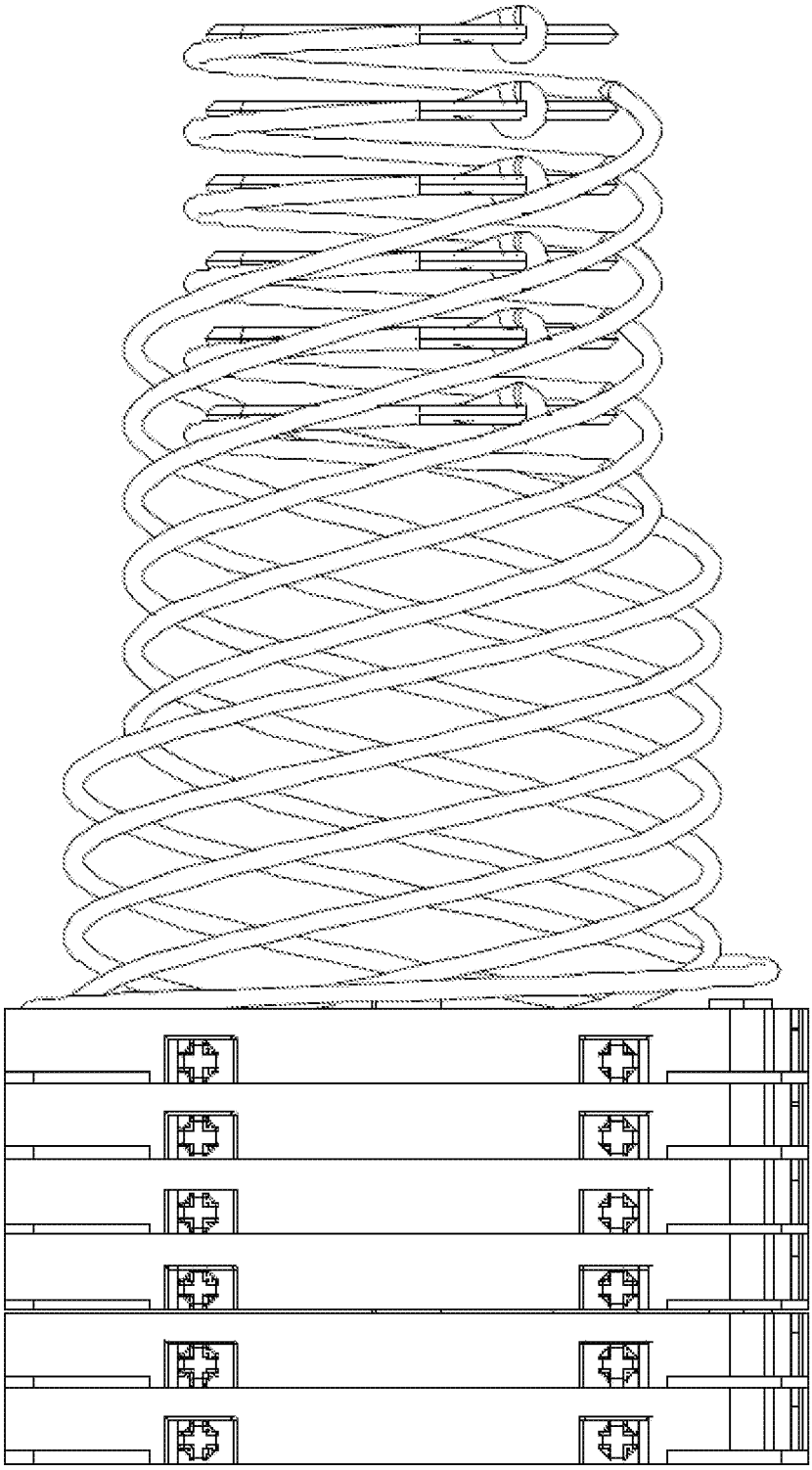
FIG. 38H is a right view of the stacked column of springs and spring caps shown in FIG. 38B.
Figure 39B:
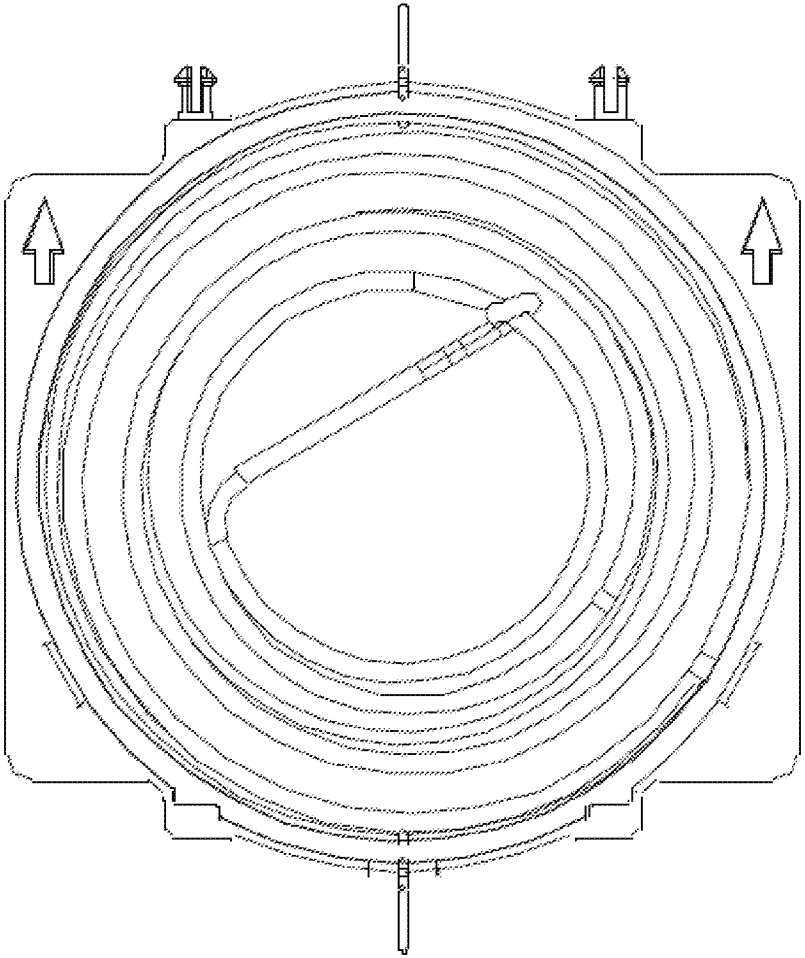
FIG. 39B is a bottom view of the stacked column of springs and spring caps shown in FIG. 39A.
Figure 39C:
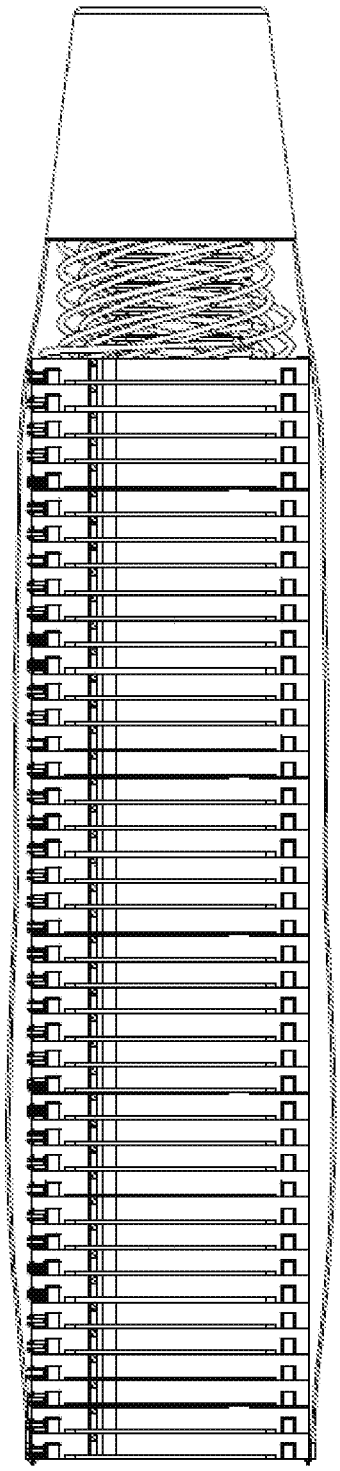
FIG. 39C is a front view of the stacked column of springs and spring caps shown in FIG. 39A.
Figure 39D:
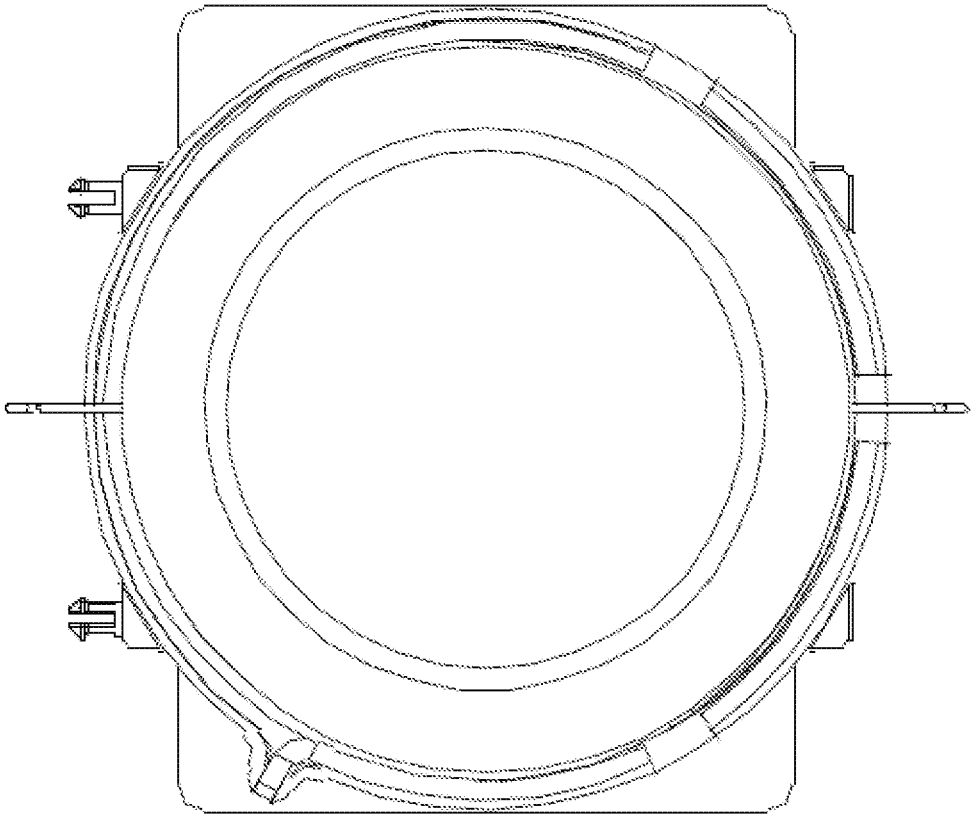
FIG. 39D is a top view of the stacked column of springs and spring caps shown in FIG. 39A.
Figure 39E:
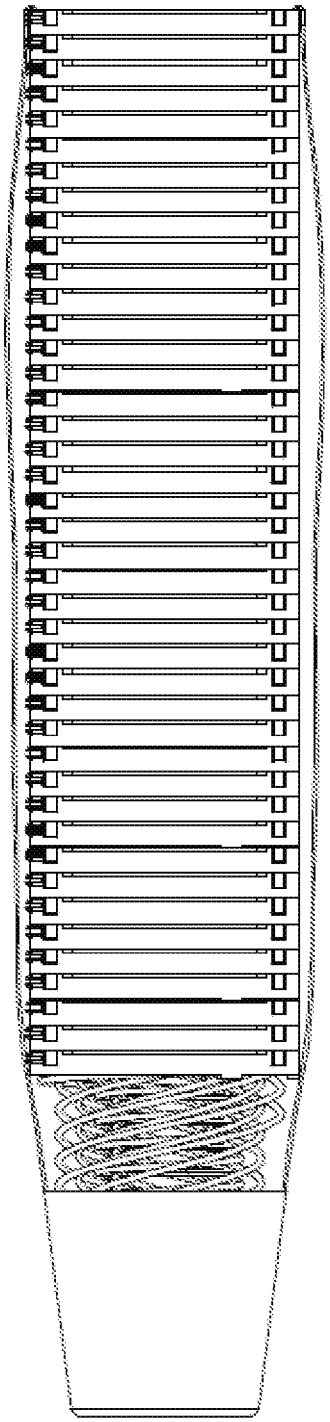
FIG. 39E is a back view of the stacked column of springs and spring caps shown in FIG. 39A.
Figure 39F:
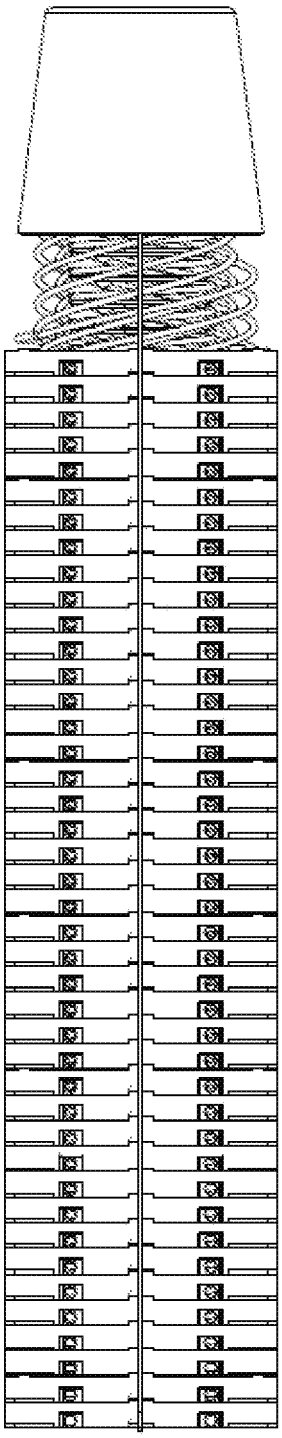
Figure 39G:
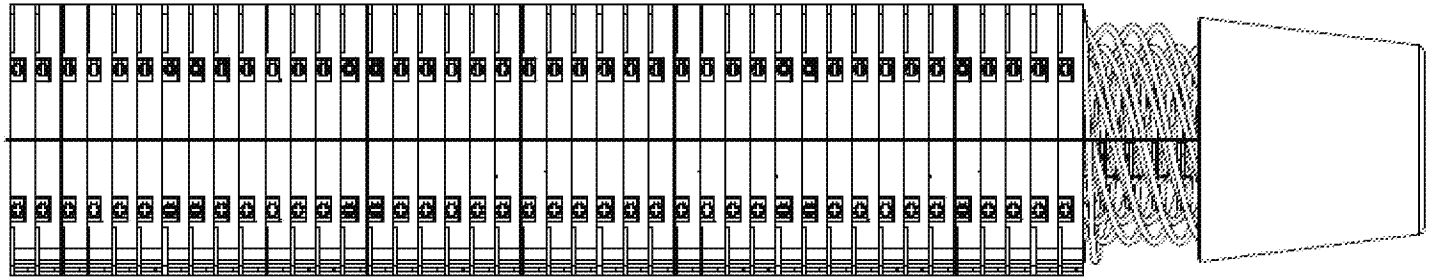
Figure 40B:
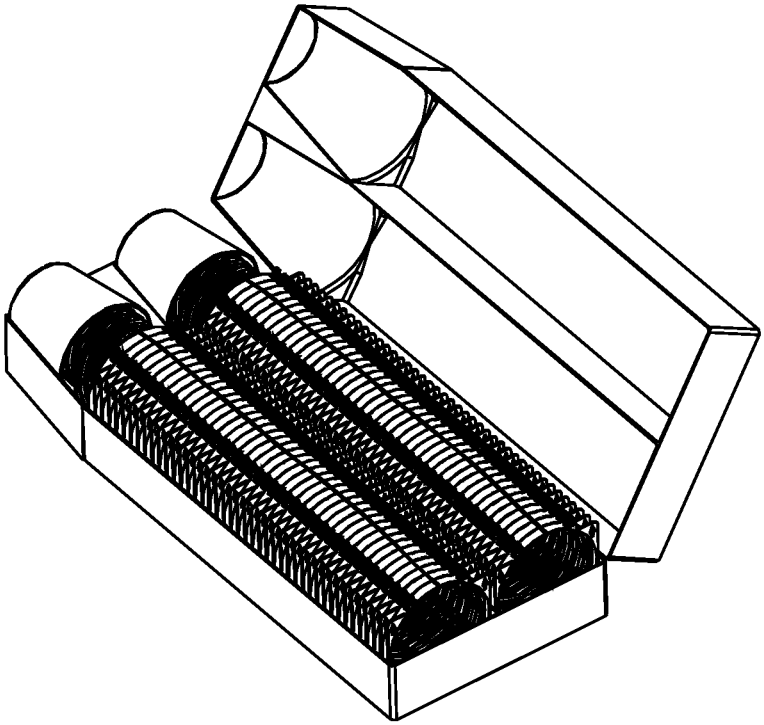
Figure 40C:
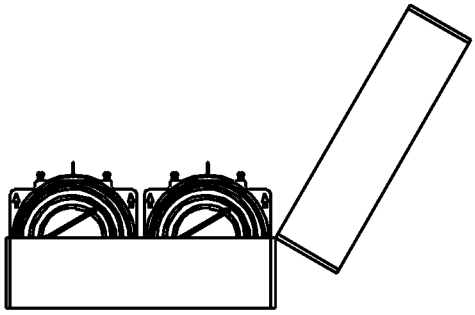
Figure 40D:
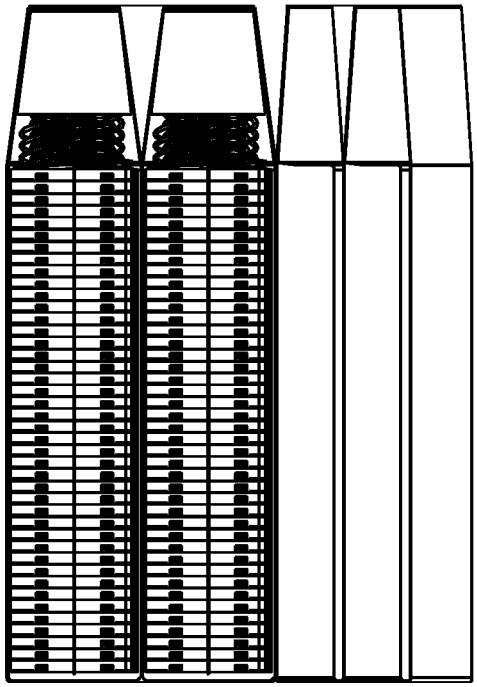
Figure 40E:
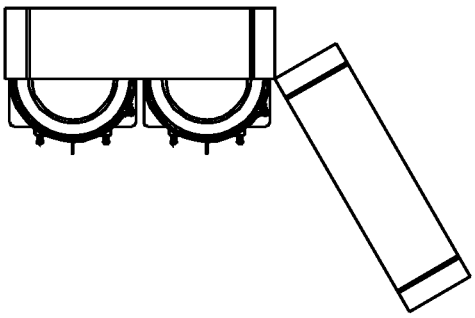
Figure 40F:
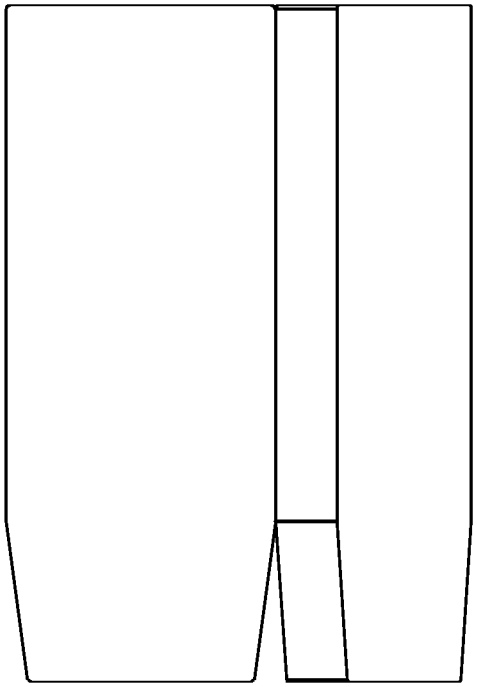
Figure 40G:
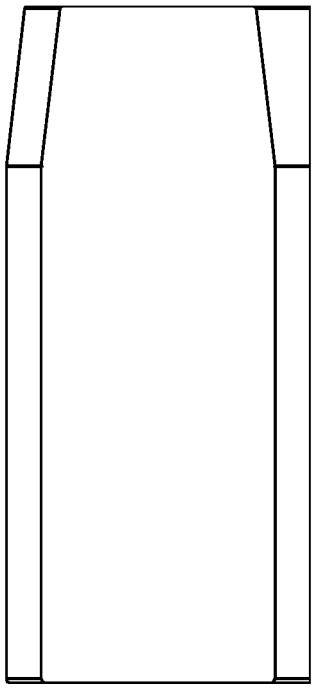
Figure 40H:
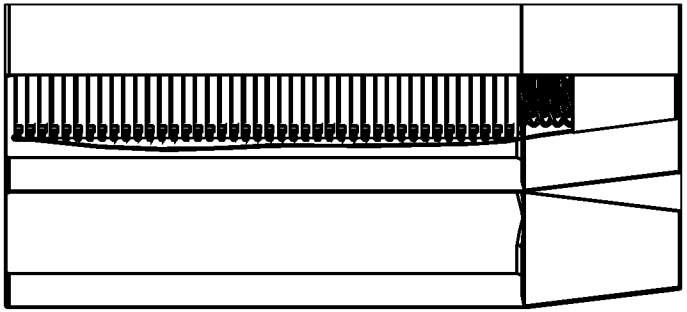

As shown in FIGS. 37A and 37B, each boss 220 may be positioned within a recess 222 in the bottom surface of top pad 136, to further prevent inadvertent displacement of the top end 158 of the spring 134. The bosses 220, if used, may be of the same material as the top pad 136, or they may be separate pieces adhered to the top pad.

Referring to FIGS. 38, 39 and 40, because the spring caps are separable from each other, and from the springs 134, and because the springs have a conical taper, the springs 134 and the spring caps may be stacked into compact columns for storage and transport. As shown in FIG. 38, the springs 134 may be nested into each other to form a compact column of springs 232. The spring caps can then be formed into a column of spring caps 234 which is placed over or around the column of springs 232, as shown in FIG. 39. A cup 230 may be placed over the top end of the column of springs 232. The column of spring caps 234 containing the column of springs 232 may be placed into a compact container 236 for transport or storage. The top pad 136 and side pads 138 may be stored as is, or they may be rolled, folded or compressed. The mattress 130 accordingly can be shipped and stored in a minimized space. If the spring caps are provided with an alignment hole 177 as shown in FIG. 32A, a rod may inserted through the alignment holes to help keep the spring caps aligned into a column.

In the designs described above, with the mattress in use, each spring of the spring core is subject to forces individually so that each spring may deflect largely independently of adjoining the springs. The springs can extend and retract individually according to a body contour. Thus, the mattress can evenly and properly support different weights of different positions of the human body. This can help to keep the sleeper's spine straight and flat and provide more comfortable sleep. When force is exerted on one area, other areas do not move. If one sleeper turns and twists, another sleeper on the mattress will not be affected. The cone springs having a smaller diameter top coil and a larger diameter bottom coil can make the deformation of the springs more stable when a force acts on the springs in a diagonal direction, so that left-right swing or noise generated due to spring friction can be reduced or avoided.

The springs may be arranged in a rectangular shape as shown in FIGS. 26 and 28 or a diamond shape as shown in FIG. 29. The diamond shape arrangement of FIG. 29 can effectively improve the spring coverage rate, reduce inter-spring gaps, and enhances the comfort of the mattress.

The present mattress has a simple structure that allows the mattress to be quickly and easily assembled and dis-assembled. The mattress can be cleaned and washed conveniently in a way that not only the cover 140 can be washed, but the springs 134 can also be cleaned, and the mattress can be hung under the sun regularly for cleaning and airing.

During transportation and storage, the springs may be stacked one above another to achieve effective packaging, and the soft structures such as the top and side pads may be compressed, folded or packaged, greatly reducing storage space requirements. The mattress can be carried in a vehicle so that people can enjoy a home-style normal spring mattress outdoors.

Since the springs have a very long service life, when the cover 140 needs to be changed, the springs may be reused. Alternatively, one set of springs can match with many sets of cover materials in use. When the mattress is damaged and needs to be disposed or recovered, disposal processing is simple and inexpensive due to the detachable structure of the mattress.

As shown in FIGS. 41-44, an upper ring-shaped plastic member 302 and a lower ring-shaped plastic member 303 are provided, wherein positioning shafts 304 are provided at an upper end face and a lower end face of the upper ring-shaped member, and can be engaged into positioning holes 307 formed on the lower ring-shaped member. After the spring 305 is installed in the lower ring-shaped plastic member, the upper ring is locked with the lower ring-shaped member by the positioning shafts 304, and then the spring is fixed as shown in FIG. 42. After each set of plastic members are assembled with the spring, they can be reliably stacked one above another by the positioning shafts and positioning holes as shown in FIG. 43, to provide a stack of conical springs, with D1 greater than or equal to D0+2*n*d, wherein, D1 represents a larger diameter of the spring, D0 represents a smaller diameter of the spring, n represents the number of coils of the spring, and d represents a wire diameter of the spring. The connection design is as shown in FIG. 44 The design of FIGS. 41-44 may be used in the elastic modules or spring assemblies to provide the pads and mattresses discussed above relative to FIGS. 1-40.

Turning to FIGS. 45 to 49, a spring mattress is divided into a plurality of independently ascending and descending sections or blocks 306, shown as sections 1-9 in FIG. 48. Each block may either be driven by a motion mechanism 308 to rise and fall independently, or be linked together to perform a controlled movement. This kind of spring mattress may be applied to a functional bed, a functional sofa, a health care bed, a functional mattress and the like. It can implement the deformation function of the functional bed or the like by virtue of rising and falling blocks, and achieve purposes such as improving human body comfort, stop snoring, providing zero gravity, stretching and pressing. It can also provide simple massage by fast moving the lifting mechanisms via an electrical control.

Each set comprises at least one spring which may be a conical helical spring, a cylindrical helical spring, a middle-convex helical spring or a middle-concave helical spring. A sponge structure 310 is attached to the top of the spring, and a mounting base 312 is provided at the bottom of the spring. Referring to FIGS. 45-47, the base may be pushed by at least one driving mechanism 308 such as a gas cylinder, a hydraulic cylinder or an electrically-driven cylinder to implement ascending and descending of the spring set. Alternatively, the ascending and descending of the spring set may be implemented by the cooperation of a motor and a cam or an eccentric bearing, or by inflation and deflation of an air bag mounted below the base of the spring.

Figure 51:
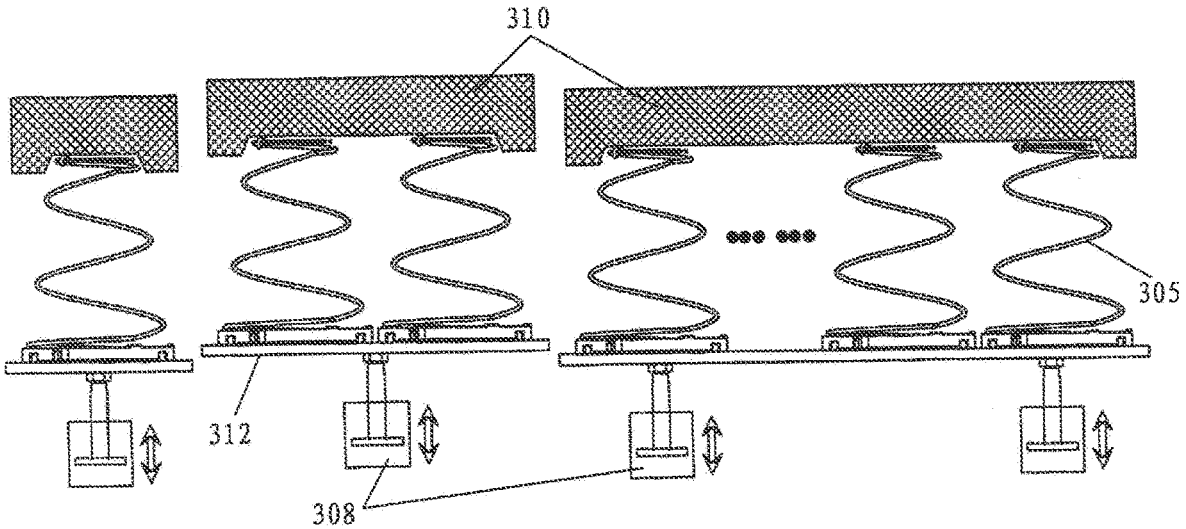

As shown in FIGS. 48 and 49, the sections 1-9 can be distributed either regularly or irregularly, and each block may be moved vertically independent of the other blocks. As shown in FIG. 51 different blocks may have varying numbers of spring assemblies and actuators.

Figure 50:
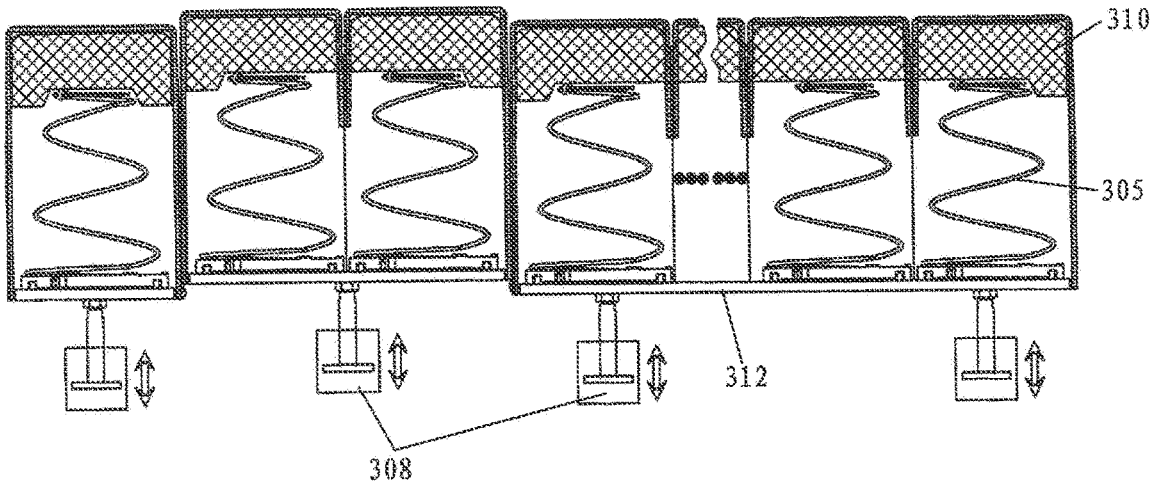
Figure 52:
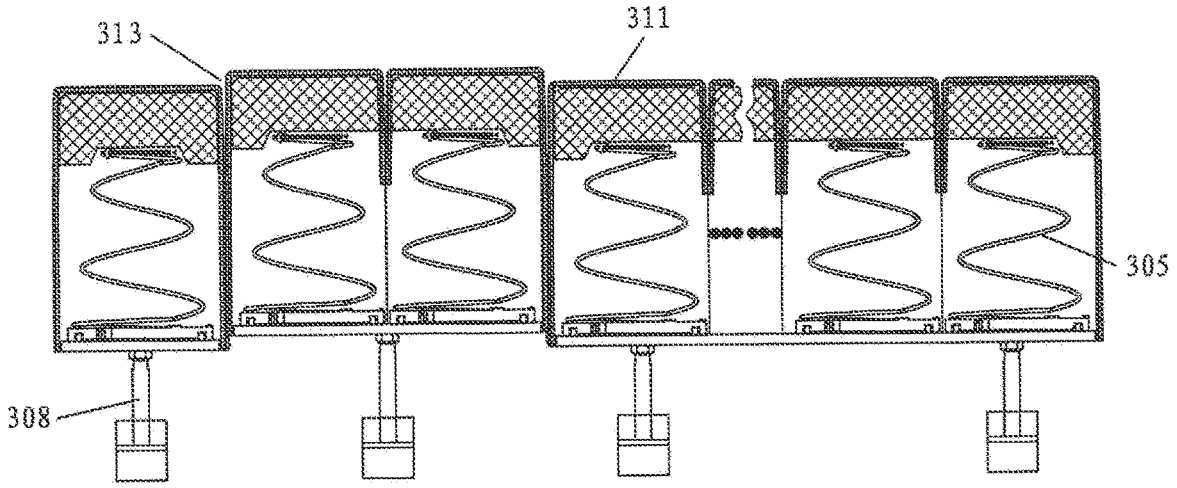
Figure 53:
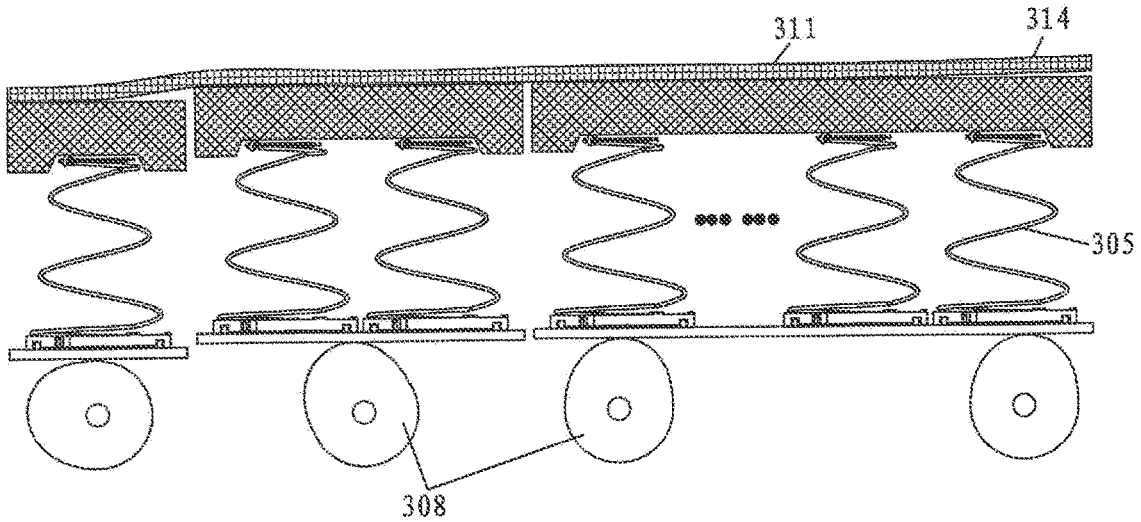
Figure 54:
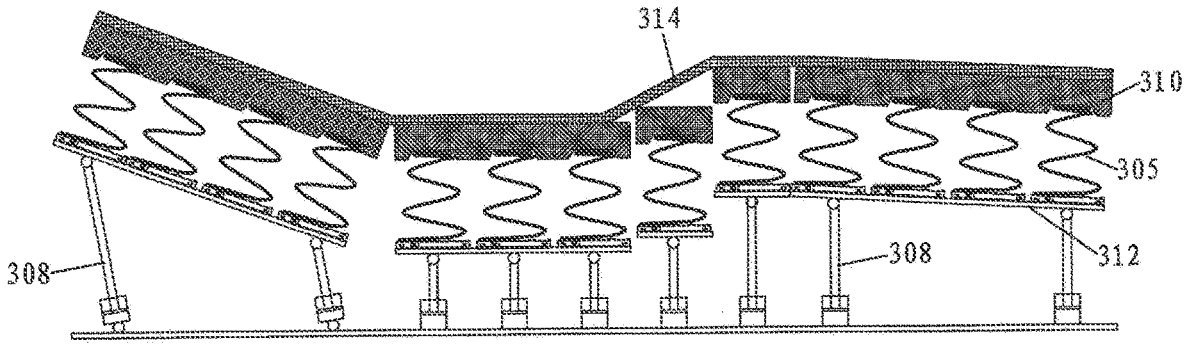

In FIGS. 52 and 54, a covering 311 of the whole spring mattress may employ a flat and smooth fabric or material or the outer appearance of the covering material may be formed as block-shaped protrusions while the sponge at the top of the springs is partially recessed properly, so that the whole mattress looks natural and attractive when the respective spring sets rise and fall. The fabric may be elastic. The fabric may be pre-formed with pleats 313 configured to fit in between adjacent sections, as shown in FIG. 50. As shown in FIG. 53, a foam or quilted top layer 314 may be provided on top of the sections 1-9.

In FIGS. 52-54, gaps may be provided between adjacent blocks so that the proper ascending and descending of the blocks can maximize a contact area of a human body lying on the mattress and the mattress maintains the spine in a horizontal state, thereby achieving an optimal sleeping experience.

Movement and positioning of the spring blocks may be controlled by an electrical signal control or APP application control. If the frequency of rising and falling the blocks is increased, a vibration or impact massaging effect may be achieved.

As shown in FIG. 54, by controlling each spring block to rise and fall properly, a zero gravity function of the mattress may be achieved, in which a user's legs are lifted to a position higher than the level of the heart, and his back and legs form an angle of 126±7 degrees. Additionally, cyclically and repeatedly ascending and descending the blocks enables the mattress to press and extend the human body so as to relax the user and reduce fatigue. Suitable sensors and control systems may be used in cooperation. When a sleeper snores during sleep, spring blocks near the neck and head are lifted to an inclination angle (about 15 degrees) to reduce or stop the snoring. Also as shown in FIG. 54, the actuators may be pivotally attached to the sections 1-9.

A control system may store the rising and falling position of each spring block in memory so that a number of memory modes may be implemented. When each of the spring blocks is adjusted in a suitable position for the first time, it may be quickly adjusted to the most conformable position from then on.

The structure of the spring sets lifting and falling in blocks may also be applied to a medical care bed and a daily-used sofa or couch and may realize functionalized and intelligent medical care bed and sofa in cooperation with an intelligent control system.

In each of the embodiments described above, the elastic modules or spring assemblies may be attached to each other using only the module connecting structures described, so that no separate lateral or longitudinal couch or bed frame slats or structural elements or connecting strips are needed. A perimeter frame around the perimeter of a spring pad or mattress made up of the elastic modules or spring assemblies may optionally be used to provide an improved appearance, and to further hold them in place. No base or tray is needed underneath the elastic modules or spring assemblies to support or hold them in place.

Generally, a spring pad or mattress may be assembled with the end members 2 or the spring caps placed edge-to-edge, in contact with each other, and with no space or gap between them. Each end member or spring cap is generally directly attached to four adjacent end members or spring caps, except at the corners and edges where each end member or spring cap is attached to two or three others. The spring pads and mattresses described typically have no rigid or hard element at the top, so as to provide a comfortable support surface for the user. Specifically, the top of the elastic module may include only the outer covering layer made of a soft foam material, which material may have a low thermal conductivity so as to act as an insulator.

As described above the elastic modules and spring assemblies may be assembled without any intermediate elements between them, for example without any walls or dividers between them. The elastic modules and spring assemblies can be provided as substantially simple mechanical elements, without any electrical components or wiring.

Various changes and substitutions may of course be made without departing from the spirit and scope of the invention. The present specification and examples are considered to be exemplary, and the true scope of the present invention is defined by the appended claims and the equivalent solution thereof. The invention, therefore, should not be limited, except to the following claims, and their equivalents.

What is claimed is:

1. A mattress comprising:

a plurality of individual spring assemblies, each spring assembly including a single spring and a single spring cap, each spring cap comprising a body;

at least one first attachment fitting and at least one second attachment fitting on the body, each first attachment fitting engageable into or onto and removable from a second attachment fitting of an adjoining spring cap;

each spring assembly attached to at least two other spring assemblies by the first and second attachment fittings, forming the individual spring assemblies into a spring core;

wherein the body comprises a coil floor extending radially inwardly from a coil wall and the attachment fittings are on the coil wall.

2. The mattress of claim 1 wherein the individual spring assemblies are formed into a spring core, further including a top pad on top of the spring core.

3. The mattress of claim 2 wherein the coil wall is circular.

4. The mattress of claim 2 wherein the first attachment fitting is an up-facing hook and the second attachment fitting is a down-facing hook.

5. The mattress of claim 2 wherein the first and second attachment fittings each comprises a spring clip having a first slot and a second slot, wherein a bottom coil of the spring is in the first slot.

6. The mattress of claim 3 further comprising:

left and right side first attachment fittings and left and right side second attachment fittings, the first attachment fittings on a first side of the body and the second attachment fittings on a second side of the body;

the left side first and second attachment fittings aligned on a first chord parallel to a diameter of the body intersecting the first and second sides of the body, and the right side first and second attachment fittings aligned on a second chord parallel to the diameter and parallel to the first chord; and the first chord and the second chord equidistant from the diameter of the body.

7. The mattress of claim 6 wherein the first attachment fittings comprise pins and the second attachment fittings comprise complementary pin holes.

8. The mattress of claim 6 further comprising tabs on the coil floor projecting radially inwardly towards a center of the body of the spring cap, to help retain a bottom coil of the spring onto the spring cap.

9. The mattress of claim 6 further including a spring end socket on the body to hold an end of the spring.

10. The mattress of claim 6 wherein the spring is removable from the spring cap to allow the springs to be stacked into a spring column.

11. The mattress of claim 6 wherein the body includes left and right side frames providing the body with straight and parallel left and right sides.

12. The mattress of claim 6 wherein the left and right side first attachment fittings each comprises a pivot tab pivotally attached to the body, and the left and right side second attachment fittings each comprise a pin projecting from the body, each pivot tab pivotable to a closed position wherein the pivot tab engages a pin of an adjoining spring cap to hold adjoining spring caps together.

13. The mattress of claim 6 wherein the left and right side first attachment fittings each comprise a release tab and the left and right side second attachment fittings each comprise a pin projecting from the body, each release tab movable to allow the pin of an adjoining spring cap to be withdrawn, to detach adjoining spring caps.

14. The mattress of claim 3 wherein the body is hexagonal and the body includes side tabs and side slots, each side tab dimensioned to fit into a side slot of an adjacent spring cap.

15. The mattress of claim 14 wherein the body includes a side post on a first side of the body and a complementary side socket on a second side of the body.

16. The mattress of claim 3 wherein the body is hexagonal, further including first and second side plates extending radially outward from adjacent sides of the spring cap body, and a plate hook projecting from each side plate, the plate hook having a height and a curvature corresponding to an inside diameter of a bottom coil of the spring.

17. A mattress comprising:

a plurality of individual spring assemblies, each spring assembly including a single spring and a single spring cap, each spring cap comprising an annular rigid body having a coil floor extending radially inwardly from a coil wall, the coil floor perpendicular to the coil wall;

two first attachment fittings and two second attachment fittings on the coil wall, each first attachment fitting engageable into or onto and removable from a second attachment fitting of an adjacent spring cap;

each spring assembly attached to at least two other spring assemblies, the spring assemblies attached to each other by the first and second attachment fittings, forming the individual spring assemblies into a spring core; and a top pad on top of a top end of the spring core.

18. The mattress of claim 17 further comprising tabs on the coil floor projecting radially inwardly towards a center of the body of the spring cap, to help retain a bottom coil of the spring onto the spring cap.

19. The mattress of claim 17 wherein a bottom coil of the spring is removable from the spring cap to allow the springs to be stacked into a spring column.

20. A mattress comprising:

a plurality of individual spring assemblies, each spring assembly including a spring and a spring cap, each spring cap comprising a rigid annular plastic or metal body having a coil floor extending radially inwardly from a coil wall, the coil floor perpendicular to the coil wall;

left and right side first attachment fittings and left and right side second attachment fittings, the first attachment fittings on a first side of the body and the second attachment fittings on a second side of the body;

the left side first and second attachment fittings aligned on a first chord parallel to a diameter of the body intersecting the first and second sides of the body, and the right side first and second attachment fittings aligned on a second chord parallel to the diameter and parallel to the first chord, the first chord and the second chord equidistant from the diameter of the body;

each spring assembly attached to at least two other spring assemblies via the first and second attachment fittings, forming the individual spring assemblies into a spring core; and a top pad on top of a top end of the spring core.

* * * * *